US007316734B2

(12) United States Patent
Ohta et al.

(10) Patent No.: US 7,316,734 B2
(45) Date of Patent: Jan. 8, 2008

(54) VOLATILE ORGANIC COMPOUND TREATMENT APPARATUS

(75) Inventors: Koji Ohta, Tokyo (JP); Masaki Kuzumoto, Tokyo (JP); Yasuhiro Tanimura, Tokyo (JP); Hajime Nakatani, Tokyo (JP); Toshiaki Yoshizumi, Tokyo (JP); Hideo Ichimura, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 304 days.

(21) Appl. No.: 11/155,826

(22) Filed: Jun. 20, 2005

(65) Prior Publication Data

US 2005/0284295 A1 Dec. 29, 2005

(30) Foreign Application Priority Data

Jun. 29, 2004 (JP) ..... 2004-191949
Nov. 29, 2004 (JP) ..... 2004-344084
Mar. 23, 2005 (JP) ..... 2005-084189

(51) Int. Cl.
*B03C 3/36* (2006.01)

(52) U.S. Cl. ..... 96/19; 95/3; 95/12; 95/78; 95/141; 96/25; 96/60; 96/68; 96/73; 96/80; 96/99; 96/111; 96/116; 96/121

(58) Field of Classification Search ..... 96/19, 96/25, 30, 31, 60, 68, 69, 73, 80, 99, 111, 96/115, 116, 121, 154; 95/3, 11–13, 78, 95/141
See application file for complete search history.

(56) References Cited

U.S. PATENT DOCUMENTS 3,365,858 A * 1/1968 Penney ..... 95/73
4,509,958 A * 4/1985 Masuda et al. ..... 96/60
4,533,368 A * 8/1985 Snaddon et al. ..... 96/26
4,624,763 A * 11/1986 Chimenti ..... 204/562
4,702,752 A * 10/1987 Yanagawa ..... 96/68
4,781,736 A * 11/1988 Cheney et al. ..... 96/60

(Continued)

FOREIGN PATENT DOCUMENTS

GB 2195922 A * 4/1988 ..... 96/60

(Continued)

OTHER PUBLICATIONS

Hyun-Ha Kim, et al. "Optimization of Plasma-Driven Catalysis for the Decomposition of Benzene Using Ag/$TiO_2$ Catalyst", Proceedings of the Institute of Electrostatics Japan 2004 Annual Meeting, 16aB-6, pp. 21-26, Sep. 16, 2004.

*Primary Examiner*—Richard L. Chiesa
(74) *Attorney, Agent, or Firm*—Oblon, Spivak, McClelland, Maier & Neustadt, P.C.

(57) ABSTRACT

A volatile organic compound treatment apparatus including an adsorber coming into contact with a gas to be treated and adsorbing volatile organic compounds; a plurality of pairs of electrodes, divided into a plurality of groups, which generate electric discharge so that a part of the adsorber is exposed to the electric discharge; and an electric discharge control mechanism for controlling whether or not the electric discharge is generated in what pair of the electrodes by applying a voltage to every group of the pair of electrodes such that different parts of the adsorber are sequentially exposed to the electric discharge.

9 Claims, 45 Drawing Sheets

U.S. PATENT DOCUMENTS

2004/0045438 A1* 3/2004 Place et al. ..... 95/141

FOREIGN PATENT DOCUMENTS

JP 08-229345 9/1996
JP 2002-126445 5/2002
JP 3395432 2/2003
JP 2004-82097 3/2004

* cited by examiner

VOLATILE ORGANIC COMPOUND TREATMENT APPARATUS

CROSS-REFERENCE TO RELATED APPLICATION

This application claims priority, under 35 U.S.C. §119 (a)-(d), to Japanese patent applications: No. 2004-191949, filed on Jun. 29, 2004; No. 2004-344084, filed on Nov. 29, 2004; No. 2005-084189, filed on Mar. 23, 2005.

BACKGROUND OF THE INVENTION

1. Field of the Invention

This invention relates to a volatile organic compound treatment apparatus which is useful for decomposition of vapors of organic solvents which, when released into the atmosphere, become harmful, for example, toluene, xylene and styrene, and other organic compounds (hereinafter abbreviated as "VOC"), that is, volatile organic compounds.

2. Description of the Related Art

Painting factories, semiconductor factories or printing factories use large quantities of organic solvents. It is known that VOC discharged into the atmosphere from such factories gives serious influences against the atmospheric environment, for example, it forms a harmful organic fine particle upon reaction with sunlight or ozone or it increases the ozone concentration in the atmosphere. For that reason, it is strongly demanded to recover VOC and make it harmless.

For the purpose of recovering VOC, a gas concentration rotor formed in a honeycomb shape supporting hydrophobic zeolite or active carbon is developed and diffused. VOC having been adsorbed and concentrated by the gas concentration rotor is decomposed by a catalyst or a combustion apparatus, made harmless and then released into the atmosphere.

An apparatus for decomposing VOC by electric discharge is also developed. The apparatus for decomposing VOC by electric discharge is constructed such that a corrugated cardboard-like VOC adsorber is interposed by a pair of electrodes along with an insulator. Before the VOC adsorber has adsorbed VOC and become saturated so that it cannot thoroughly adsorb VOC, an alternating current voltage of from 5 to 7 kV is applied between the electrodes to generate electric discharge, VOC is desorbed from the VOC adsorber by the generated electric discharge plasma, and the desorbed VOC is further decomposed into water and carbon dioxide. During the decomposition treatment of VOC by electric discharge, the gas to be treated is made to flow in the same amount as in the case where no electric discharge is generated. Incidentally, if the gas is stopped during the decomposition treatment of VOC by bringing electric discharge into contact with the VOC adsorber, the gas treatment cannot be carried out because only one VOC adsorber is present.

Incidentally, a phenomenon in which the VOC adsorber has adsorbed VOC and become saturated so that it cannot thoroughly adsorb VOC in the gas to be treated is called "breakdown" of the VOC adsorber (for example, see Japanese patent application publication no. 2002-126445, Patent Document 1).

SUMMARY OF THE INVENTION

Volatile organic compound treatment apparatus that can decompose VOC and are small in power consumption and cheap in apparatus costs without generating substances that adversely affect the environment are desired. Related-art volatile organic compound treatment apparatus for decomposing VOC involve the following problems.

(1) Since all of the VOC adsorber are treated all at once, it is necessary to make an electric discharge current, in its turn a power supply capacity large, leading to an increase of apparatus costs.

(2) Since at the time of generating electric discharge, the gas is made to flow in the same amount as in the case where no electric discharge is generated, nitrogen and oxygen in the gas react with each other by the electric discharge, thereby generating large quantities of harmful nitrogen oxides (hereinafter abbreviated as "NOx").

The volatile organic compound treatment apparatus according to this invention has been made for the purpose of solving these problems.

According to first aspect of this invention, there is provided a volatile organic compound treatment apparatus comprising: an adsorber coming into contact with a gas to be treated and adsorbing volatile organic compounds; a plurality of pairs of electrodes, divided into a plurality of groups, which generate electric discharge so that a part of the adsorber is exposed to the electric discharge; and an electric discharge control mechanism for controlling whether or not the electric discharge is generated in what pair of the electrodes by applying a voltage to every group of the pair of electrodes such that different parts of the adsorber are sequentially exposed to the electric discharge.

According to second aspect of this invention, there is provided a volatile organic compound treatment apparatus comprising: an adsorber coming into contact with a gas to be treated and adsorbing volatile organic compounds; a pair of electrodes for generating electric discharge such that a part of the adsorber is exposed to the electric discharge; and an electric discharge control mechanism for applying a voltage to the pair of electrodes and for moving either at least one-side of the pair of electrodes or the adsorber such that different parts of the adsorber are sequentially exposed to the electric discharge.

According to third aspect of this invention, there is provided a volatile organic compound treatment apparatus comprising: a plurality of gas treatment units, divided into a plurality of groups, which have an adsorber coming into contact with a gas to be treated and adsorbing volatile organic compounds, a pair of electrodes for generating electric discharge so that the adsorber is exposed to the electric discharge, and a sealable cell in which the adsorber and the pair of electrodes are contained; and an electric discharge control mechanism for applying a voltage to the pair of electrodes so as to generate the electric discharge in the groups of gas treatment units in sequence.

BRIEF DESCRIPTION OF THE DRAWINGS

The present invention will become more fully understood from the detailed description given herein below and the accompanying drawings which are given by way of illustration only, and thus are not limitative of the present invention and wherein.

DETAILED DESCRIPTION OF THE EMBODIMENTS

Embodiment 1

Figure 1:
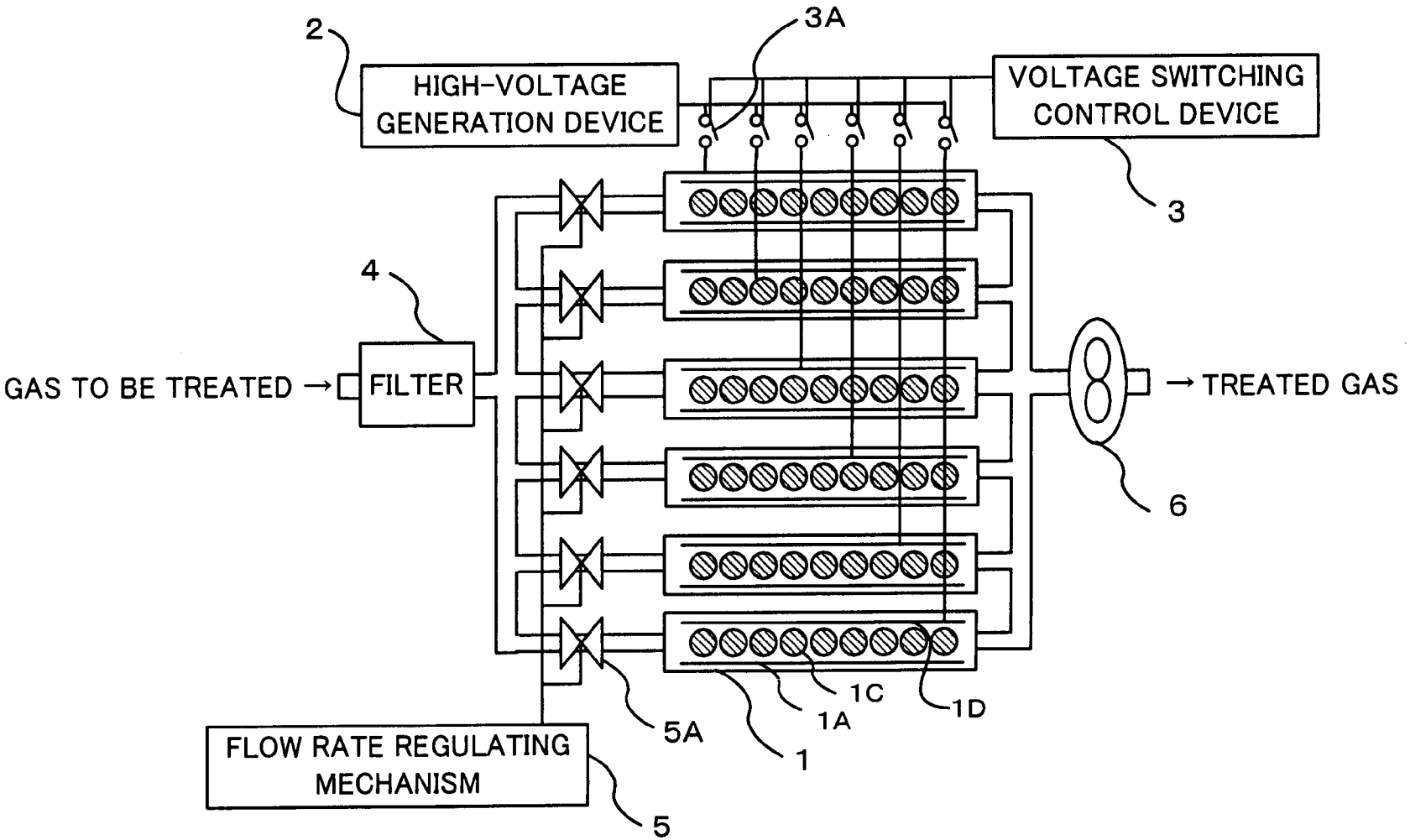
FIG. 1 is a system block diagram of a volatile organic compound treatment apparatus in Embodiment 1 of this invention.

FIG. 1 is a system block diagram of a volatile organic compound treatment apparatus (hereinafter abbreviated as "VOC treatment apparatus") in Embodiment 1. The VOC treatment apparatus has the prescribed number of a gas treatment unit 1 which is divided into the prescribed number (two or more) of groups and in which a gas is supplied in parallel and VOC is decomposed by electric discharge; a high-voltage generation device 2 for generating an alternating current high voltage for causing electric discharge; a voltage switching control mechanism 3 for applying a high voltage to high-voltage electrodes of any one of the gas treatment units 1; a filter 4 provided in a gas inlet port; a flow rate regulating mechanism 5 for regulating the flow rate of the gas flowing into each of the gas treatment units 1; and an exhaust fan 6. Here, the voltage switching control mechanism 3 is an electric discharge control mechanism in this invention. Incidentally, it should be noted that the group of the gas treatment unit 1 has one or more gas treatment units 1.

The gas treatment unit 1 has adsorber 1C for adsorbing VOC and an earthed electrode 1A and a high-voltage electrode 1D as a pair of electrodes for generating electric discharge.

The VOC treatment apparatus exhausts a gas from the apparatus by the exhaust fan 6, thereby sucking the same amount of a gas from the inlet port. The gas that the VOC treatment apparatus sucks is called a gas to be treated, and the gas that is exhausted from the VOC treatment apparatus is called a treated gas. It is an appointed task of the VOC treatment apparatus to convert the treated gas into clean air not containing VOC and NOx.

The filter 4 is one for removing components having a high viscosity and capable of being relatively easily separated from the gas to be treated, such as paint scum and oils. Though the filter 4 is useful, it is not essential in the VOC treatment apparatus. When a gas to be treated does not contain components that can be removed by the filter 4, such as the case where a gas after treatment by another apparatus is the gas to be treated, the filter 4 is not necessary.

Figure 2A:
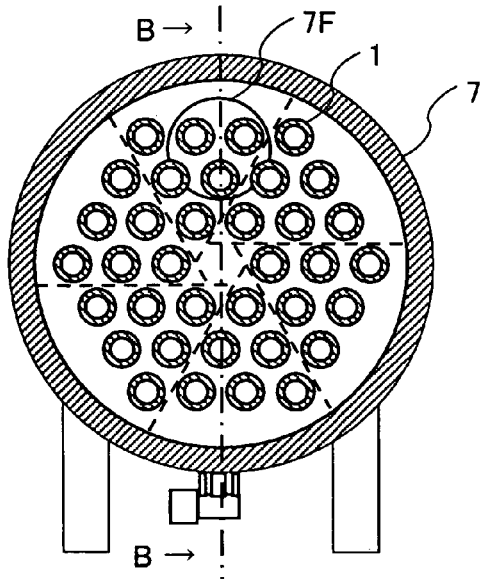
FIG. 2A is a lateral cross sectional view to explain the structure of a VOC treatment apparatus in Embodiment 1 of this invention.
Figure 2B:
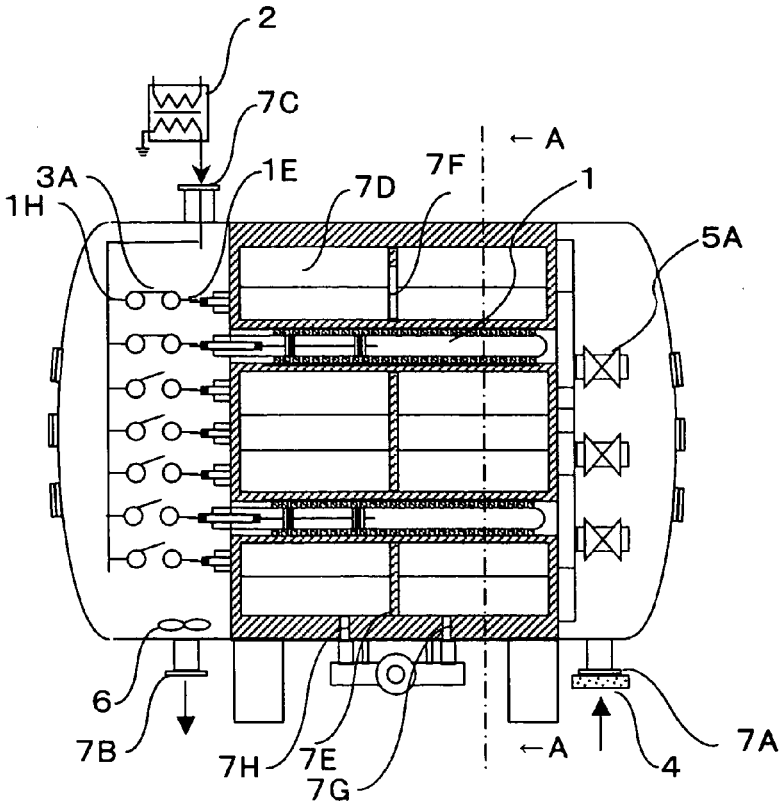
FIG. 2B is a longitudinal cross sectional view to explain the structure of a VOC treatment apparatus in Embodiment 1 of this invention.
Figure 3A:
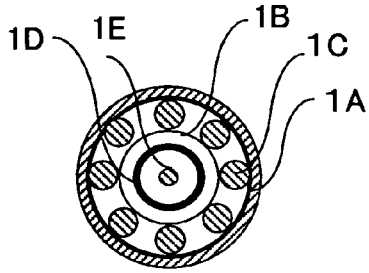
FIG. 3A is a lateral cross sectional view to explain the structure of a gas treatment unit in Embodiment 1 of this invention.
Figure 3B:
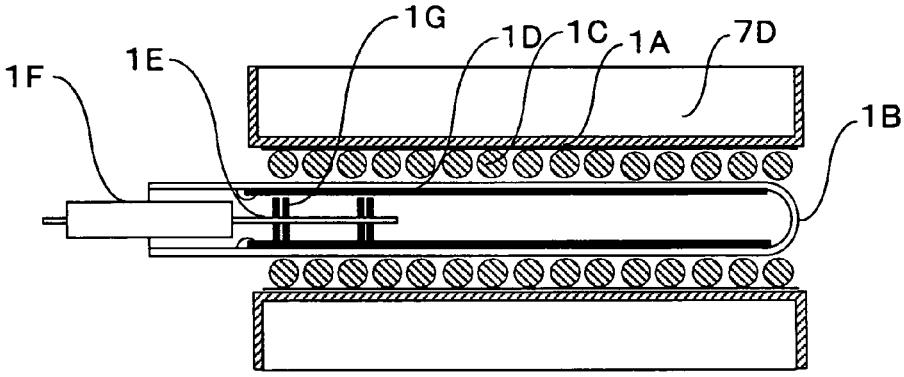
FIG. 3B is a longitudinal cross sectional view to explain the structure of a gas treatment unit in Embodiment 1 of this invention.

FIG. 2A and FIG. 2B are views to explain the structure of the VOC treatment apparatus. FIG. 2A is a lateral cross sectional view, and FIG. 2B is a longitudinal cross sectional view, respectively. Also, FIG. 3A and FIG. 3B are views to explain the structure of one gas treatment unit 1. FIG. 3A is a lateral cross sectional view, and FIG. 3B is a longitudinal cross sectional view, respectively. Incidentally, the cross sectional view of the BB cross-section in FIG. 2A is shown in FIG. 2B and FIG. 3B; and the cross sectional view of the AA cross section in FIG. 2B is shown in FIG. 2A and FIG. 3A.

As is noted from FIG. 2A, this Embodiment 1 contains thirty-six gas treatment units 1 which are divided into six groups of every 6 units in a container 7 having a circular cross section. In FIG. 2A, the broken lines mean divisions of groups of the gas treatment units 1. As shown in FIG. 2B, every group is provided with a valve 5A for regulating the flow rate of the gas. In FIG. 2B, a gas to be treated comes into the VOC treatment apparatus from an inlet port 7A provided in the right bottom of the container 7; passes through valves 5A; is treated by the gas treatment units 1 disposed in parallel; and is then discharged as a treated gas from an exhaust port 7B provided in the left bottom of the container 7. The filter 4 is provided in the outside of the inlet port 7A, and the exhaust fan 6 is provided nearby the inside of the exhaust port 7B. Incidentally, in FIG. 2B, the outside of the container 7 is not a cross sectional view but is drawn as a drawing seen from the side face.

As shown in FIG. 3, one gas treatment unit 1 is constructed of a cylindrical earthed electrode 1A; a cylindrical glass tube 1B having a hemi-sphere in one end thereof as provided inside the earthed electrode 1A; adsorber 1C is disposed fully in a space between the glass tube 1B and the earthed electrode 1A; a cylindrical high-voltage electrode 1D as disposed in intimate contact with the inner surface of the glass tube 1B; a high-voltage conductor 1E for connecting the high-voltage electrode 1D to the voltage switching control device 3; a fuse 1F which is cut when an electric current flowing into the high-voltage conductor 1E exceeds a tolerable value; and a brush-like supporting member 1G for supporting the high-voltage conductor 1E and passing an electric current within the glass tube 1B. A gap between the earthed electrode 1A and the high-voltage electrode 1D is set up at a value at which electric discharge can be generated at a high voltage to be applied. The adsorber 1C is made of a spherical hydrophobic zeolite, and the diameter of the hydrophobic zeolite is adjusted to be substantially equal to the gap between the earthed electrode 1A and the glass tube 1B. In this way, one line of the hydrophobic zeolite enters the high-voltage electrode 1D and the glass tube 1B.

A part of the adsorber 1C present in the whole of the VOC treatment apparatus is present in each gas treatment unit 1. For that reason, when a high voltage is applied to the high-voltage electrode 1D of the gas treatment unit 1, a part of the adsorber 1C is exposed to electric discharge. Also, the gas treatment unit 1 is provided with a pair of electrodes composed of the earthed electrode 1A and the high-voltage electrode 1D, and the group of the gas treatment unit 1 is a group of pairs of electrodes.

The high-voltage conductor 1E of the fuse 1F in the left side of the drawing is connected to a voltage switching element 3A. The voltage switching element 3A is provided in every gas treatment unit 1. A high-voltage conductor 1H to be connected to a terminal of the high-voltage generation device 2 provided in the outside of the container 7, at which a high voltage is generated, comes into the container 7 from a high-voltage conductor inlet port 7C and is connected to one terminal of each voltage switching element 3A. The high-voltage conductor 1E is connected to the other terminal of the voltage switching element 3A, and when the voltage switching element 3A is turned on, a high voltage is applied to the high-voltage electrode 1D of the corresponding gas treatment unit 1. Portions to which a high voltage is applied, such as the high-voltage conductor 1E and the high-voltage conductor 1H, are subjected to necessary insulation. An earthed terminal of the high-voltage generation device 2 and the earthed electrode 1A of each gas treatment unit 1 are electrically connected to each other, an aspect of which is, however, not shown in the drawings. Also, the high-voltage conductor inlet port 7C is made so as to have necessary air tightness.

As shown in FIG. 2A, every one gas treatment unit 1 is housed in a hole formed in the container 7. Incidentally, the earthed electrode 1A is disposed on the side face of the hole formed in the container 7, necessary wiring is carried out, and other constituent elements are then inserted, thereby completing the gas treatment unit 1. There is a sealable cavity 7D between the container 7 and the hole in which the gas treatment unit 1 is housed. Water for cooling is filled in this cavity 7D and circulated. A bulkhead 7E is provided in the central position of FIG. 2B of the cavity 7D, and one through-hole 7F is provided in the upper portion of the bulkhead 7E. A cooling water feed port 7G is provided in the position of the right side as compared with the bulkhead 7E in the lower side of the container 7. A cooling water discharge port 7H is provided in the position of the left side as compared with the bulkhead 7E in the lower side of the container 7. Water which has come into the cavity 7D from the cooling water feed port 7G moves upwardly because of the presence of the bulkhead 7E; passes through the though-hole 7F; moves in the left side of the bulkhead 7E; and further moves downwardly; and is then discharged from a cooling water discharge port 7H.

Next, the action will be described. First of all, the action state of the gas treatment unit 1 is described. The gas treatment unit 1 takes two action states of an action state A and an action state B. The action state A is a state in which the valve 5A is opened and a high voltage is not applied to the high-voltage electrode 1D and an action state in which the adsorber 1C absorbs VOC. On the other hand, the action state B is a state in which the valve 5A is closed and a high voltage is applied to the high-voltage electrode 1D, whereby electric discharge is generated between the earthed electrode 1A and the high-voltage electrode 1D. In the action state B, an alternating current of about 10 kV is applied at about 1 kHz to the high-voltage electrode 1D. Then, a stable electric discharge is generated between the outer surface of the glass tube 1B as a dielectric surrounding the high-voltage electrode 1D and the inner surface of the earthed electrode 1A. Incidentally, ceramic tubes made of alumina, zirconia, or other ceramics or ceramic-sprayed glass-lined tubes may be used in place of the glass tube as a dielectric.

When the adsorber 1C is exposed to electric discharge, the temperature rises, and the adsorbed VOC is released. The released VOC collides with an electron or reacts with active species such as an oxygen atom and ozone as generated by the electric discharge, whereby it is decomposed into water and carbon dioxide. VOC is desorbed from the adsorber 1C, and the adsorber 1C is regenerated in such a state that it can adsorb VOC.

The life of the oxygen atom having a stronger power for decomposing VOC than ozone is short as about 1 μ-second so that when generated, it becomes extinct within a period when it does not substantially move. For that reason, the decomposition of VOC by the oxygen atom is carried out nearby the place where the electric discharge is generated. Since the life of ozone is relatively long as about 100 seconds, even in a place far from the place where the electric discharge is generated within the gas treatment unit 1, if ozone moves, the ozone reacts with VOC, thereby decomposing VOC.

Figure 4:
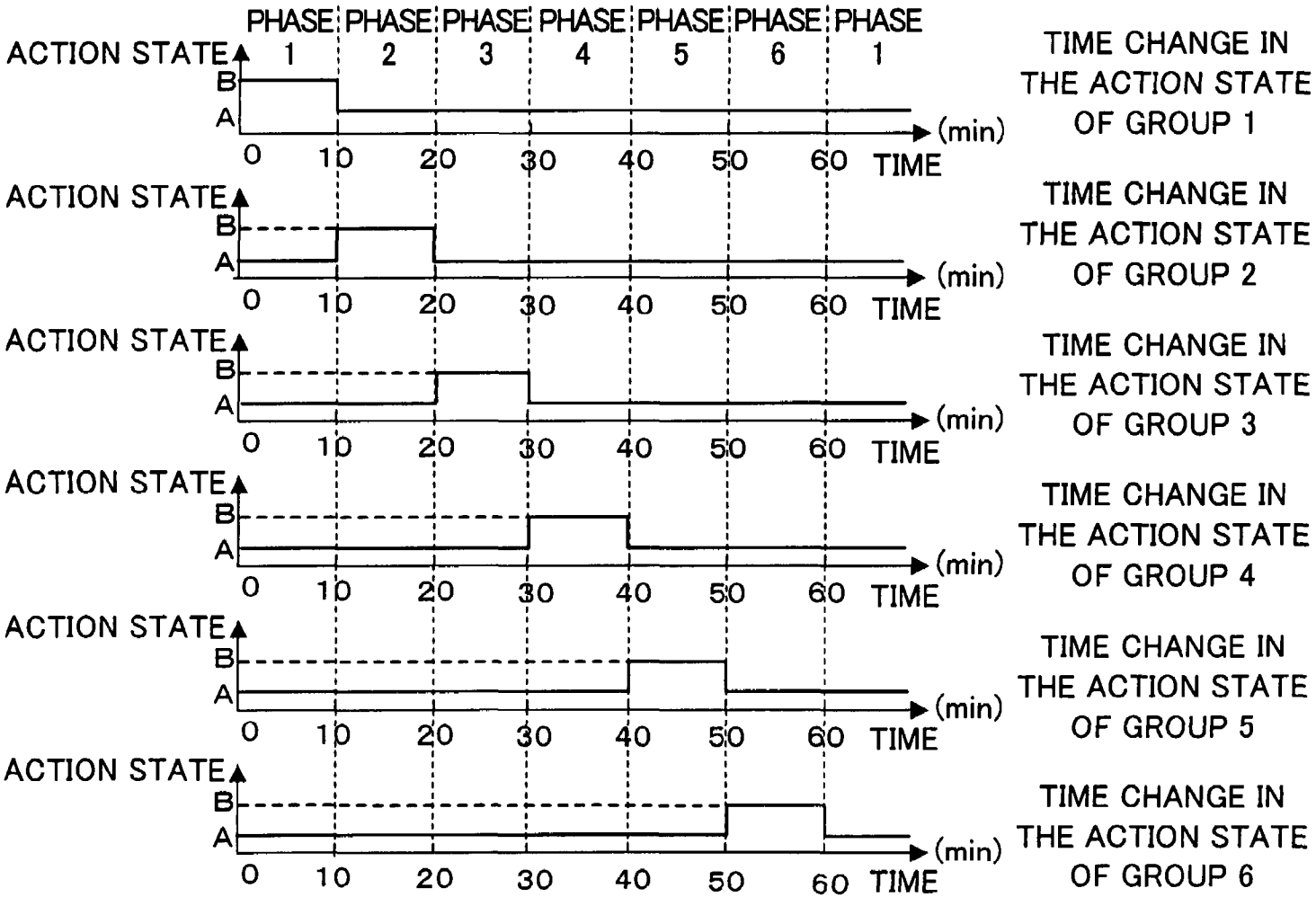
FIG. 4 is a view to explain the sequence of the action states that groups of gas treatment unit take in a control system of a VOC treatment apparatus in Embodiment 1 of this invention.

FIG. 4 is a view to explain the sequence of the action states which the groups of the gas treatment unit 1 take in a control system of the VOC treatment apparatus. FIG. 4 includes from a phase 1 to a phase 6; and in a phase n, a group n is in the action state B, with the remainder being in the action state A. The action is repeated by changing from the phase 1 to the phase 6 in sequence and returning to the phase 1 after the phase 6. In this Embodiment 1, one phase is adjusted at 10 minutes so that one period becomes 60 minutes.

Figure 5:
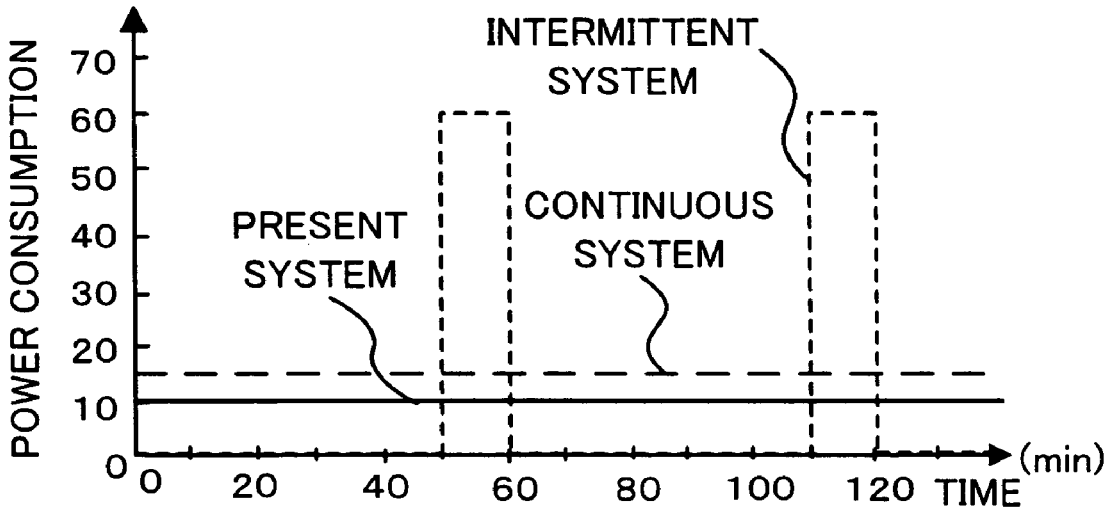
FIG. 5 is a view to explain an effect of a control system of a VOC treatment apparatus in Embodiment 1 of this invention.

FIG. 5 is a view to explain an effect of the system by the sequence of FIG. 4 (hereinafter called "the present system"). In FIG. 5, the abscissa shows a time axis, and the ordinate shows a power consumption of the VOC treatment apparatus. The solid line means the present system; the broken line means a continuous system (as described later); and the dotted line means an intermittent system (as described later), respectively. It is noted from FIG. 5 that the present system is smaller in power consumption than any of the continuous system and the intermittent system. Incidentally, with respect to the integrated value of power consumption in one period, the present system is substantially equal to the intermittent system, and the continuous system is larger than any of the present system and the intermittent system.

Here, the intermittent system is a system in Patent Document 1, in which after thoroughly adsorbing VOC onto the adsorber 1C, all of the adsorber are brought into contact with electric discharge and treated at the same time while passing the gas to be treated. The continuous system as referred to herein is a system in which electric discharge is continuously generated while passing the gas to be treated, thereby always regenerating the adsorber 1C.

As described in Patent Document 1, when the concentration of VOC increases, the amount of energy required for the treatment of VOC becomes small. As described previously, VOC collides with the electrically discharged electron or reacts with active species such as an oxygen atom and ozone as generated by the collision of the electrically discharged electron with an oxygen molecule, whereby it is decomposed. For that reason, when the concentration of VOC in the gas to be treated increases, not only the probability of reaction of VOC with active species or an electron becomes high but also the treatment efficiency becomes high. Thus, in the continuous system in which VOC is not concentrated, the power consumption becomes large as compared with that in the present system and the intermittent system in which VOC is concentrated.

Now, when the present system is compared with the intermittent system, according to the intermittent system, since substantially the same electric energy as in the present system is consumed within a short period of time, the power supply capacity of the apparatus becomes large, and the costs of the power supply device becomes high. On the other hand, according to the present system, since VOC can be decomposed with high efficiency by consuming a steadily small electric power, the power supply capacity of the apparatus can be made small, whereby the low costs of the VOC treatment apparatus can be realized.

The number of group of the gas treatment unit 1, the period of treatment, the power consumption, and so on are determined such that they become suitable values corresponding to the convention of VOC and the amount of the gas to be treated as assumed. Since it is necessary that the adsorber does not cause breakdown, in large-sized apparatus capable of using a large amount of the adsorber, the treatment period becomes long, while in small-sized apparatus, it becomes short. Even in the case where the VOC concentration varies, when averaged in terms of a period, the longer the period, the higher the probability that the amount of VOC falls within a prescribed range, whereby it is possible to make the probability of breakdown of the adsorber small. When the number of group of the gas treatment unit 1 is high, the amount of the adsorber that is desorbed at once becomes small. Accordingly, there is high possibility that the power supply capacity can be made smaller. In order that the adsorber may desorb VOC, even when the amount of the adsorber is small, the treatment with electric discharge may preferably be carried out for a prescribed period of time. Accordingly, even in the case where the number of group is increased, the time for taking the action state B in each group may preferably be this prescribed period of time or longer. The power consumption is defined to be a value at which in the case of adsorbing the maximum amount of VOC as assumed, VOC can be desorbed and decomposed within the period of time when the gas treatment unit 1 takes the action state B.

In the present system, it is designed that the gas to be treated does not flow into the gas treatment unit 1 in the action state B. This is because NOx is to be not generated as far as possible. When electric discharge energy is injected, a high-speed electron is formed, and when the formed high-speed electron collides with an oxygen molecule and a nitrogen molecule in the gas to be treated, harmful NOx is formed. When the gas flow is stopped at the time of the electric discharge treatment, though the NOx concentration within the gas treatment unit 1 increases, since the gas amount is small, the amount of NOx as formed becomes small. When the NOx concentration in the gas is about 3%, the decomposition and the formation of NOx are balanced and become in an equilibrium state, and therefore, even when the electric discharge energy to be thrown becomes large, the NOx concentration does not rise. In the case of stopping the gas, an internal space of the gas treatment unit 1 becomes in this equilibrium state, and the amount of NOx as formed is about 3% against the volume of the internal space of the gas treatment unit 1. The volume of the internal space of the gas treatment unit 1 is extremely small as compared with the gas flow rate, and the amount of NOx as formed is small. Even at the time of generating electric discharge, in the case where the gas is made to flow in the same amount as in the case of not generating electric discharge, NOx is formed substantially in proportion to the electric discharge energy to be thrown.

Incidentally, an effect for reducing the amount of NOx as formed by stopping the gas flow during the generation of electric discharge can also be applied in the intermittent system. However, in the case of applying the effect to the intermittent system, it is impossible to pass the gas to be treated into the VOC treatment apparatus during the generation of electric discharge, and therefore, the gas to be treated as formed during this period of time may be stored somewhere, or the gas to be treated should not be formed. On the other hand, according to the present system, there gives rise to such an effect that stopping of the gas flow may be limited to only a part of the gas treatment units 1, and it is not necessary to interrupt the treatment of the gas to be treated as a whole of the VOC treatment apparatus.

When electric discharge is brought into contact with the adsorber that has thoroughly adsorbed VOC, the temperature of the adsorber rises, and the adsorbed VOC is rapidly desorbed. Accordingly, there was a problem that in the case of passing a gas, VOC that has not been fully decomposed by the electric discharge leaks out the VOC treatment apparatus as the treated gas. By stopping the gas at the time of electric discharge, VOC does not come out the gas treatment unit 1. The desorbed VOC remains within the gas treatment unit 1 and reacts with an electron or active species, whereby it is decomposed.

In this Embodiment 1, though the generation of electric discharge in a part of the gas treatment units 1 in sequence and the stopping of the gas flow at the time of electric discharge are carried out simultaneously, only one of them may be carried out.

In desorbing VOC from the adsorber 1C, when the temperature of the adsorber 1C is high, the efficiency of desorption becomes high. However, when the temperature of the gas within the space where electric discharge is generated becomes high so that the temperature of the glass tube 1B is too high, there is some possibility that the withstand voltage of the glass tube 1B is lowered, whereby the glass tube 1B causes dielectric breakdown. When the glass tube 1B causes dielectric breakdown, it does not function as the gas treatment unit 1. Even if the glass tube 1B does not result in dielectric breakdown, when the temperature of the glass tube 1B becomes high, a dielectric loss tan δ of the glass tube 1B increases, thereby increasing the power consumption. For that reason, in this Embodiment 1, the earthed electrode 1A is water cooled to indirectly suppress a temperature rise of the glass tube 1B, whereby the temperature of the glass tube 1B or the adsorber 1C becomes about 100° C. even during the electric discharge. In the related-art gas concentration rotor or the like, there is caused a phenomenon in which an increase of the VOC concentration in the surrounding of the adsorber results in a lowering of the desorption rate of VOC from the adsorber (this phenomenon being called "saturated phenomenon"). Accordingly, VOC is desorbed by heating to about 300° C. such that VOC can be desorbed even in this phenomenon. According to the present system for desorbing VOC by the electric discharge, since the desorbed VOC is decomposed on the spot, even when the temperature of the adsorber is suppressed at about 100° C., VOC can be desorbed without causing a saturated phenomenon. Incidentally, the temperature is not always about 100° C. The temperature may be higher than or lower than about 100° C. so far as the dielectric can be protected and the desorption can be carried out with good efficiency.

Even during the generation of electric discharge, the adsorber 1C is heated to only about 100° C. Accordingly, even after changing to the action state A where electric discharge is not generated, the temperature of the adsorber is immediately lowered so that VOC can be desorbed. Incidentally, the temperature within the gas treatment unit 1 in the action state A becomes around the temperature of cooling water. Even in the case where the gas treatment unit 1 which cannot thoroughly adsorb VOC immediately after returning the action state A from the action state B is present, the majority of the gas treatment units 1 is in the state that VOC can be thoroughly adsorbed so that there gives rise to an effect that a step for stopping the decomposition of VOC for the purpose of regenerating the adsorber may not be provided.

Figure 6:
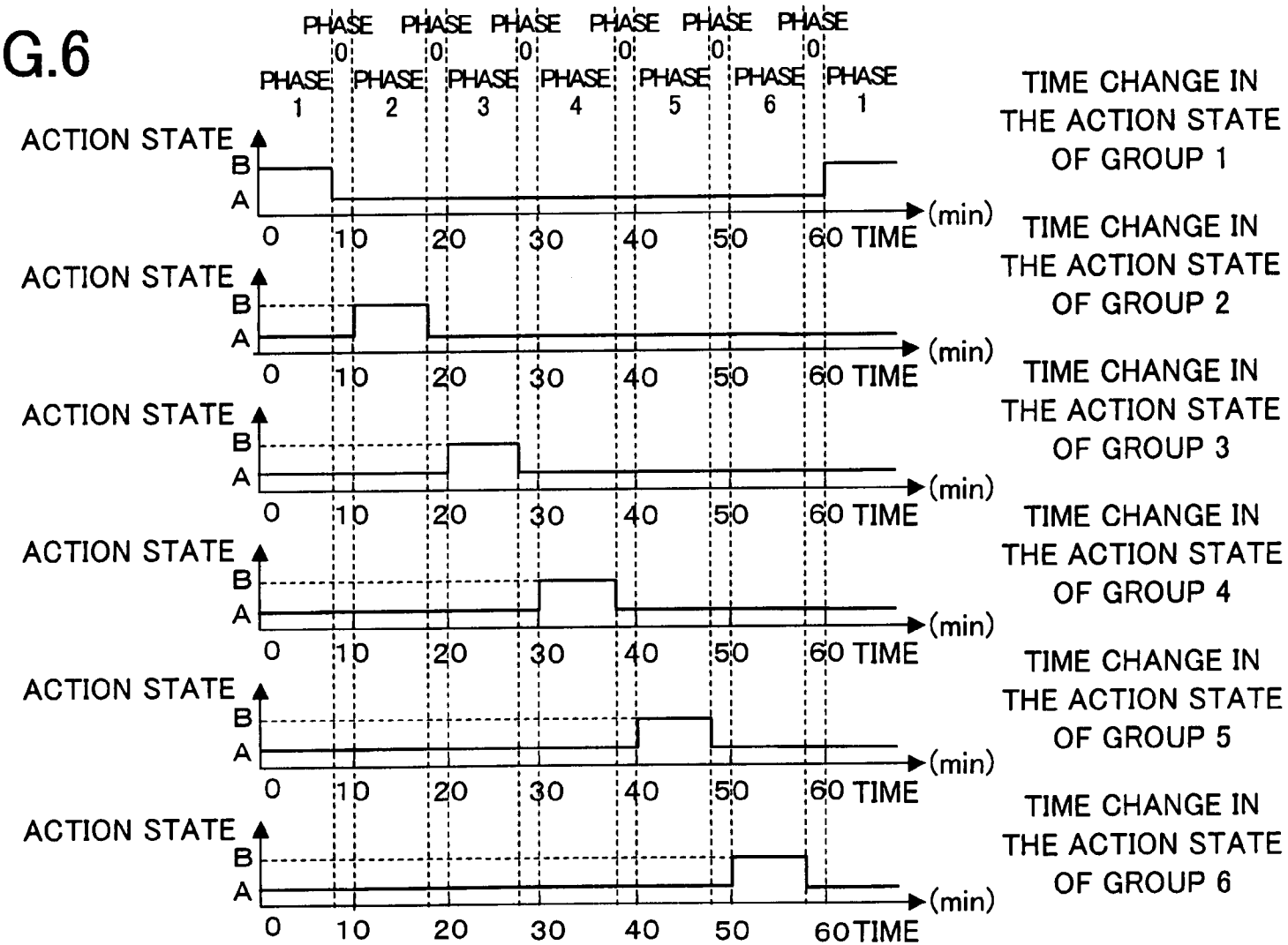
FIG. 6 is a view to explain another control system of a VOC treatment apparatus according to this invention.

This Embodiment 1 employs an embodiment such that any one of groups of the gas treatment unit 1 takes the action state B at any time. However, as shown in FIG. 6, a sequence in which a phase 0 may be employed. In the phase 0, all of the groups take the action state A.

In this Embodiment 1, the number of the gas treatment unit 1 is identical and the time for taking the action state B is also identical in the respective groups. This is to operate steadily the VOC treatment apparatus with good efficiency. The number of the gas treatment unit 1 may be made not identical in the groups, or the time for taking the action state B or the power consumption of electric discharge may be varied. However, in that case, if some measure is not taken at the same time, there is some possibility that the efficiency is lowered. There gives rise to an effect that in any control system for applying a high voltage to the groups of the gas treatment units 1 in which VOC is thoroughly adsorbed onto the adsorber 1C in sequence, thereby generating electric discharge, electric energy necessary for decomposing VOC by increasing the VOC concentration can be reduced and the power supply capacity can be made small.

In this Embodiment 1, the plural gas treatment units 1 are provided, but the gas treatment unit 1 may not be provided. So far as the adsorber can be divided into plural portions, VOC can be thoroughly adsorbed onto the adsorber, and a part of the divided adsorber is treated in sequence by electric discharge as generated between the electrodes, there gives rise to an effect that electric energy necessary for decomposing VOC can be reduced and the power supply capacity can be made small. Incidentally, what the adsorber can be divided into plural portions includes the case where the dividing manner is varied as the case may be.

Any of one-side electrodes of the plural pairs of electrodes is structured by an electrode. For example, the plural pairs of the earthed electrode 1A and the high-voltage electrode 1D may be constructed with the single earthed electrode 1A and the plural high-voltage electrodes 1D. It is needles to say that the single high-voltage electrodes 1D and the plural earthed electrodes 1A may construct the plural pairs of the electrodes.

Here, the measures generally required for the VOC treatment apparatus are classified into a measure for maintaining the performance and a measure for enhancing the efficiency. The measure for maintaining the performance as referred to herein is a measure for actuating as a VOC treatment apparatus without causing a problem. The measure for enhancing the efficiency as referred to herein is a measure for enhancing the efficiency as a VOC treatment apparatus. The measure for maintaining the performance and the measure for enhancing the efficiency are applied as the need arises.

There is some possibility that it is a measure for enhancing the efficiency to tolerate the matter that the number of the gas treatment unit 1 is different in the respective groups. For example, though in FIG. 2A, a cavity is provided in the center of the container 7, the gas treatment unit 1 may be provided in this place. In that case, even in the container 7 having the same external size, one more gas treatment unit 1 can be provided. However, in the case where thirty-seven gas treatment units 1 are similarly divided into six groups, five groups have the number of group of the gas treatment units 1 of 6, and one group has the number of group of the gas treatment units 1 of 7. When the VOC treatment apparatus has the power supply capacity to spare, no measure is required. However, in the case where the power supply capacity is the lowest limit, a measure for maintaining the performance becomes necessary for the purpose of increasing the power supply capacity so as to cope with even the group of the gas treatment units 1 of 7. Further, as the measure for enhancing the efficiency, it is necessary to make the time for taking the action state B identical corresponding to the number of the gas treatment unit 1 which takes the action state B at the same time and vary the power consumption, or to make the power consumption identical and vary the time taking the action state B. Incidentally, when the power supply capacity is the lowest limit, in the case of making the time for taking the action state B identical, it is necessary to regulate the power supply capacity at 7/6 times, while in the case of varying the time for taking the action state B, it is necessary to regulate the power supply capacity at 37/36 times.

Figure 7:
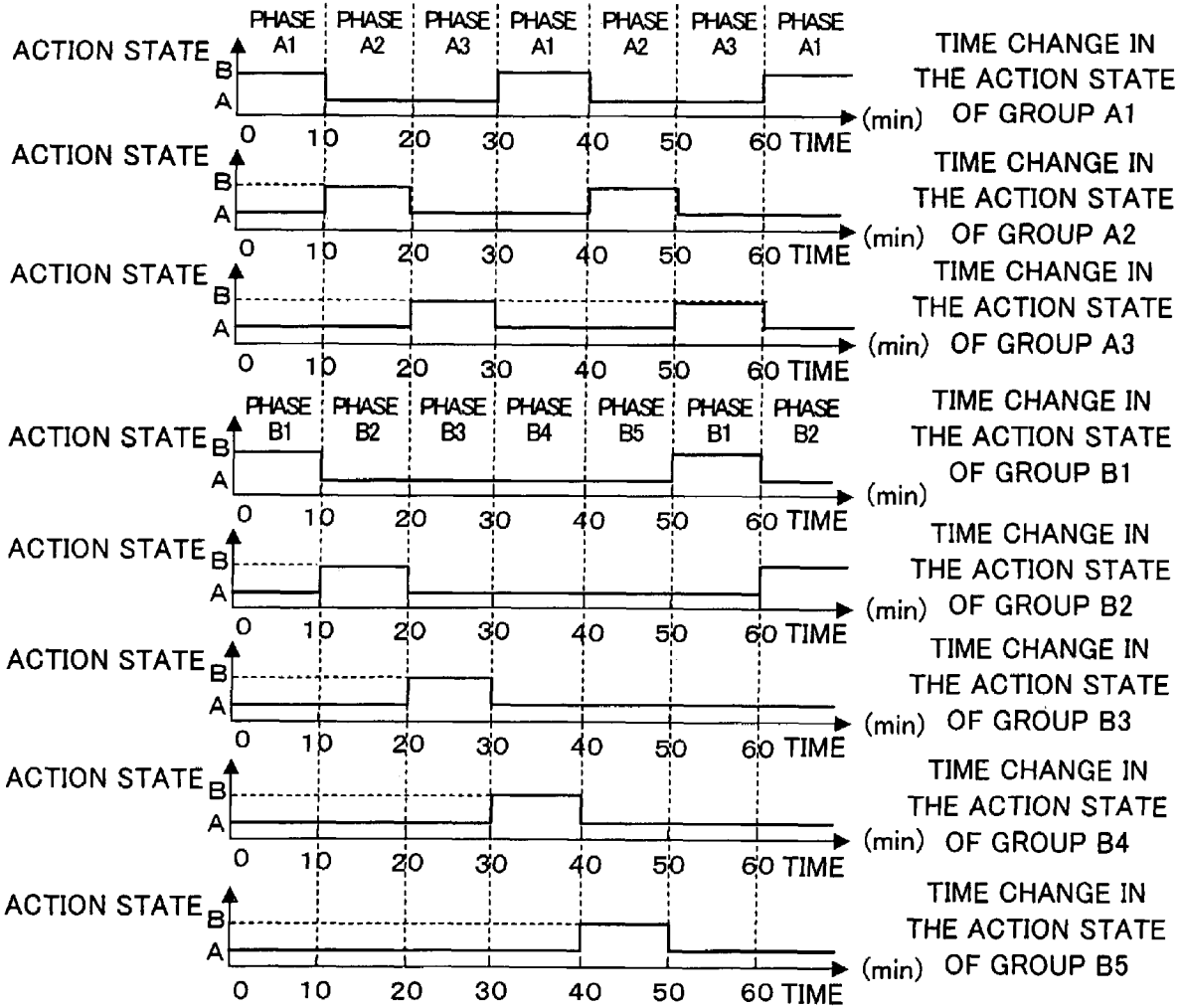
FIG. 7 is a view to explain a still another control system of a VOC treatment apparatus according to this invention.

In the case where the total number of the gas treatment units 1 does not become an integral multiple of the group number, there may be employed a method in which two or more kinds of groups are provided, and one group of them takes the action state B in sequence for every kind. For example, the thirty-seven gas treatment units 1 may be divided into a kind A of three groups each having four gas treatment units 1 and a kind B of five groups each having five gas treatment units 1, thereby taking the action sequence as shown in FIG. 7. In FIG. 7, in from a group A1 to a group A3, any one of the groups takes the action state B in sequence, and in from a group B1 to a group B5, any one of the groups takes the action state B in sequence. In FIG. 7, in the kind A and the kind B, the time for taking the action state B is made identical, and the power consumption is made in proportion to the number of the gas treatment unit 1. Even by such a control, it is possible to treat VOC similarly with good efficiency in the respective gas treatment units 1. The time for taking the action state B, in its turn a period may be varied between the kind A and the kind B such that the time when the adsorber comes into contact with the gas to be treated is made substantially identical between the kind A and the kind B. Further, so far as a difference that cannot be tolerated with respect to the treatment of VOC is not generated between the kind A and the kind B, the power consumption and treatment time of the kind A and the kind B may be determined by any way.

Figure 8:
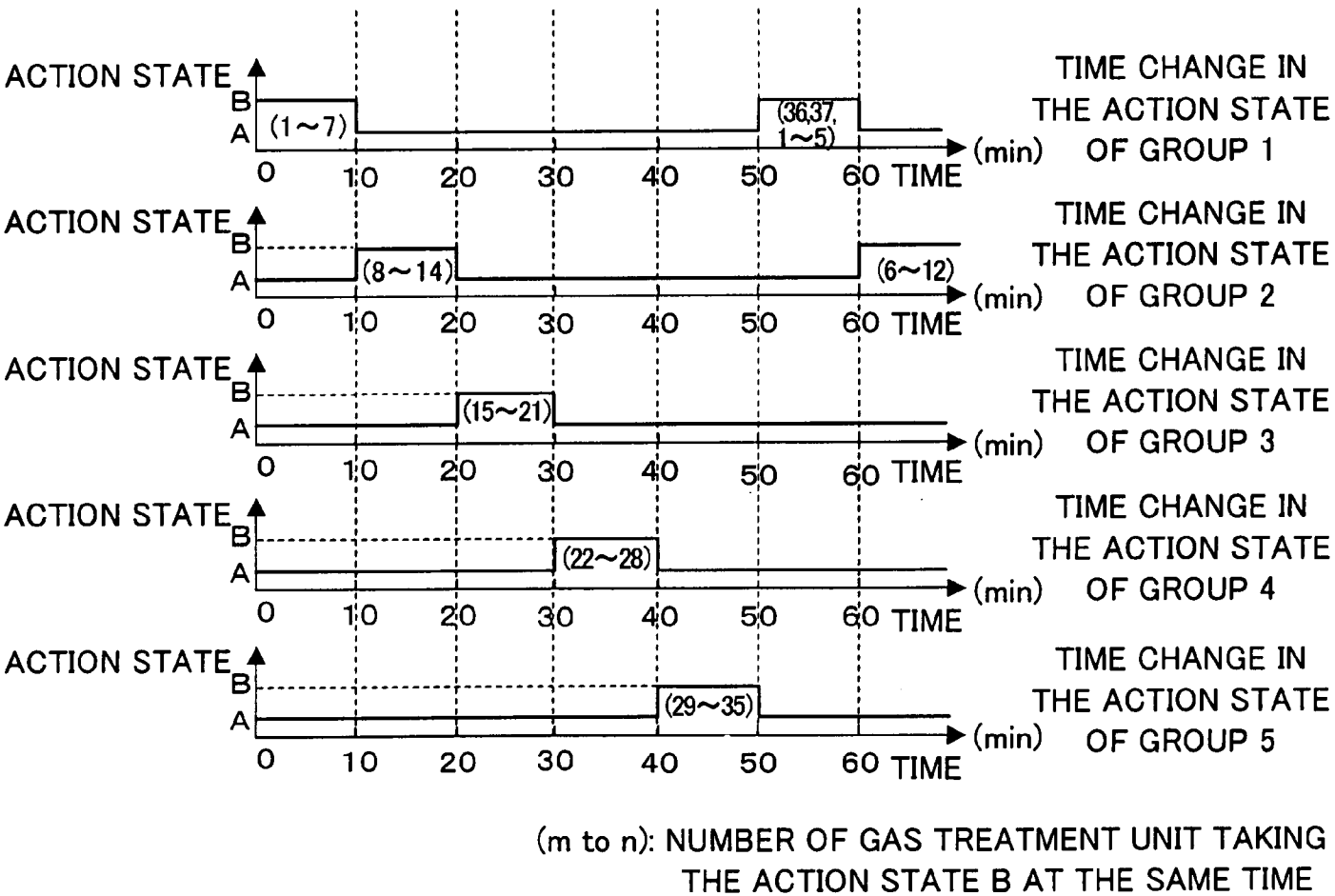
FIG. 8 is a view to explain a control system of the case where the construction of groups of a VOC treatment apparatus according to this invention is variable.

In the case where the total number of the gas treatment units 1 does not become an integral multiple of the group number, a measure as shown in FIG. 8 may be taken as the measure for enhancing the efficiency. In FIG. 8, a reference numeral of the gas treatment unit 1 taking the action state B is expressed while parenthesizing a place taking the action state B. In viewing FIG. 8, though the number of the gas treatment unit 1 taking the action state B is constant, the construction of the group of the gas treatment unit 1 taking the action state B varies every time. At first, the gas treatment units 1 given with reference numerals 1 to 7 take the action state B at the same time, but next, the gas treatment units given with reference numerals 36, 37 and 1 to 5 take the action state B at the same time. In this way, VOC can be treated with good efficiency in the respective gas treatment units 1. Grouping of the gas treatment unit 1 is carried out by the voltage switching control mechanism 3 as the electric discharge control mechanism.

In the case where the gas flow is not stopped in the action state B, such a control can be easily carried out without adding a special conduit. Though the conduit of the gas to be treated becomes complicated and the valve 5A becomes necessary in every gas treatment unit 1, in the case of stopping the gas flow at the time of electric discharge, the same control may be carried out.

In this Embodiment 1, while the VOC treatment apparatus has been described with reference to the constructions as shown in FIG. 2 and FIG. 3, any construction may be employed so far as one pair of electrodes are present while interposing an adsorber to adsorb VOC therebetween and electric discharge as generated between the electrodes comes into contact the adsorber. While the dielectric has been disposed in the surrounding of the high-voltage electrode, the dielectric may be added to the side of the earthed electrode. There may also be employed a construction in which a space is present between the high-voltage electrode and the earthed electrode and a dielectric may be provided between the high-voltage electrode and the earthed electrode. Further, an alternative or direct current high voltage may be applied without providing a dielectric.

In this Embodiment 1, while the valve 5A for stopping the gas flow at the time of electric discharge is provided in the suction side of the gas treatment unit 1, it may be provided in the exhaust side. Since the valve 5A is provided in every group of the gas treatment units 1, such is advantageous in view of reducing the number of part and realizing the low costs. The valve 5A may be provided in every gas treatment unit 1. In that case, though the costs of the apparatus become high, there may be the case where a higher control can be realized, thereby enhancing the treatment efficiency of VOC.

In this Embodiment 1, while the voltage switching element 3A is provided in every gas treatment unit 1, it may be provided in every group of the gas treatment units 1. In that case, the number of the voltage switching element 3A becomes small, and therefore, such is advantageous in view of realizing the low costs.

When at the time of performing electric discharge, while the gas flow has been completely stopped, the gas flow comes into contact with the electric discharge, there may be employed a method in which the flow rate of the gas flowing into the adsorber is smaller than the flow rate when it is not brought into contact with the electric discharge. How the generation of NOx can be reduced by making the gas flow rate small will be considered. Here, a ratio of the gas flow rate at the time of contact with the electric discharge to the gas flow rate at the time of non-contact with the electric discharge is defined as X. X is the actual number of less than 1 and 0 or more. As described previously, when the NOx concentration becomes high, a decomposition reaction of NOx cannot be neglected. In the case where the NOx concentration is small so that the decomposition reaction of NOx is negligible, the amount of NOx as generated is the same regardless of the gas flow rate. Accordingly, when the gas flow rate is X times, the NOx concentration in the gas becomes 1/X times. When the NOx concentration in the gas becomes high, the decomposition reaction of NOx cannot be neglected, and the NOx concentration in the gas becomes smaller than 1/X times. In the case where the NOx concentration in the gas is smaller than 1/X times, there gives rise to an effect that the generation of NOx can be reduced.

A mechanism composed of an opening and closing member may be employed in place of the valve 5A. Any flow rate regulating mechanism is employable so far as it can make the flow rate of the gas flowing into the adsorber that is brought into contact therewith at the time of electric discharge thoroughly small. The flow rate regulating mechanism may be provided in every gas treatment unit 1.

For the purpose of suppressing the generation of NOx, a sufficient effect is obtained by a measure for stopping the feed of the nitrogen-containing gas to be treated or making its feed amount small at the time of electric discharge. However, by feeding an inert gas such as argon and helium or an oxygen gas into the gas treatment unit 1 during the electric discharge, the generation of NOx can be further reduced. Especially, in the case of passing an oxygen gas, larger amounts of an oxygen atom and ozone are generated, whereby the decomposition efficiency of VOC can be further enhanced. The gas in which specific components to be fed into the gas treatment unit 1 during the electric discharge are blended in prescribed concentrations for the purpose of reducing NOx is called "specific blended gas". In the case of one kind gas such as an oxygen gas, the gas is also called "specific blended gas". The specific blended gas may be reused after being recovered.

In this Embodiment 1, while the hydrophobic zeolite is used as the adsorber, by making it hydrophobic, even in the case where the moisture in the gas to be treated is high, there gives rise to an effect that VOC can be adsorbed. In the case where the gas to be treated is subjected to a pre-treatment such as drying in advance, the adsorber may be not hydrophobic. While the hydrophobic zeolite is made spherical, the adsorber may be in any form so far as it can pass the gas to be treated therethrough and disposed between the electrodes. Besides the zeolite, high-silica adsorber such as mesoporous silicate, dealuminated faujasite, high-silica pentasil zeolite, and silica gel and other kinds of adsorber can be used as the adsorber. Any adsorber can be used so far as it can adsorb and desorb VOC.

Other embodiments may be employed.

Embodiment 2

Figure 9A:
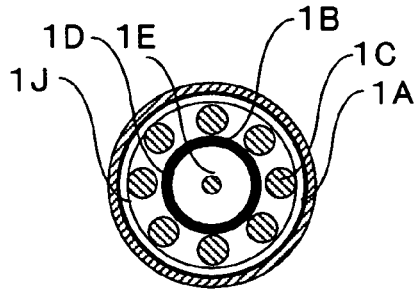
FIG. 9A is a lateral cross sectional view to explain the structure of a gas treatment unit in Embodiment 2 of this invention.
Figure 9B:
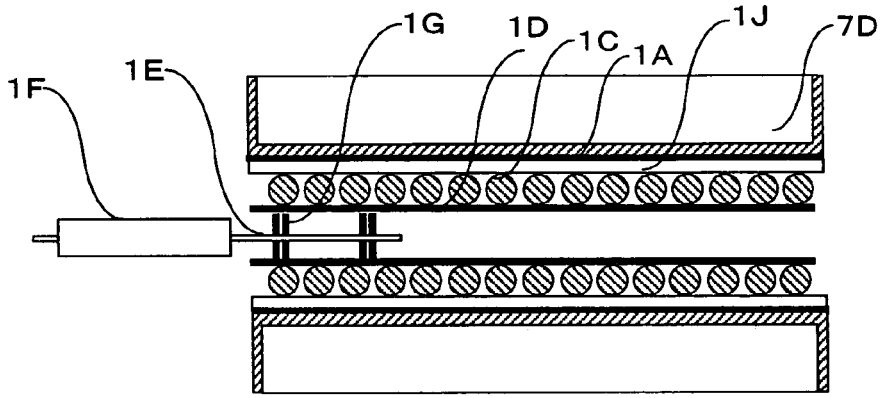
FIG. 9B is a longitudinal cross sectional view to explain the structure of a gas treatment unit in Embodiment 2 of this invention.

In this Embodiment 2, the electrode construction within the gas treatment unit 1 is changed. The structure of the gas treatment unit 1 in this Embodiment 2 is shown in FIG. 9A and FIG. 9B. FIG. 9A is a lateral cross sectional view, and FIG. 9B is a longitudinal cross sectional view, respectively. A dielectric coat 1J is coated on the inner surface of an earthed electrode 1A; a spherical hydrophobic zeolite is disposed in a line; and a metallic cylindrical high-voltage electrode 1D is disposed. Other construction is the same as in Embodiment 1.

In this Embodiment 2, since the dielectric coat 1J is coated on the earthed electrode 1A, the dielectric can also be cooled by water cooling the earthed electrode 1A. For that reason, in the case where the temperature of the dielectric coat 1J is similarly adjusted at about 100° C., the electric discharge current density can be increased as compared with the case of Embodiment 1, whereby the gas treatment unit 1 can be made smaller in size.

In this Embodiment 2, VOC can also be treated with good efficiency at a small power supply capacity, and the generation of NOx can be reduced.

Incidentally, in place of coating the dielectric coat 1J on the inner surface of the earthed electrode 1A, the earthed electrode 1A may be constructed by bringing a metal into intimate contact with the outside of the tube of the dielectric.

Embodiment 3

Figure 10A:
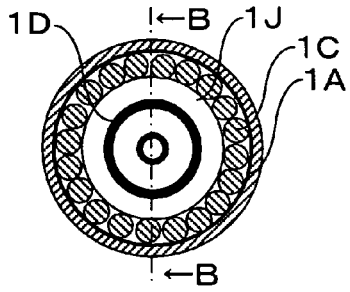
FIG. 10A is a lateral cross sectional view to explain the structure of a gas treatment unit in Embodiment 3 of this invention.
Figure 10B:
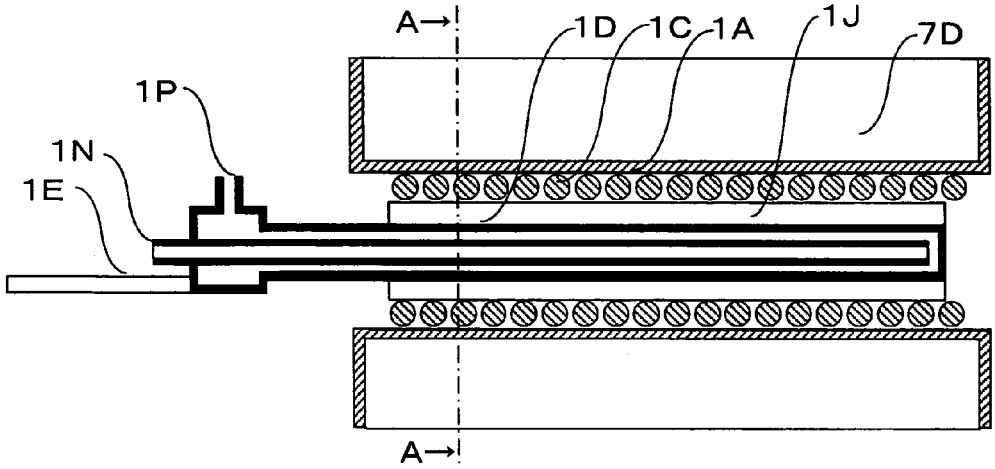
FIG. 10B is a longitudinal cross sectional view to explain the structure of a gas treatment unit in Embodiment 3 of this invention.

In this Embodiment 3, Embodiment 1 is changed such that the electrode construction within the gas treatment unit 1 is changed, thereby cooling the high-voltage electrode. The structure of the gas treatment unit 1 in this Embodiment 3 is shown in FIG. 10A and FIG. 10B. FIG. 10A is a lateral cross sectional view, and FIG. 10B is a longitudinal cross sectional view, respectively. Incidentally, the cross sectional view of the BB cross-section in FIG. 10A is shown in FIG. 10B; and the cross sectional view of the AA cross section in FIG. 10B is shown in FIG. 10A.

A structure in which cooling water can be passed inside a metallic cylindrical high-voltage electrode 1D is employed. The high-voltage electrode 1D is of a double structure cylinder; a cooling water feed port 1N into which cooling water flows is provided in one end of the inner cylinder; and the cooling water which has flown from the cooling water feed port 1N comes out from an end in the opposite side, reruns in a space between the inner cylinder and the outer cylinder, and comes out from a cooling water discharge port 1P. A dielectric coat 1J is coated on the outer surface of the high-voltage electrode 1D. Namely, the high-voltage electrode 1D that is an electrode adjacent to the dielectric is provided with an electrode cooling mechanism.

Since the inner surface (the surface which is brought into contact with cooling water) of the high-voltage electrode 1D is not coated at all, pure water having a resistivity of $10^4$ ($\Omega\times$m) or more is used as the cooling water such that the high-voltage electrode 1D is not connected to the ground via the cooling water.

Likewise Embodiment 2, a spherical hydrophobic zeolite as an adsorber 1C is disposed in a line in the external portion of the dielectric coat 1J, a metallic cylindrical earthed electrode 1A id disposed. The cooling water is not passed through in a cavity 7D in the outside of the earthed electrode 1A.

Other construction is the same as in Embodiment 1.

In this Embodiment 3, VOC can also be treated with good efficiency at a small power supply capacity, and the generation of NOx can be reduced.

In this Embodiment 3, since the dielectric coat 1J is coated on the high-voltage electrode 1D, the dielectric coat 1J can also be cooled by water cooling the high-voltage electrode 1D. For that reason, in the case where the temperature of the dielectric coat 1J is adjusted at about 100° C. in the same manner as in the case of Embodiment 1, the temperature of an electric discharge space between the earthed electrode 1A and the high-voltage electrode 1D can be made higher than that in the case of Embodiment 1 in which the earthed electrode 1A is cooled. Namely, even when the electric discharge current density is made high so that the temperature of the electric discharge space becomes high, the temperature of the dielectric 1J can be maintained at about 100° C. Since the electric discharge current density can be made high, in the case of the same output, the gas treatment unit 1 can be made smaller in size. Incidentally, in the case where a dielectric is present adjacent to the earthed electrode 1A by, for example, coating the electric film 1J on the earthed electrode 1A, the electric discharge current density can be made high by cooling the earthed electrode 1A. By cooling both the high-voltage electrode 1D and the earthed electrode 1A, the electric discharge current density can be made higher.

Incidentally, by coating an insulation film over the entire surface of the high-voltage electrode 1D, which is brought into contact with cooling water, it becomes unnecessary to use pure water, and cooling can be carried out by using usual city water or industrial water.

The above can also be applied to other embodiments of cooling an electrode.

Embodiment 4

Figure 11A:
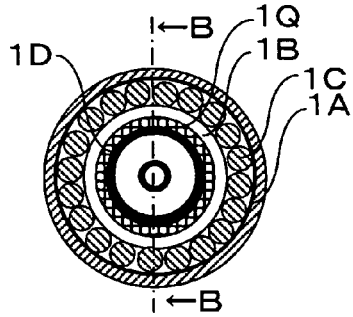
FIG. 11A is a lateral cross sectional view to explain the structure of a gas treatment unit in Embodiment 4 of this invention.
Figure 11B:
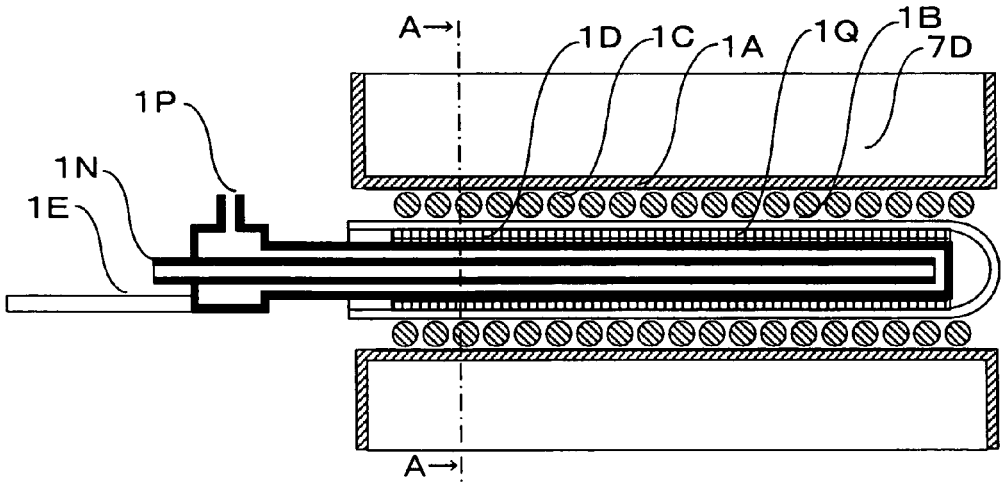
FIG. 11B is a longitudinal cross sectional view to explain the structure of a gas treatment unit in Embodiment 4 of this invention.

In this Embodiment 4, Embodiment 3 is changed such that a glass tube is used in place of the electric film in Embodiment 3. The structure of the gas treatment unit 1 in Embodiment 4 is shown in FIG. 11A and FIG. 11B. FIG. 11A is a lateral cross sectional view, and FIG. 11B is a longitudinal cross sectional view, respectively. Incidentally, the cross sectional view of the BB cross-section in FIG. 11A is shown in FIG. 11B; and the cross sectional view of the AA cross section in FIG. 11B is shown in FIG. 11A.

The structure of a high-voltage electrode 1D is substantially the same as in the case of Embodiment 3. However, a dielectric coat is not coated on the outer surface of the high-voltage electrode 1D. A glass tube 1B is disposed in the outside of the high-voltage electrode 1D, and a feed layer 1Q for electrically and thermally coupling the glass tube 1B and the high-voltage electrode 1D is provided between the dielectric and the glass tube 1B and the high-voltage electrode 1D. Incidentally, when the electrical coupling between the glass tube 1B and the high-voltage electrode 1D is insufficient, an abnormal electric discharge is generated between the high-voltage electrode 1D and the glass tube 1B. When the thermal coupling is insufficient, the glass tube 1B cannot be thoroughly cooled. The feed layer 1Q is provided for the purpose of preventing such matters from occurring.

Other construction is the same as in Embodiment 3.

Figure 12A:
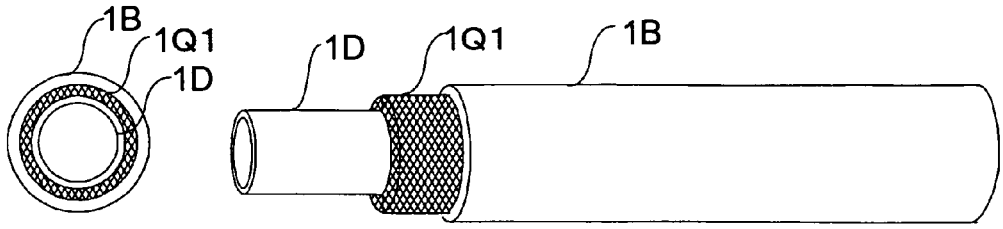
FIG. 12A is a view to explain an example of the structure of a feed layer using a steel wool in Embodiment 4 of this invention.
Figure 12B:
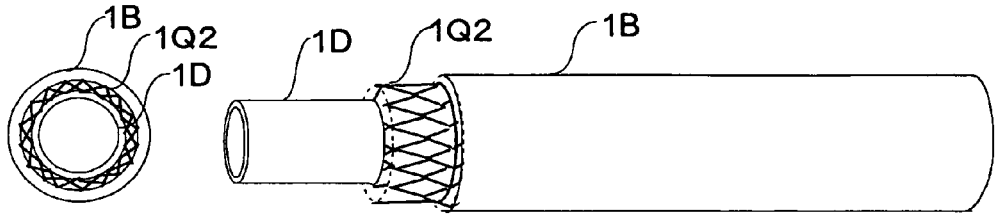
FIG. 12B is a view to explain an example of the structure of a feed layer using a metal mesh in Embodiment 4 of this invention.
Figure 12C:
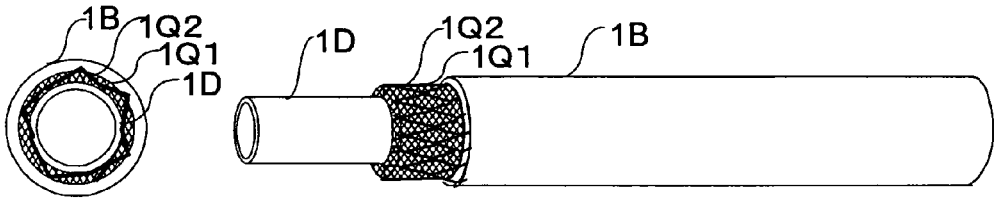
FIG. 12C is a view to explain an example of the structure of a feed layer using a metal mesh and a steel wool in Embodiment 4 of this invention.
Figure 12D:
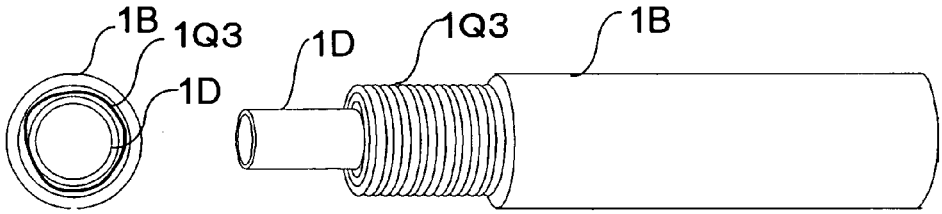
FIG. 12D is a view to explain an example of the structure of a feed layer using a shape memory alloy in Embodiment 4 of this invention.

Some examples of the structure of the feed layer 1Q are shown in FIG. 12A to FIG. 12D. FIG. 12A shows the case of using a steel wool 1Q1; FIG. 12B shows the case of using a metal mesh 1Q2 having spring properties; FIG. 12C shows the case of winding a metal mesh 1Q2 having spring properties around a steel wool 1Q1; and FIG. 12D shows the case of using a shape memory alloy 1Q3, respectively. In all of these cases, the feed layer 1Q is fitted on the outer surface of the high-voltage electrode 1D, and the high-voltage electrode 1D having the feed layer 1Q fitted thereon is then inserted into the glass tube 1B.

In view of enhancing the electrical and thermal coupling, it is desired that the feed layer 1Q is thin. For inserting the high-voltage electrode 1D having the feed layer 1Q fitted thereon into the glass tube 1B, it is necessary that the feed layer 1Q has not only prescribed flexibility but also prescribed thickness. The thickness of the feed layer 1Q may vary depending upon the quality of the feed layer 1Q but is desirably about 0.5 mm or more.

In the case of using the steel wool 1Q1, it is determined so as to have a linear diameter at which necessary flexibility is obtained and a volume rate at which necessary heat conductivity is obtained. In the case of using the metal mesh 1Q2, its linear diameter is determined from necessary flexibility. Also, the density of the mesh is determined from the viewpoint of heat conduction. In the case of using the shape memory alloy 1Q3, various characteristics are determined from the same viewpoints.

As the feed layer 1Q, any material can be used so far as it has prescribed conductivity and heat conduction characteristics. Conductive greases, conductive adhesives, conductive putties, conductive clays, conductive polymers, metal plates, and so on can be used as a replacement. Instead of the steel wool, the feed layer 1Q may be prepared by weaving copper or aluminum having higher heat conductivity. Further, for the purpose of increasing the conductivity, a conductive layer may be provided on the inner surface of the glass tube 1B by using plating nickel, aluminum, chromium, gold or the like.

In this Embodiment 4, VOC can also be treated with good efficiency at a small power supply capacity, and the generation of NOx can be reduced.

By using the glass tube 1B as the dielectric, it is possible to save a trouble for coating a dielectric coat 1J on the high-voltage electrode 1A, and the costs can be reduced.

By providing the fee layer 1Q, in the case where the temperature of the glass tube 1B is adjusted at about 100° C. in the same manner as in Embodiment 1, an electric discharge current density can be increased as compared with the case of Embodiment 1, whereby the gas treatment unit 1 can be made smaller in size.

Incidentally, a tube made of a ceramic may be used as a dielectric in place of the glass tube. In the case where a solid dielectric such as a glass tube is used and a gap is possibly generated between the dielectric and the electrode, by providing a feed layer for electrically and thermally coupling the dielectric and the electrode such that no gap is generated, it is possible to generate a stable electric discharge and maintain the cooling efficiency.

The electrode construction in this embodiment is the case where a high-voltage electrode is disposed inside, an earthed electrode is disposed outside, and a solid dielectric is disposed just outside the high-voltage electrode. However, even in the case where the dielectric is disposed inscribing the earthed electrode, or the case where the dielectric is disposed inside the high-voltage electrode or outside the earthed electrode in the construction in which the high-voltage electrode and the earthed electrode are exchanged, the same effect is obtained in the construction in which the feed layer is provided between the dielectric and the electrode. Further, in the case of square pillar or planar electrodes, the same effect is obtained by the construction in which the feed layer is provided between the dielectric and the electrode.

Figure 13:
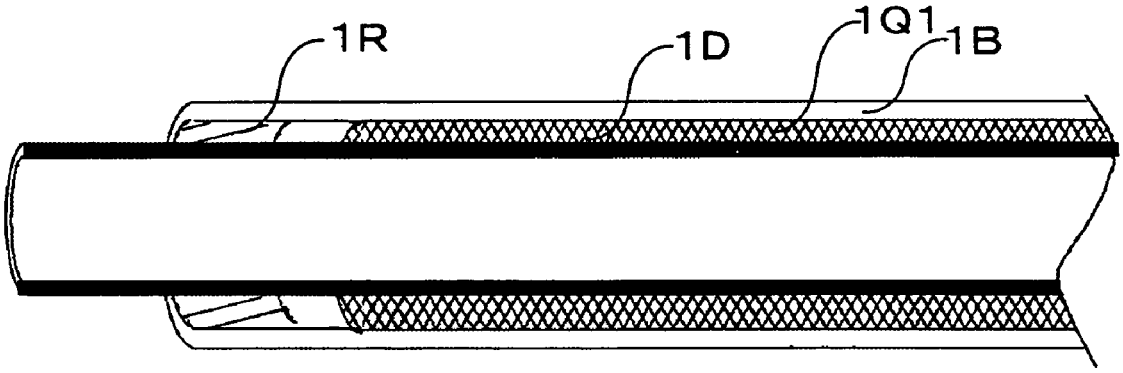
FIG. 13 is a view to show a longitudinal cross sectional view of a high-voltage electrode having an insulation layer provided in an inlet port in Embodiment 4 of this invention.

FIG. 13 is a view to show a longitudinal cross sectional view of the high-voltage electrode 1D. By providing an insulation layer 1R made of silicon carbide (SiC) or a silicon (Si) based rubber in an inlet portion of the glass lateral cross section, it is possible to prevent dielectric breakdown by surface discharge from occurring and enhance reliability.

The above can also be applied to other embodiments having a feed layer.

Embodiment 5

Figure 14A:
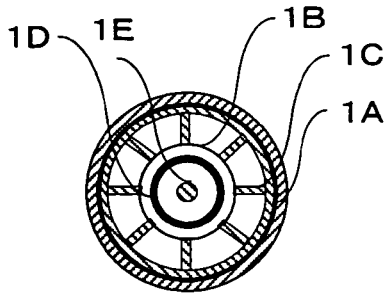
FIG. 14A is a lateral cross sectional view to explain the structure of a gas treatment unit in Embodiment 5 of this invention.
Figure 14B:
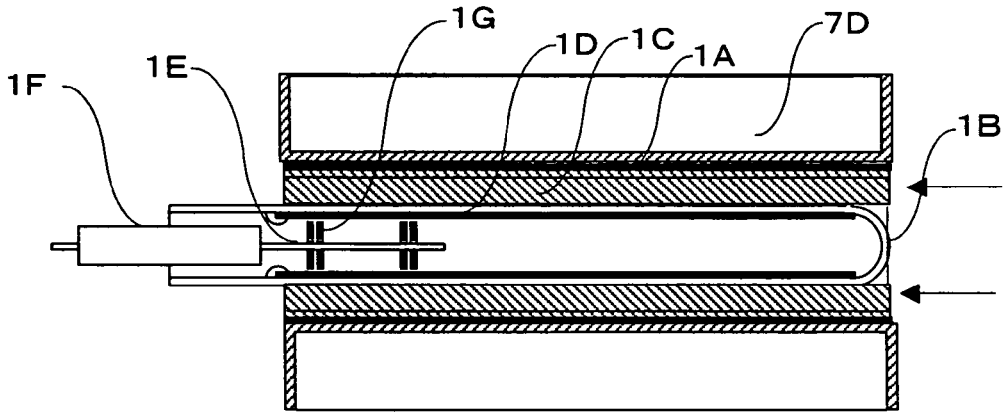
FIG. 14B is a longitudinal cross sectional view to explain the structure of a gas treatment unit in Embodiment 5 of this invention.

In this Embodiment 5, the construction of the adsorber present within the gas treatment unit 1 is changed. The structure of the gas treatment unit 1 in this Embodiment 5 is shown in FIG. 14A and FIG. 14B. FIG. 14A is a lateral cross sectional view, and FIG. 14B is a longitudinal cross sectional view, respectively. An adsorber 1C is of a structure in which a protruded planar plate having elasticity is rounded in the cylindrical form. In the adsorber 1C, a component for adsorbing VOC is added on the surfaces of the planar plate and protrusions. It is noted from FIG. 14A that the protrusions of the adsorber 1C also serve as a member for supporting a glass tube 1B. Other construction is the same as in Embodiment 1.

In this Embodiment 5, VOC can also be treated with good efficiency at a small power supply capacity, and the generation of NOx can be reduced.

Embodiment 6

Figure 15A:
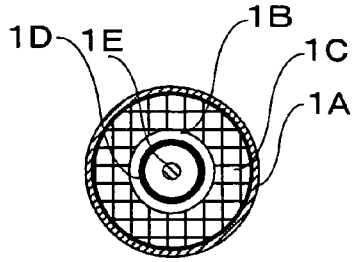
FIG. 15A is a lateral cross sectional view to explain the structure of a gas treatment unit in Embodiment 6 of this invention.
Figure 15B:
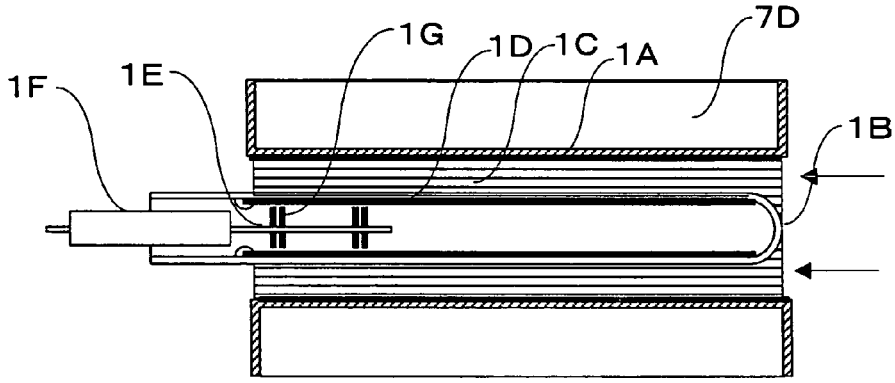
FIG. 15B is a longitudinal cross sectional view to explain the structure of a gas treatment unit in Embodiment 6 of this invention.

In this Embodiment 6, the construction of the adsorber present within the gas treatment unit 1 is changed similarly to Embodiment 5. The structure of the gas treatment unit 1 in this Embodiment 6 is shown in FIG. 15A and FIG. 15B. FIG. 15A is a lateral cross sectional view, and FIG. 15B is a longitudinal cross sectional view, respectively. As shown in FIG. 15, the adsorber 1C is of a columnar (doughnut-like) form in which the central portion is defective. The adsorber 1C constructing a gas passage in the honeycomb form in the longitudinal direction of the column is disposed between an earthed electrode 1A and a glass tube 1B. The gas passage is parallel to the flow direction of a gas as shown by arrows in FIG. 15B. Here, a structure in which many tubes having a small cross sectional area are accumulated is called "honeycomb form". This adsorber 1C in the honeycomb form also serves as a member for supporting the glass tube 1B. An electrode is disposed vertically to the gas passage. Electric discharge is also generated substantially vertically to the gas passage. Other construction is the same as in Embodiment 1.

The adsorber 1C having such a form is formed by forming a hydrophobic zeolite in the cylindrical form and then boring the central portion, or winding and superimposing a hydrophobic zeolite in the sheet form having a thin gas passage. In many cases, what the sheet is wound can make the costs cheap.

In this Embodiment 6, VOC can also be treated with good efficiency at a small power supply capacity, and the generation of NOx can be reduced.

When the adsorber 1C is made of a dielectric, electric discharge is generated vertically to the wall surface of the gas passage. Accordingly, the adsorber C gives rise to an effect for stabilizing the electric discharge similarly to the glass tube 1B as a dielectric. Incidentally, since dielectric strength of the adsorber 1C is not so high, when a dielectric such as the glass tube 1B is present between the electrodes, the reliability is enhanced.

By disposing the electrodes in the crossing direction against the adsorber 1C but not in the vertical direction to the adsorber 1C and generating electric discharge between the electrodes, there gives rise to an effect that the adsorber 1C contributes to stabilization of the electric discharge. The adsorber 1C may be in other form than the doughnut-like form, such as a rectangular form. Similarly, the electrode may be in other form than the cylindrical form, such as a plate-like form. The structure may be in any form so far as the electrodes are disposed such that a high voltage can be applied in the crossing direction against the wall surface of the gas passage of the adsorber 1C.

The above can also be applied to other embodiments.

Embodiment 7

In this Embodiment 7, the construction of the adsorber 1C present within the gas treatment unit 1 is changed with respect to Embodiment 1. The structure of the gas treatment unit 1 is shown in FIG. 16A and FIG. 16B.

Figure 16A:
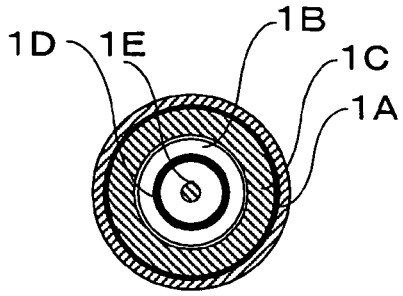
FIG. 16A is a lateral cross sectional view to explain the structure of a gas treatment unit in Embodiment 7 of this invention.
Figure 16B:
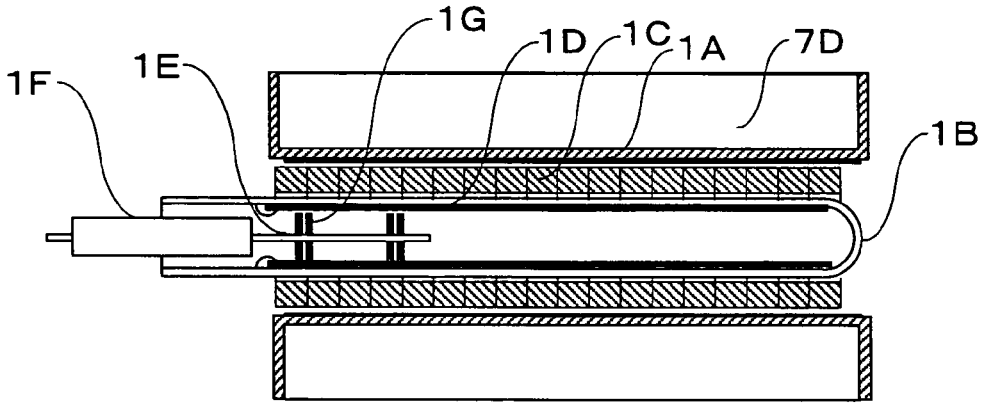
FIG. 16B is a longitudinal cross sectional view to explain the structure of a gas treatment unit in Embodiment 7 of this invention.

FIG. 16A is a lateral cross sectional view, and FIG. 16B is a longitudinal cross sectional view, respectively. As shown in FIG. 16, the adsorber 1C is of a columnar (doughnut-like) form having a height of from about 5 to 100 mm in which the central portion is defective and which is prepared by sintering a hydrophobic zeolite such that many fine pores are formed. The adsorber 1C constructing a gas passage in the longitudinal direction of the column is superimposed and disposed between an earthed electrode 1A and a glass tube 1B. The inner diameter and outer diameter of the doughnut are regulated at a size such that the adsorber 1C can be inserted between the glass tube 1B and the earthed electrode 1A closely as far as possible. With respect to the height of the adsorber 1C, when it is low, the manufacturing is easy and the yield becomes high. However, it is preferable that the height is high in view of easiness of handling.

A pore diameter and a porosity of the adsorber 1C are determined such that a pressure loss is not more than a prescribed value and that a necessary adsorbing ability of VOC is obtained. For example, in order that the adsorber 1C may have a thickness of 5 mm and a pressure loss at an airflow rate of 1 m/sec of not more than 50 Pa (=about 0.0005 atm.), the pore diameter is from about 0.01 to 1 mm, and the porosity is from about 5 to 80%, and desirably from about 10 to 40%. Incidentally, in view of reducing the pressure, it is desired that the pore diameter is large and that the porosity is high. However, in view of adsorbing VOC, it is desired that the pore diameter is small and that the porosity is low. When the pore diameter is large, the number of the pore becomes small, and the total surface area of the pores is lowered. In view of adsorbing VOC, it is advantageous that the total surface area of the pores is large. When the porosity is high, the amount of the adsorber 1C per unit volume is lowered so that the amount of VOC that can be adsorbed per unit volume becomes small.

Other construction is the same as in Embodiment 1.

The adsorber 1C is prepared by mixing a substance such as polyurethane with a powder of a hydrophobic zeolite, forming the mixture and then sintering it in a furnace. During sintering in the furnace, the polyurethane or the like is burnt, and pores are then formed. By adjusting size and mixing ratio of a substance to be mixed, such as polyurethane, it is possible to prepare the adsorber 1C having a prescribed diameter and a prescribed porosity easily and cheaply.

The adsorber 1C having such a shape is preferably made of a hydrophobic zeolite. However, the same effect is also obtainable by using a sintered material made of one or a blend of a plural number of high-silica adsorber such as mesoporous silicate, dealuminated faujasite, high-silica pentasil zeolite, and silica gel. At the time of sintering the adsorber, a metal having a catalytic action of oxidative destruction, such as platinum, gold, titanium dioxide, and manganese dioxide may be blended.

In this Embodiment 7, VOC can also be treated with good efficiency at a small power supply capacity, and the generation of NOx can be reduced.

Since the adsorber 1C is made of a dielectric, when electric discharge is generated in the crossing direction against the adsorber 1C, the adsorber 1C gives rise to an effect for stabilizing the electric discharge similarly to the glass tube 1B as a dielectric.

Since the adsorber 1C is manufactured by sintering, there gives rise to an effect that the apparatus can be manufactured cheaply.

The above can be applied to other embodiments.

Embodiment 8

Figure 17A:
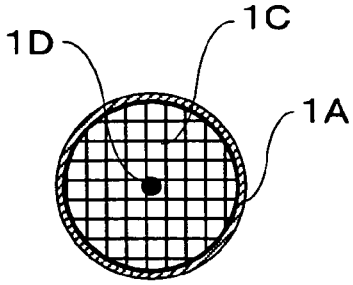
FIG. 17A is a lateral cross sectional view to explain the structure of a gas treatment unit in Embodiment 8 of this invention.
Figure 17B:
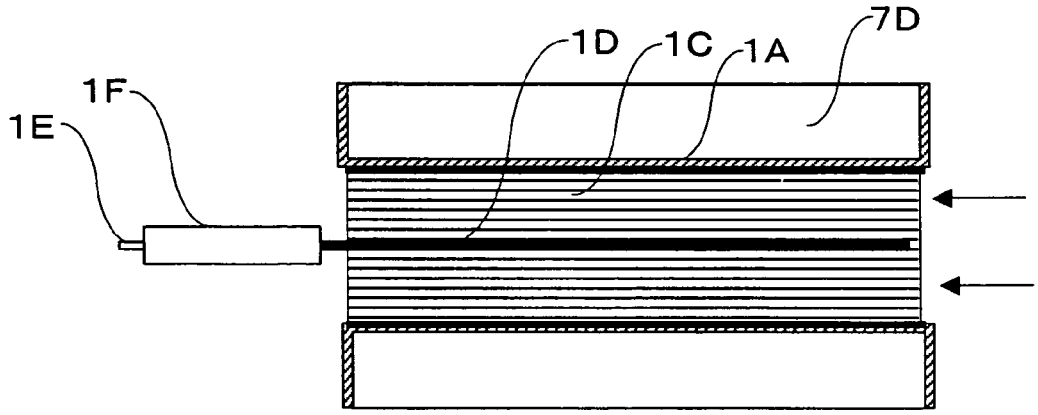
FIG. 17B is a longitudinal cross sectional view to explain the structure of a gas treatment unit in Embodiment 8 of this invention.

In the Embodiment 8, Embodiment 6 is changed such that the glass tube 1B as a dielectric is not provided. The structure of the gas treatment unit 1 in this Embodiment 8 is shown in FIG. 17A and FIG. 17B. FIG. 17A is a lateral cross sectional view, and FIG. 17B is a longitudinal cross sectional view, respectively. As shown in FIG. 17, the adsorber 1C is of a columnar (doughnut-like) form in which the central portion is defective. The adsorber 1C constructing a gas passage in the honeycomb form in the longitudinal direction of the column is disposed between an earthed electrode 1A and a high-voltage electrode 1D. This adsorber 1C in the honeycomb form also serves as a member for supporting the high-voltage electrode 1D. An electrode is disposed vertically to the gas passage. An electrode is disposed vertically to the gas passage, and electric discharge is also generated substantially vertically to the gas passage. Other construction is the same as in Embodiment 1.

The adsorber 1C having such a shape is formed in the same manner as in Embodiment 6.

In this Embodiment 8, VOC can also be treated with good efficiency at a small power supply capacity, and the generation of NOx can be reduced. A dielectric part such as the glass tube 1B is not provided, the structure is simple as compared with that in Embodiment 6, and the apparatus can be prepared more cheaply. Since the adsorber 1C is made of a dielectric, there gives rise to an effect that a stable electric discharge can be generated, too in this Embodiment 8. Incidentally, since dielectric strength of the adsorber 1C is not so high, reliability of the apparatus is low as compared with the case where a dielectric other than the adsorber 1C is disposed between the electrodes. This Embodiment 8 is applied in the case where reliability of the apparatus may be not so high as in the case of a low current density.

Embodiment 9

In this Embodiment 9, the gas treatment unit 1 is of a longitudinal structure. The structure of the gas treatment unit 1 in this Embodiment 9 is shown in FIG. 18A and FIG. 18B.

Figure 18A:
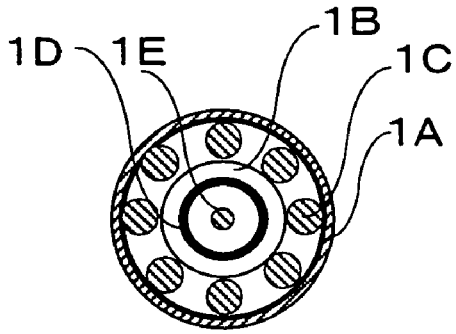
FIG. 18A is a lateral cross sectional view in the horizontal plane to explain the structure of a gas treatment unit in Embodiment 9 of this invention.
Figure 18B:
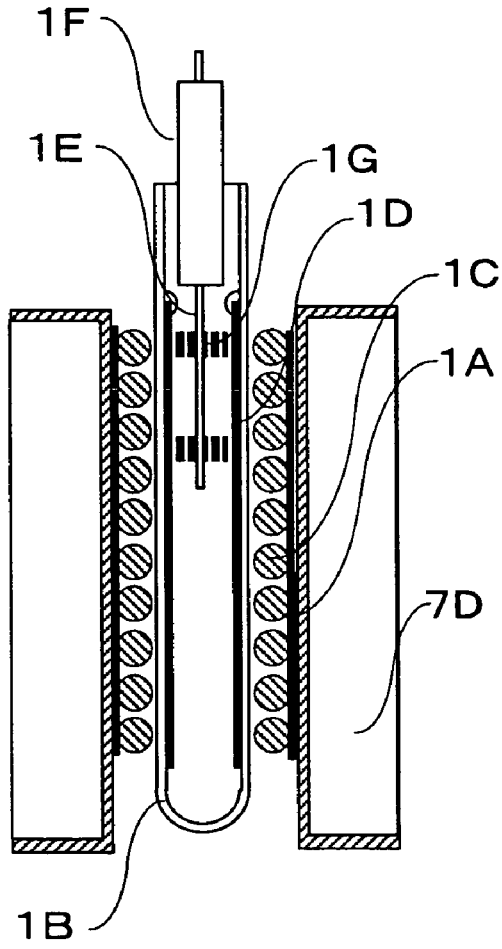
FIG. 18B is a longitudinal cross sectional view in the vertical plane to explain the structure of a gas treatment unit in Embodiment 9 of this invention.

FIG. 18A is a lateral cross sectional view in the horizontal plane, and FIG. 18B is a longitudinal cross sectional view in the vertical plane, respectively. In FIG. 18, FIG. 3 in Embodiment 1 is rotated at an angle of 90 degrees such that a fuse 1F is positioned in the upper portion. As not shown in the drawing, the whole of the VOC treatment apparatus is similarly rotated at an angle of 90 degrees. Other construction is the same as in Embodiment 1.

In this Embodiment 9, VOC can also be treated with good efficiency at a small power supply capacity, and the generation of NOx can be reduced. In the case of using a granular adsorber, there is a characteristic feature that according to the longitudinal structure, the adsorber can be easily sealed.

While this Embodiment 9 is based on Embodiment 1, what the gas treatment unit 1 is of a longitudinal structure can be applied to other embodiments.

Embodiment 10

Figure 19A:
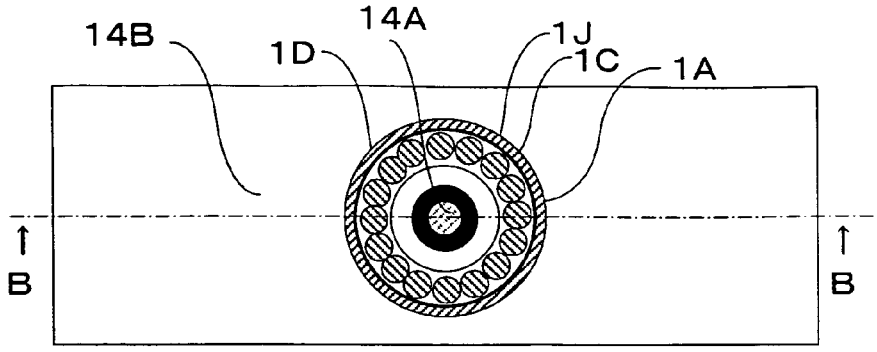
FIG. 19A is a lateral cross sectional view in the horizontal plane to explain the structure of a gas treatment unit in Embodiment 10 of this invention.
Figure 19B:
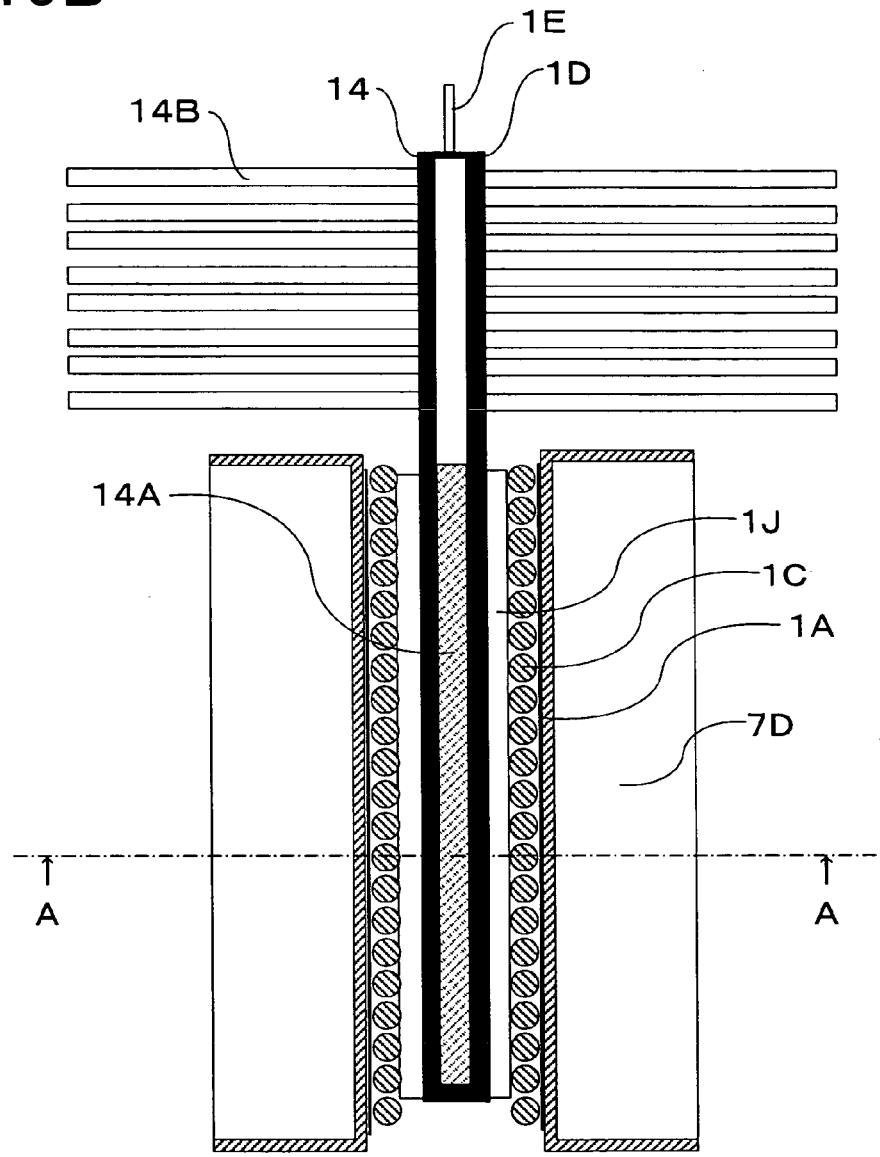
FIG. 19B is a longitudinal cross sectional view in the vertical plane to explain the structure of a gas treatment unit in Embodiment 10 of this invention.

In this Embodiment 10, Embodiment 3 is changed such that the gas treatment unit is of a longitudinal structure and that the high-voltage electrode 1D is cooled by a heat pipe. The longitudinal structure means that the high-voltage electrode 1D and the like are disposed in the vertical direction to the ground. The structure of this gas treatment unit 1 is shown in FIG. 19A and FIG. 19B. FIG. 19A is a lateral cross sectional view in the horizontal plane, and FIG. 19B is a longitudinal cross sectional view in the vertical plane, respectively. Incidentally, FIG. 19A is corresponding to the AA cross section of FIG. 19B, and FIG. 19B is corresponding to the BB cross section of FIG. 19A, respectively.

Here, a heat pipe 14 that is an electrode cooling mechanism to be used in the high-voltage electrode 1D will be described. In the heat pipe 14, a lower end of a copper-made pipe that is the high-voltage electrode 1D is closed, whereby a coolant 14A is sealed inside the tube, and a radiating panel 14B for radiation is provided in the upper portion thereof. Water is mainly used as the coolant 14A. The reason why water is used resides in the matter that water has a global warming potential of zero and is cheap.

The radiating panel 14B is a panel prepared by superimposing thin aluminum plates at prescribed intervals. The radiating panel 14B is connected in the upper end of the high-voltage electrode 1D to a high-voltage conductor 1E, and a high voltage is applied to the whole of the radiating panel 14B. The thickness and interval of the radiating panel 14B are determined such that a surface area from which a necessary cooling ability is obtained is obtained in a usable space.

In the heat pipe 14, the heat generated by the electric discharge is removed from the high-voltage electrode 1D and a dielectric coat 1J by evaporation latent heat of the coolant 14A. The evaporated coolant vapor is cooled and condensed upon heat removal in the radiating panel 14B, whereby it becomes again a coolant.

In this Embodiment 10, VOC can also be treated with good efficiency at a small power supply capacity, and the generation of NOx can be reduced.

An effect that by efficiently cooling the high-voltage electrode 1D and the dielectric coat 1J, an increase of the electric discharge current density, in its turn miniaturization of the gas treatment unit 1 is realized is the same as in Embodiment 3. Further, by using the heat pipe 14, since the management of pure water is not required, the maintenance becomes easy. Since it is not required to circulate the cooling water, a pump for circulating the cooling water is not necessary, leading to a reduction of the operation costs.

Figure 20:
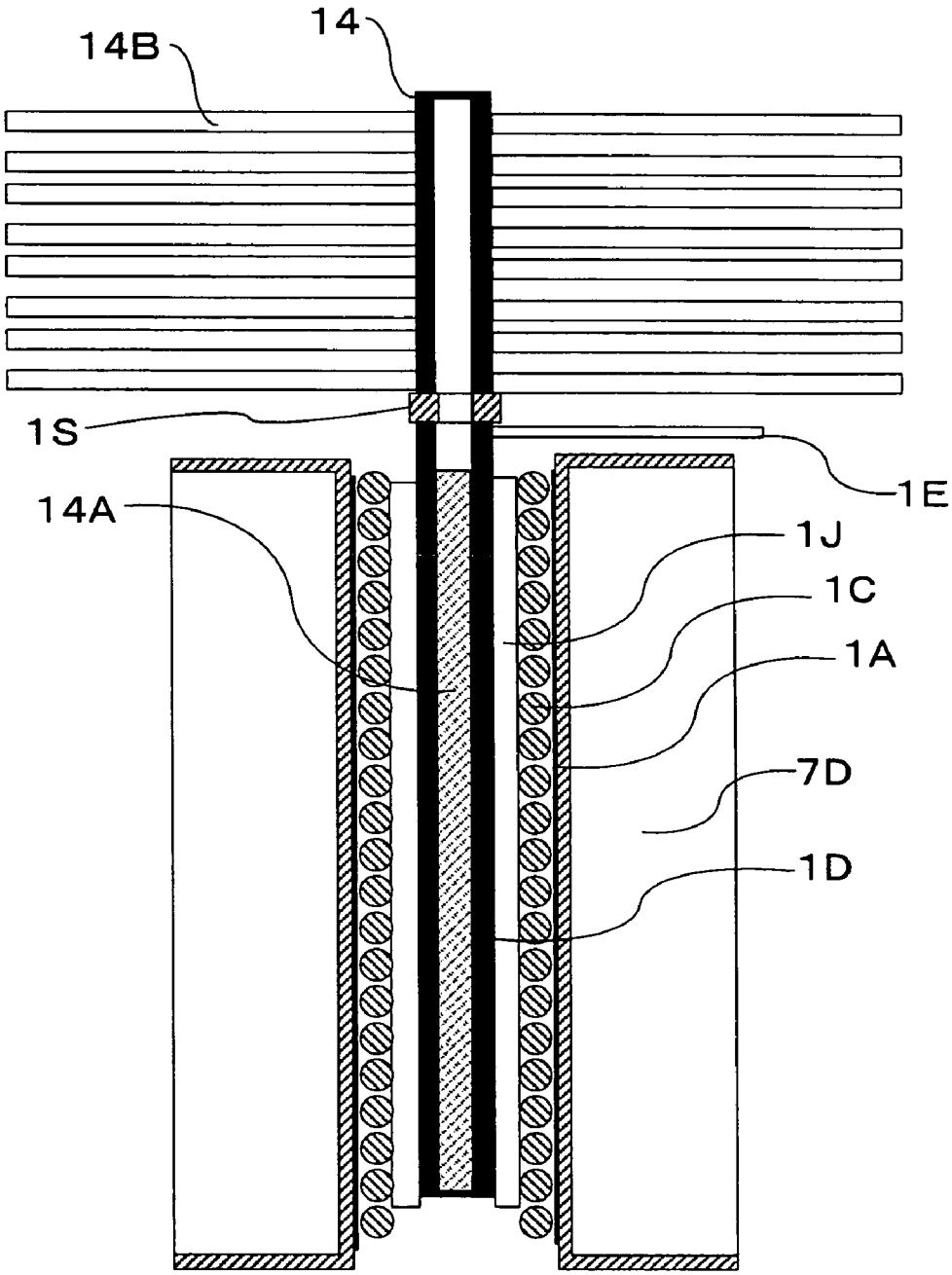
FIG. 20 is a view to explain the structure of a high-voltage electrode having an insulating material between radiating panels in Embodiment 10 of this invention.

In the case where the heat pipe 14 is used as the high-voltage electrode 1D, a high voltage is also applied to the radiating panel 14B, and an abnormal electric discharge is possibly generated from the radiating panel 14B. In order to avoid such a phenomenon, in the case where the cooling efficiency may be lowered a little, an insulation material is used for the radiating panel 14B, or an insulation layer is coated. Alternatively, as shown in FIG. 20, by connecting the high-voltage electrode 1D to the upper portion of the heat pipe 14 using an insulation material 1S such as glasses, ceramics, and epoxy resins, it becomes possible to design a stable gas treatment unit. In the case where the high-voltage electrode 1D is exposed to a corrosive gas, stainless steel is covered on the copper pipe, thereby preventing corrosion of the copper pipe from occurring. Incidentally, so far as the high-voltage electrode 1D has high conductivity and heat conductivity, it may not be made of copper.

Besides water, materials having good cooling efficiency and small global warming potential can be used as the coolant to be sealed within the heat pipe.

Even in the case where a solid dielectric such as a glass tube as shown in Embodiment 4 is used in place of the dielectric coat 1J, the same effect can be obtained.

While cooling is carried out by applying a heat pipe to the high-voltage electrode, the cooling may be carried out by applying a heat pipe to the earthed electrode. The cooling of both the high-voltage electrode and the earthed electrode may also be carried out by using a heat pipe.

The above can be applied to other embodiments using a heat pipe.

Embodiment 11

Figure 21A:
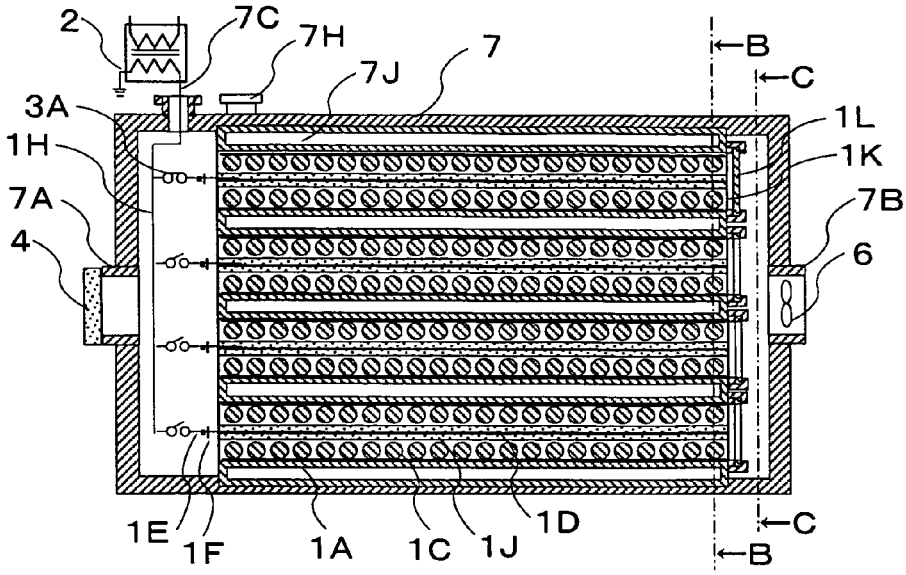
FIG. 21A is a longitudinal cross sectional view to explain the structure of a VOC treatment apparatus in Embodiment 11 of this invention.
Figure 21B:
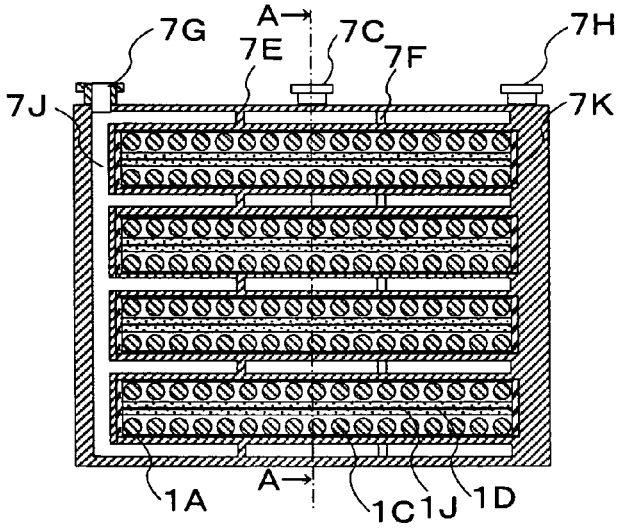
FIG. 21B is a lateral cross sectional view to explain the structure of a VOC treatment apparatus in Embodiment 11 of this invention.
Figure 21C:
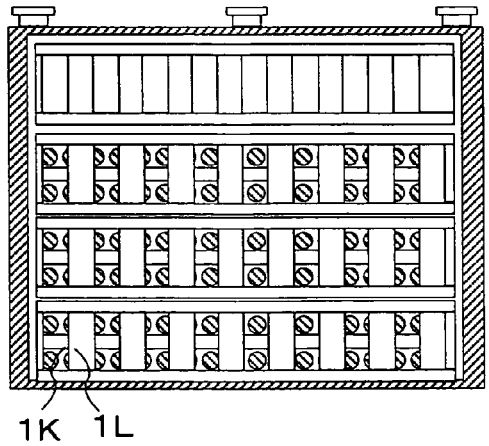
FIG. 21C is a lateral cross sectional view in other position to explain the structure of a VOC treatment apparatus in Embodiment 11 of this invention.

This Embodiment 11 is constructed such that a plate-like electrode is used. The structure of the VOC treatment apparatus in this Embodiment 11 is shown in FIG. 21A to FIG. 21C. FIG. 21A is a longitudinal cross sectional view, FIG. 21B is a lateral cross sectional view, and FIG. 21C is a lateral cross sectional view in other position, respectively. Incidentally, the AA cross section in FIG. 21B is corresponding to FIG. 21A, and the BB cross-section in FIG. 21A is corresponding to FIG. 21B, and the CC cross-section in FIG. 21B is corresponding to FIG. 21C, respectively.

In FIG. 21, four gas treatment units 1 are provided. One gas treatment unit 1 has a height of a little less than 2 cm and a width and a depth of several tens cm, respectively. In FIG. 21, for the purpose of explaining the structure, the height direction is enlarged and expressed.

The upper and lower portions of the gas treatment unit 1 are interposed by a planar cooling water passage 7J. Cooling water enters from a cooling water feed port 7G provided in the near side of the right side in the upper portion, which is, however, not shown in FIG. 21A; passes through the cooling water passage 7J; and comes out from a cooling water discharge port 7H provided in the far side of the left side in the upper portion. Two bulkheads 7E are provided, and the cooling water passage 7J makes 1.5 reciprocations right and left in FIG. 21A. As shown in FIG. 21B, one bulkhead 7E and one through-hole 7F are provided in the position of the BB cross section.

A gas to be treated which has passed through a filter 4 enters a container 7 from an inlet port 7A provided on the right side face, passes through the inside of the gas treatment unit 1, and is exhausted from an exhaust port 7B on the left side face. An exhaust fan 6 is provided just nearby the exhaust port 7B.

In the gas treatment unit 1, an earthed electrode 1A is provided on the upper and lower surfaces, and a high-voltage electrode 1D the outer surface of which is covered by a dielectric coat 1J such as ceramics is provided in the center. An adsorber 1C made of a granular hydrophobic zeolite is provided between the high-voltage electrode 1D and the upper and lower earthed electrodes 1A. An insulator 7K is provided on the inner surface of the container 7 such that electric discharge is not generated on the inner surface of the container 7. A gap between the high-voltage electrode 1D and the earthed electrode 1A is adjusted at about 5 mm, and an alternating current voltage of about 20 kV is applied to the high-voltage electrode 1D.

The high-voltage electrode 1D is connected to a voltage switching element 3A via a high-voltage conductor 1E and a fuse 1F; and a high-voltage conductor 1H to be connected to the other end of the voltage switching element 3A comes out the container 7 from a high-voltage conductor inlet port 7C provided in the upper portion in the exhaust side of the container 7 and is connected to a high-voltage generation device 2.

In the exhaust side of the gas treatment unit 1, as shown in FIG. 21C, the prescribed number (eight in this Embodiment 11) of rectangular exhaust ports 1K are provided at intervals slightly larger than the width of the exhaust port 1K. In the exhaust side of the exhaust port 1K, a shield plate 1L for opening and closing the exhaust port 1K is provided. The shield plate 1L is a plate having a size identical with that of the exhaust port 1K and having openings whose number is less than the exhaust port 1K by one, and when the shield plate 1L moves right and left, all of the exhaust ports 1K of the gas treatment unit 1 are simultaneously opened and closed. In FIG. 21C, the exhaust ports 1K of the uppermost gas treatment unit 1 are closed, and the exhaust ports 1K of other gas treatment units 1 are opened. In FIG. 21, a non-illustrated flow rate regulating mechanism 5 controls the movement of the shield plate 1L.

The action state A in this Embodiment 11 is a state in which the exhaust ports 1K are opened, and a high voltage is not applied to the high-voltage electrode 1D. The action state B is a state in which the exhaust ports 1K are closed, and a high voltage is applied to the high-voltage electrode 1D, thereby generating electric discharge.

Next, the action will be described. The control is achieved by the voltage switching control device 3 and the flow rate regulating mechanism 5 in such a manner that the four gas treatment units 1 take the action state B in sequence one by one, while the other gas treatment units take the action state A. In FIG. 21, the case where the uppermost gas treatment unit 1 takes the action state B is shown.

In this Embodiment 11, VOC can also be treated with good efficiency at a small power supply capacity, and the generation of NOx can be reduced.

According to this Embodiment 11, the plural laminated gas treatment units 1 are housed in one container 7, and therefore, it is possible to make the apparatus practically useful more cheaply. Incidentally, the container 7 may be provided for every one gas treatment unit 1, while providing a conduit of the gas to be treated and cooling water.

The above can be applied to other embodiments having the same construction.

Embodiment 12

Figure 22A:
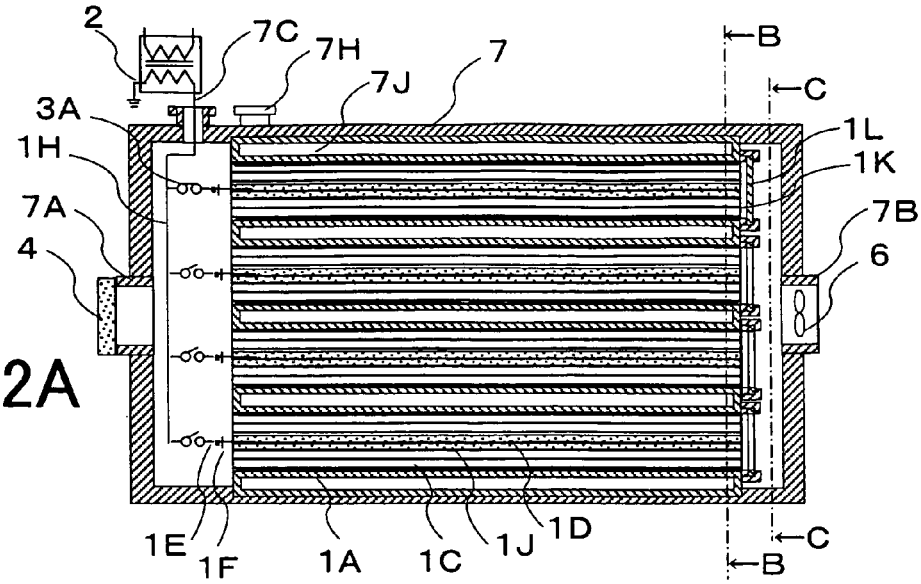
FIG. 22A is a longitudinal cross sectional view to explain the structure of a VOC treatment apparatus in Embodiment 12 of this invention.
Figure 22B:
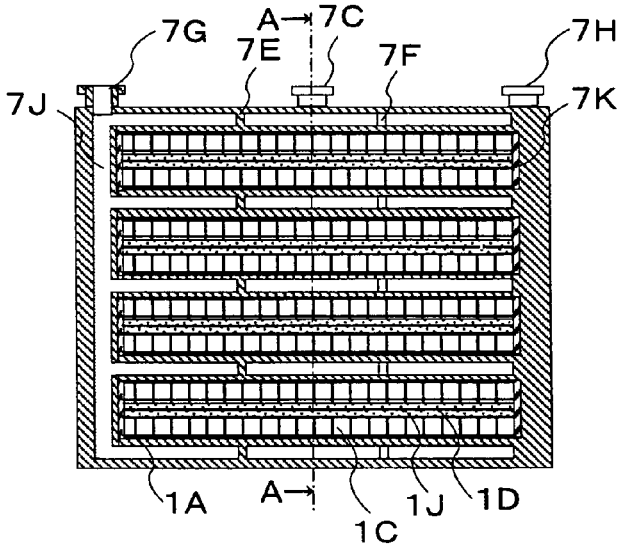
FIG. 22B is a lateral cross sectional view to explain the structure of a VOC treatment apparatus in Embodiment 12 of this invention.
Figure 22C:
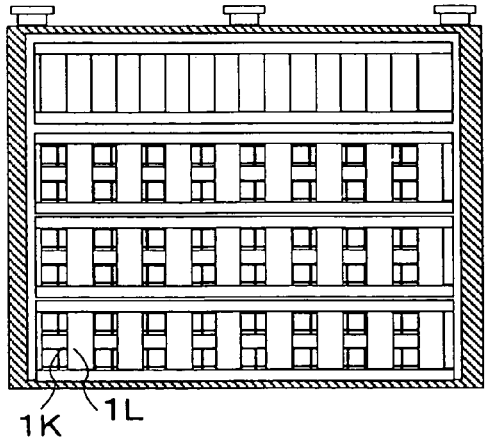
FIG. 22C is a lateral cross sectional view in other position to explain the structure of a VOC treatment apparatus in Embodiment 12 of this invention.

This Embodiment 12 is constructed such that a plate-like electrode and an adsorber in the honeycomb form are used. The structure of the VOC treatment apparatus in this Embodiment 12 is shown in FIG. 22A to FIG. 22C. FIG. 22A is a longitudinal cross sectional view, FIG. 22B is a lateral cross sectional view, and FIG. 22C is a lateral cross sectional view in other position, respectively. Incidentally, the AA cross section in FIG. 22B is corresponding to FIG. 22A, and the BB cross-section in FIG. 22A is corresponding to FIG. 22B, and the CC cross-section in FIG. 22B is corresponding to FIG. 22C, respectively.

The adsorber 1C is made of a hydrophobic zeolite in the honeycomb form. Electric discharge is generated substantially perpendicularly to the wall surface of a gas passage in the honeycomb form. Other structure is the same as in Embodiment 11.

In this Embodiment 12, VOC can also be treated with good efficiency at a small power supply capacity, and the generation of NOx can be reduced. Since the adsorber in the honeycomb form is used, a pressure loss during passing a gas flow is small so that the resulting VOC treatment apparatus become more practically useful.

Embodiment 13

Figure 23A:
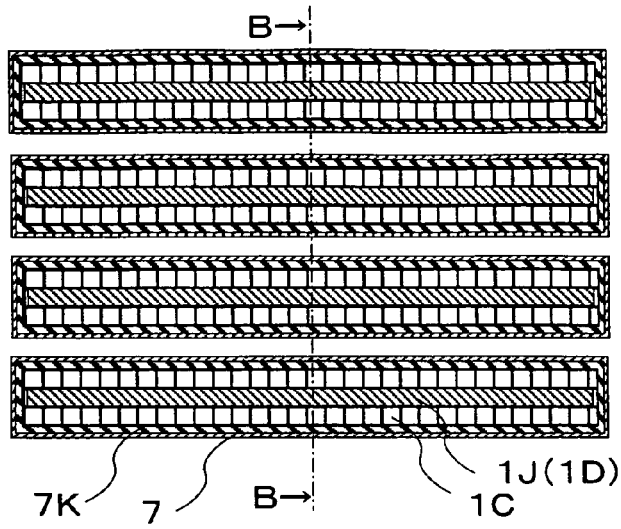
FIG. 23A is a lateral cross sectional view to explain the structure of a VOC treatment apparatus in Embodiment 13 of this invention.
Figure 23B:
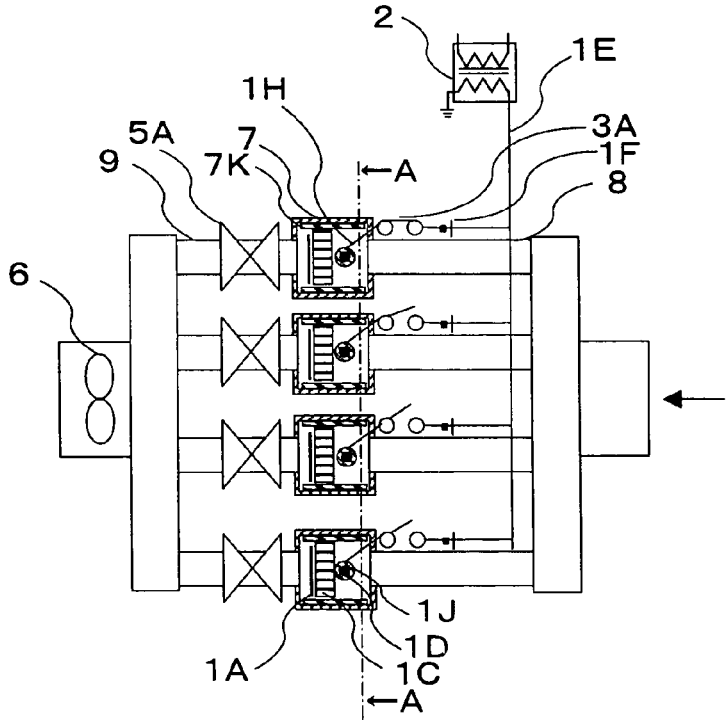
FIG. 23B is a longitudinal cross sectional view to explain the structure of a VOC treatment apparatus in Embodiment 13 of this invention.

Though in the foregoing embodiments, the electric discharge is generated in the direction perpendicular to the gas flow direction, this Embodiment 13 is the case of generating electric discharge in parallel to the gas flow direction. The structure of the VOC treatment apparatus in this Embodiment 13 is shown in FIG. 23A and FIG. 23B. FIG. 23A is a lateral cross sectional view, and FIG. 23B is a longitudinal cross sectional view, respectively. Incidentally, the AA cross section in FIG. 23B is corresponding to FIG. 23A, and the BB cross-section in FIG. 23A is corresponding to FIG. 23B, respectively. However, in FIG. 23B, the cross sectional view of only the inside of the container 7 is shown.

Four containers 7 each housing a gas treatment unit 1 having a long rectangular cross section are superimposed and disposed vertically. A feed conduit 8 and an exhaust conduit 9 of a gas to be treated are connected to each of the containers 7. A valve 5A is provided before the exhaust conduit 9. The gas flows from the right side to the left side in the drawing. One feed conduit 8 is provided in the inlet port of the gas to be treated and branched towards the respective gas treatment units 1; and the exhaust conduits 9 from the respective gas treatment units 1 are gathered into one. An exhaust fan 6 is disposed before an exhaust port 7B.

In the gas treatment unit 1, an mesh-like earthed electrode 1A is provided in the exhaust side, and linear or rod-like high-voltage electrodes 1D are disposed while interposing an adsorber 1C in the honeycomb form therebetween. The earthed electrode 1A is covered by a dielectric coat 1J made of a ceramic, or other materials. The thickness of the adsorber 1C is regulated such that it becomes suitable for generating electric discharge at a high voltage to be applied. The high-voltage electrode 1D is connected to a high-voltage generation device 2 for generating an alternating current high voltage via a high-voltage conductor 1E, a fuse 1F, a voltage switching element 3A, and a high-voltage conductor 1H successively from the gas inlet side. In order to avoid the generation of an unnecessary electric discharge, an insulator 7K is added on the side face of the inside of the container 7 with a prescribed width.

A flow rate regulating mechanism 5 controls opening and closing of the valve 5A; a voltage switching control mechanism 3 controls the voltage switching element 3A; one gas treatment unit 1 takes the action state B in sequence; and the other gas treatment units 1 take the action state A.

In this Embodiment 13, VOC can also be treated with good efficiency at a small power supply capacity, and the generation of NOx can be reduced.

Since the electric discharge is generated in the gas flow direction, the electrode has been made in the mesh-like, linear or rod-like form such that the gas can flow. The electrode is not in the mesh-like form but may be a plate having pores of a necessary size or the plural number of linear or rod-like electrodes arranged at intervals. So far as the gas flow can pass and the electric discharge can be generated, the shape of the electrode is not limited.

Since the dielectric coat 1J is covered on the earthed electrode 1A and an alternating current voltage is applied, electric discharge having a high power density can be stably generated, and a compact VOC treatment apparatus is obtainable. The high-voltage electrode 1D may be covered by a dielectric. By properly disposing a dielectric between the high-voltage electrode and the earthed electrode, it is possible to increase a power density of the electric discharge and obtain a compact VOC treatment apparatus.

In the case where it is not necessary to increase the power density so much, a dielectric may not be disposed between the high-voltage electrode and the earthed electrode. In that case, in the case where the earthed electrode is made in the planar form, the high-voltage electrode is made in the linear form, and a negative high voltage is applied to the high-voltage electrode, a stable electric discharge is likely obtained.

The above can be applied to other embodiments having the same construction.

Embodiment 14

Figure 24:
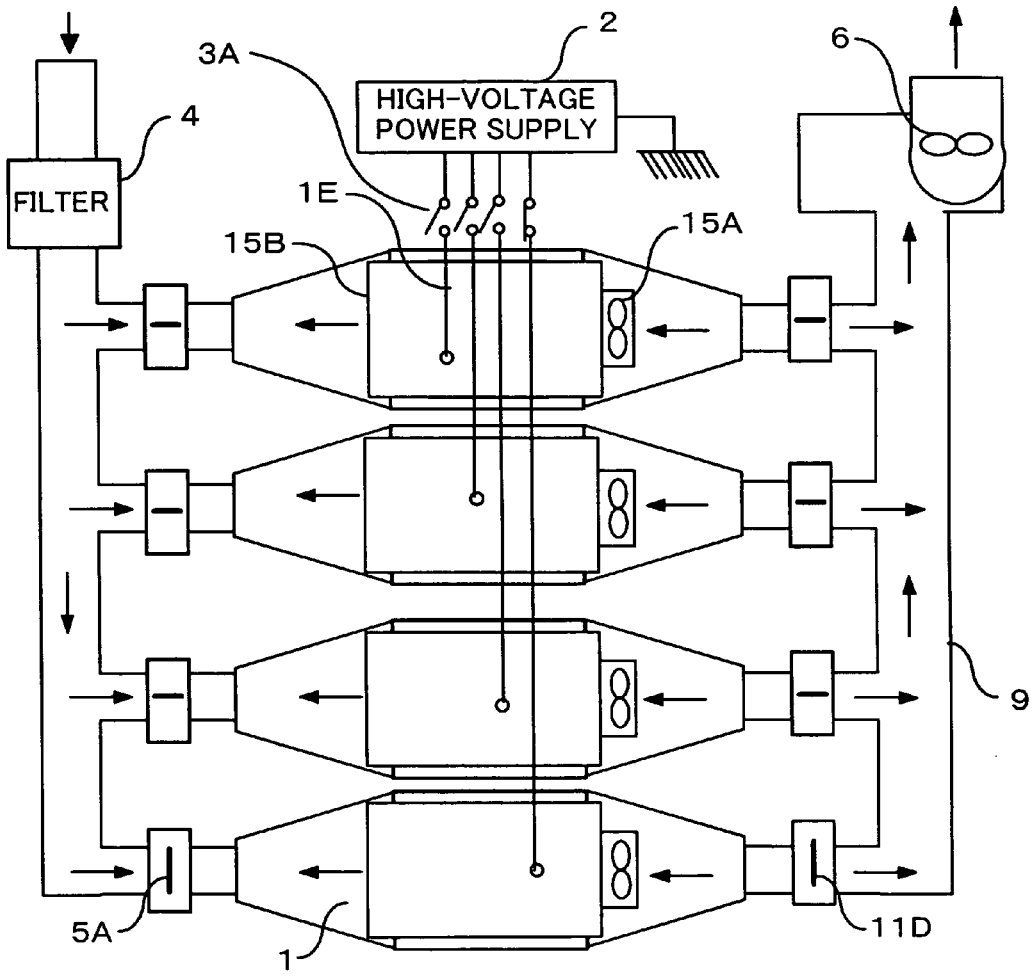
FIG. 24 is a plan view to explain the structure of a VOC treatment apparatus in Embodiment 14 of this invention.
Figure 25:
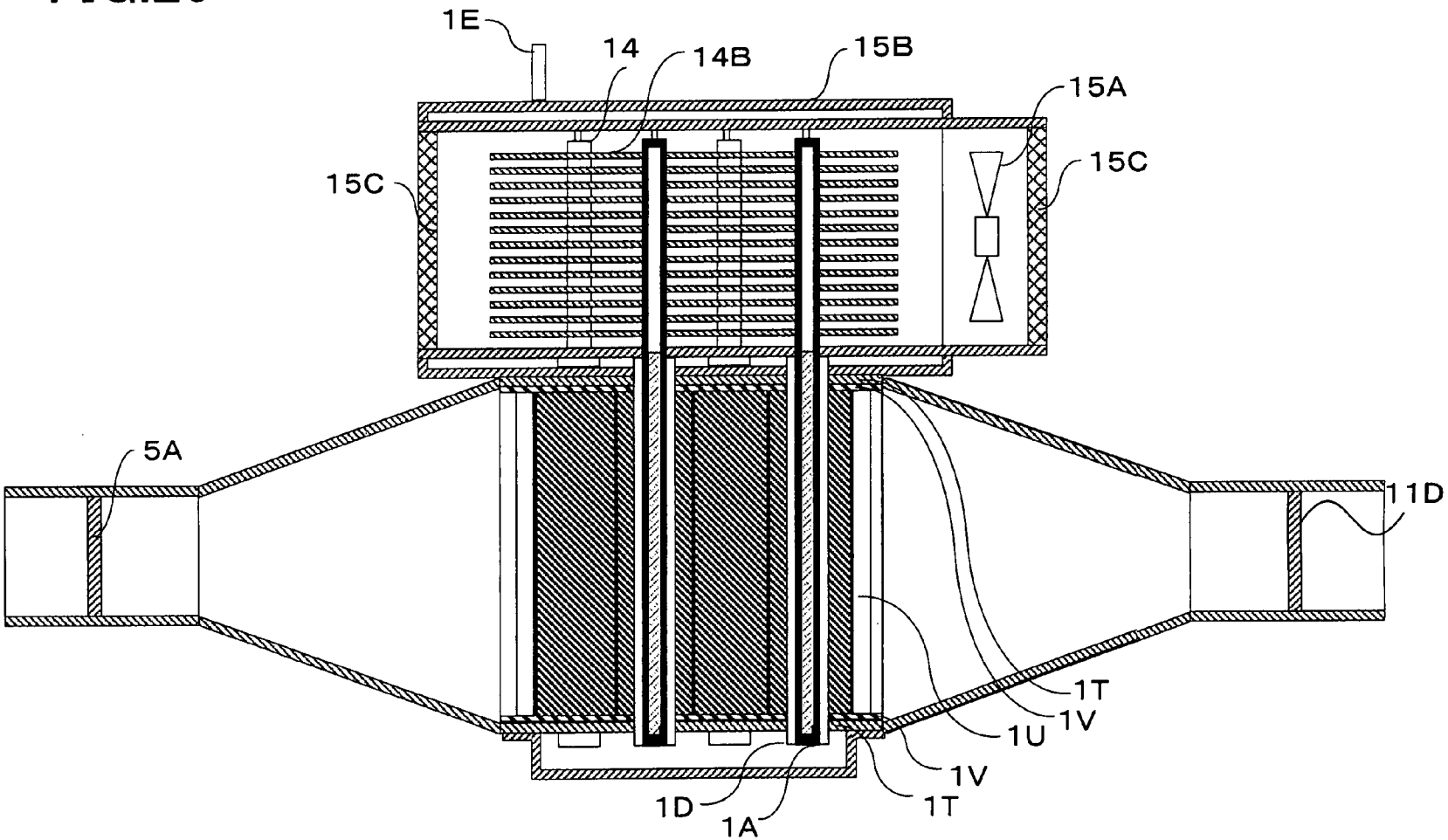
FIG. 25 is a longitudinal cross sectional view to explain the structure of a gas treatment unit of a VOC treatment apparatus in Embodiment 14 of this invention.
Figure 26:
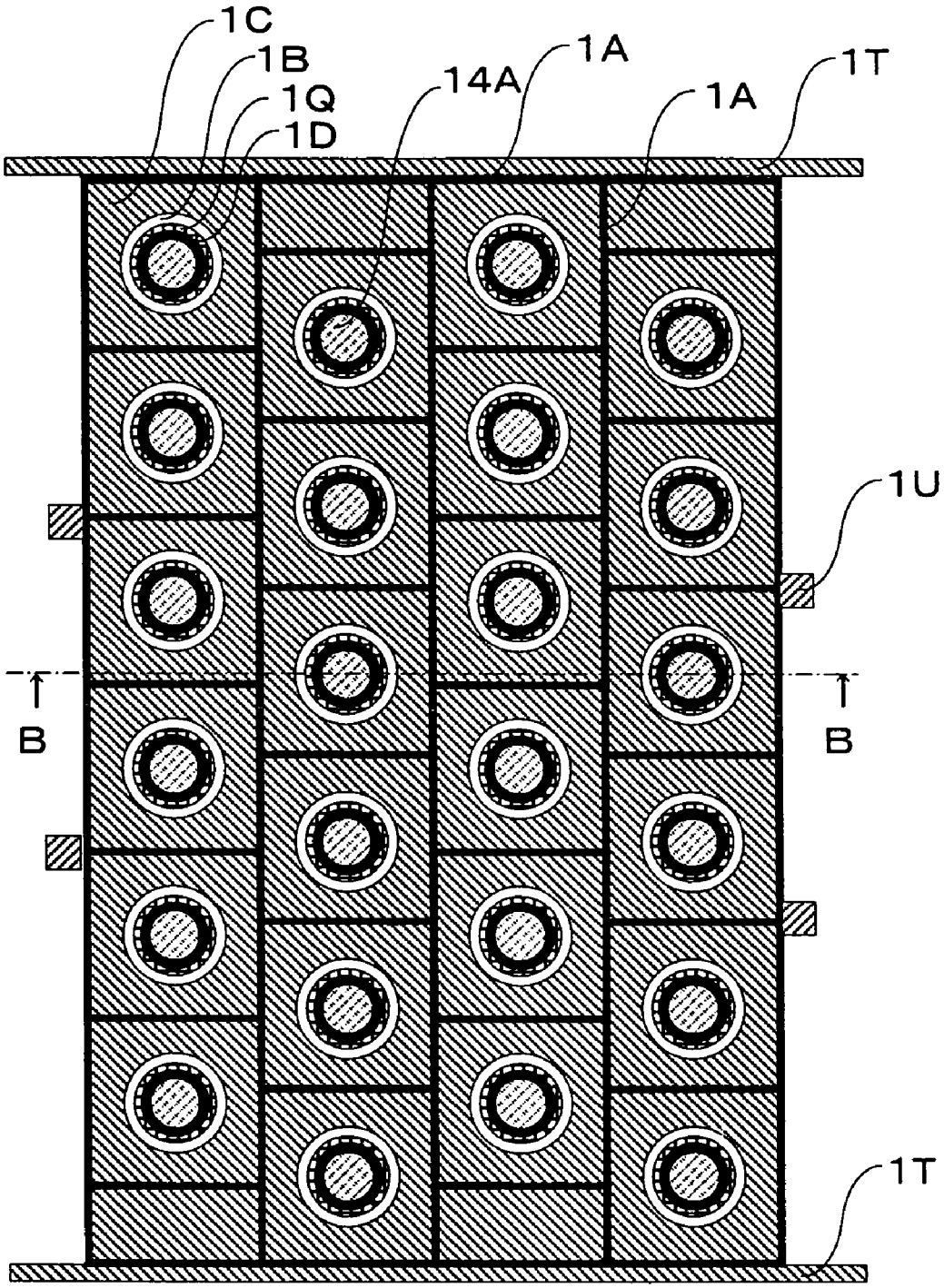
FIG. 26 is a lateral cross sectional view to explain the disposition of electrodes of a gas treatment unit of a VOC treatment apparatus in Embodiment 14 of this invention.
Figure 27:
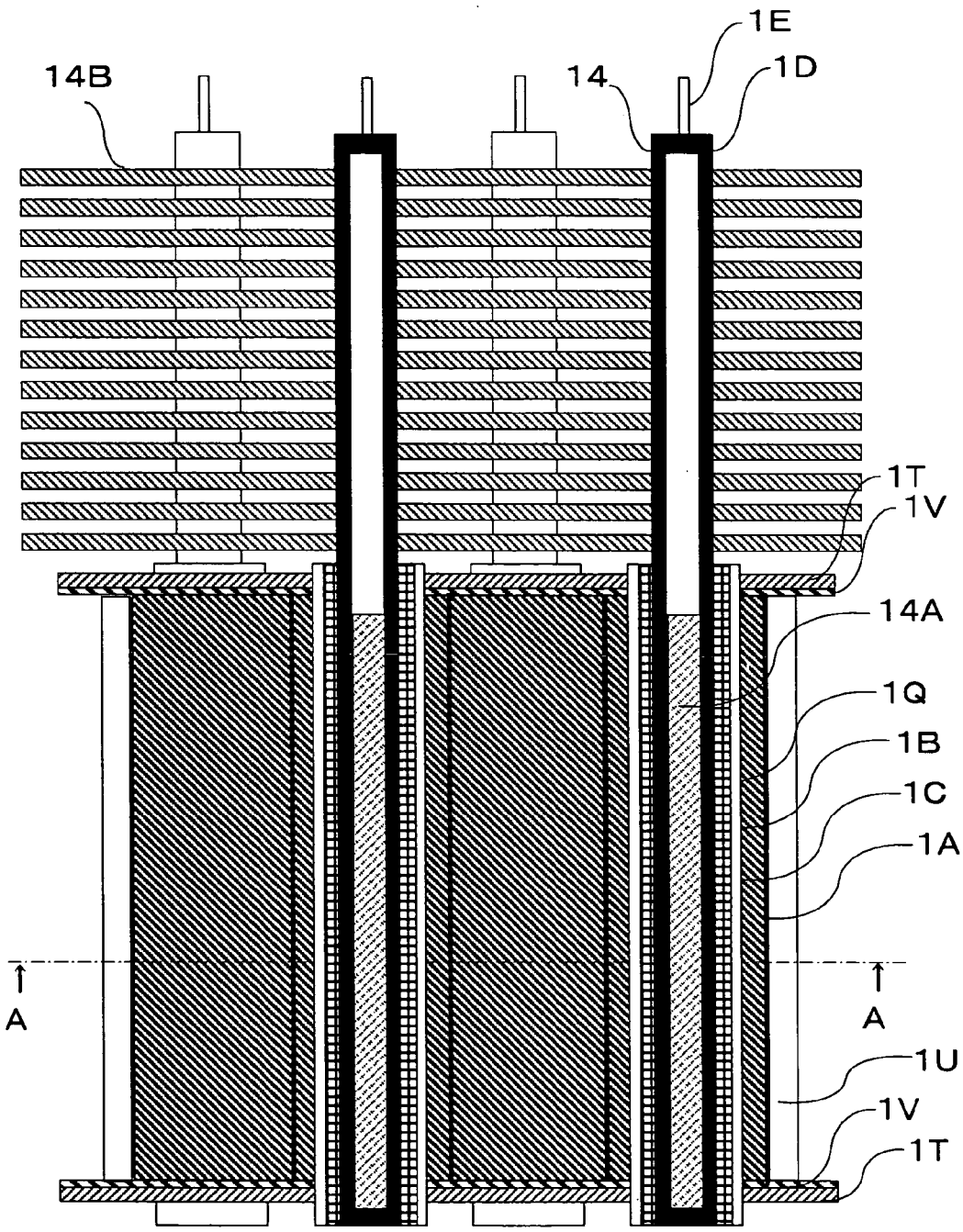
FIG. 27 is a longitudinal cross sectional view to explain the structure of electrodes of a VOC treatment apparatus in Embodiment 14 of this invention.

This Embodiment 14 is concerned with the case where in the construction of generating electric discharge in parallel to the gas flow direction, a cylindrical high-voltage electrode which is cooled by a heat pipe and an earthed electrode made of a metal mesh or a punching metal are used. The construction of the VOC treatment apparatus in this Embodiment 14 is shown in from FIG. 24 to FIG. 27. FIG. 24 is a whole view of the system; FIG. 25 is a longitudinal cross sectional view of the inside of the gas treatment unit 1; FIG. 26 is a lateral cross sectional view to show the electrode disposition of the inside of the gas treatment unit 1; and FIG. 27 is a longitudinal cross sectional view to explain the structure of an electrode of the VOC treatment apparatus. Incidentally, the BB cross section in FIG. 26 is corresponding to FIG. 27, and the AA cross section in FIG. 27 is corresponding to FIG. 26.

In FIG. 24, one VOC treatment apparatus is constructed of four towers of gas treatment units 1 each having a sealable cell. In the VOC treatment apparatus, a gas to be treated is sucked by an exhaust fan 6, and contaminants and paint scum are removed by a filter 4. In the drawing, in three towers of gas treatment units 1 from the upper side, both an inlet side valve 5A and an outlet side valve 11D are opened, and the gas to be treated is adsorbed by the adsorber, thereby cleaning the air. Also, in the lowermost one tower of gas treatment unit 1, the inlet side valve 5A and the outlet side valve 11D are closed, thereby sealing the gas treatment unit 1, a high voltage is applied from a high-voltage power source 2 through a voltage switching element 3A, and a desorption treatment is carried out by electric discharge.

FIG. 25 is a longitudinal sectional view of the inside of the gas treatment unit 1. The gas treatment unit 1 as shown in FIG. 25 is of electric discharge regeneration mode in which electric discharge is carried out by closing the valves 5A and 1D. Since the operation is carried out while keeping at around 100° C. without an excessive increase of the temperature of glass tube 1B, cooling is carried out by a heat pipe 14 also serving as a high-voltage electrode 1D. As shown in FIG. 27, the heat pipe 14 has the same construction as in the case of Embodiment 10.

The gas treatment unit 1 is provided with a rectangular, cylindrical metal-made structural member 1T through which the gas to be treated passes and the prescribed number of a column 1U disposed outside the outermost earthed electrode 1A in the direction crossing to the flow of the gas to be treated. The structural member 1T connects with a supply pipe 8 and an exhaustion pipe 9 and constitutes a compartment with no leakage of gases to the outside. The structural member 1T is a steel plate having a prescribed thickness and is provided with a reinforcing rib for enhancing the strength in a prescribed portion of the outside. A hole for inserting every one glass tube 1B is provided on the upper surface and the lower surface of the rectangular cylindrical structure member 1T. The glass tube 1B is inserted in this hole and fixed in a prescribed position. The column 1U supports the outermost earthed electrode 1A to which a load of the adsorber 1C is applied, and the upper surface and the lower surface of the structural member 1T are connected to each other, thereby making it strong. The column 1U is disposed in a position at which the earthed electrode 1A is provided in parallel to the gas flow such that the flow of the gas is not interrupted as far as possible.

An insulating material 1V is disposed inside the upper surface and the lower surface of the structural member 1T, respectively such that no electric discharge is generated between the structural member 1T and the high-voltage electrode 1A. Though the insulating material 1V is also provided with a hole through which the glass tube 1B passes, a structure for bringing air-tightness between the hole of the insulating material 1V and the glass tube 1B is provided such that the gas to be treated does not leak.

Further, air is forcedly applied to a radiating panel 14B by a cooling fan 15A, thereby cooling the heat pipe 14. The periphery of the radiating panel 15A is surrounded by a cylindrical blast guide 15B such that a ventilation trunk for stabilizing the airflow by the cooling fan 15A is formed. For the purpose of not sucking external dirt and dusts from the cooling fan 15A, a filter 15C is provided in an inlet and an outlet of the ventilation trunk. The cylindrical blast guide 15B that will become a ventilation trunk is provided above the structural member 1T. Incidentally, if the glass tube 1B can be properly cooled by spontaneous heat exchange between the radiating panel 14B and the fresh air, the cooling fan 15A, the blast guide 15B and the filter 15C are not required.

FIG. 26 is the disposition of electrodes within one gas treatment unit 1. In FIG. 26, seven high-voltage electrodes 1D in each row are provided over four rows. The position in the longitudinal direction of the high-voltage electrodes 1D in the drawing is disposed in the middle between the positions of the adjacent rows. The reason why such a disposition is taken is as follows. That is, since the gas to be treated does not flow in the portions of the high-voltage electrodes 1D, the gas to be treated is to flow within the electric discharge space uniformly as far as possible. Incidentally, the number of the high-voltage electrode 1D in one row and the number of row may be any number.

FIG. 27 is a longitudinal cross sectional view to explain the construction of the high-voltage electrode 1D and the periphery thereof. The high-voltage electrode 1D is a cylinder in which water is sealed therein as a coolant. The glass tube 1B is disposed in a concentric circle form in the outside the high-voltage electrode 1D, and a feed layer 1Q made of, for example, a flexible metal having good electrical and thermal conductivity is provided between the high-voltage electrode 1D and the glass tube 1B. The prescribed number of radiating panel 14B is provided above the high-voltage electrode 1D. The radiating panel 14B is shared by the heat pipe 14 for cooling the high-voltage electrodes 14D of four rows in total as shown in FIG. 26. For the purpose of avoiding complication, the blast guide 15B and so on are not shown in the longitudinal cross sectional view of FIG. 27 and the like. Since a high voltage is applied to the high-voltage electrode 1D and the radiating panel 14B, a proper member is disposed such that no electric discharge is generated in the spaces against the blast guide 15B and the like, which is, however, not shown in the drawing. Incidentally, if no high voltage is applied to the radiating panel 14B as shown in FIG. 20, a member to be provided such that no electric discharge is generated in the spaces against the blast guide 15B and the like is not required.

The earthed electrode 1A is disposed such that the respective high-voltage electrodes 1D are squarely surrounded. The earthed electrode 1A is disposed such that the shortest distance between the earthed electrode 1A and each glass tube 1B, electric discharge gap length becomes uniform at a prescribed value within the range of from 5 to 20 mm. When the electric discharge gap is short, there gives rise to an advantage that an applied voltage may be made low, whereas when the electric discharge gap is long, though the applied voltage may be made high, there gives rise to an advantage that the number of electrode can be made small. The electric discharge gap is comprehensively determined while taking into account various conditions such as performance values to be realized, costs, and restrictions which may preferably be fulfilled.

The adsorber 1C is granular and is filled within the range surrounded by the outermost earthed electrode 1A.

Though the earthed electrode 1A includes a portion in the crossing direction to the flow of the gas to be treated, the earthed electrode 1A is constructed of a metal mesh or a punching metal such that the gas to be treated readily flows. In other earthed electrodes 1A than the outermost earthed electrode, the mesh size of a net of the metal mesh or the pore size of the punching metal is regulated at a size such that the adsorber 1C easily goes therethrough. For example, the size is about 1.5 times or more of the diameter of the granular adsorber 1C. For the purpose of efficiently generating electric discharge, the pore size is not more than about 6 mm. This is because it is known that the electric discharge generates in a columnar form having a diameter of from about 1 to 4 mm, the most of which is generated in a diameter of about 3 mm. When the pore size is about 6 mm, it is possible to suppress of a reduction in the number of electric discharge column, which is caused due to the presence of pores, by about 10%. In the light of the above, in the case of using a spherical adsorber having a particle size of 2 mm, the pore size of the earthed electrode 1A is regulated at about 3 mm or more, and desirably from about 3 to 6 mm. In a pellet having a particle size of 3 mm, the pores size of the earthed electrode 1A is regulated at 4.5 mm or more, and desirably from about 4.5 to 6 mm. Incidentally, in the outermost earthed electrode 1A in the crossing direction to the flow of the gas to be treated, the mesh size of a net of the metal mesh or the pore size of the punching metal is regulated at less than the diameter of the adsorber 1C such that the granular adsorber 1C does not leak away. The outermost earthed electrode 1A in the parallel direction of the flow to be treated is not provided with a hole such that the adsorber 1C does not leak.

Other structure is the same as in Embodiment 13.

The action is the same as in Embodiment 13. Since in the horizontal plane, the cross section of the earthed electrode 1A is square and the cross section of the high-voltage electrode 1D is circular, the electric discharge density in the horizontal plane is not uniform. However, the electric discharge time is regulated such that the adsorber 1C in the vicinity of a corner of the square earthed electrode 1A in which the gap between the electrodes becomes long can also be desorbed to a necessary extent.

In this Embodiment 14, VOC can also be treated with good efficiency at a small power supply capacity, and the generation of NOx can be reduced. By making the pore size of the earthed electrode 1A sufficiently larger than the diameter of the adsorber 1C, at the time of packing the adsorber 1C, even when the adsorber is charged from one place in the upper portion, the adsorber 1C is spread over the whole of the electric discharge space surrounded by the outermost earthed electrode 1A within the gas treatment unit 1, and therefore, the assembling is easy.

Incidentally, it is not always necessary that the earthed electrode 1A within the electric discharge space has pores, all of which have the same pore size. For example, in the earthed electrode 1A in the horizontal direction in FIG. 26, the number of pore may be decreased, the pore size may be made small, or the pore may be omitted. This is because since this earthed electrode 1A is parallel to the flow direction of the gas to be treated, the gas to be treated can be made to flow even without the pore.

When the cross section of the earthed electrode 1A is an equilateral hexagon, a change in the distance between the high-voltage electrode 1D and the earthed electrode 1A is smaller than that in the case of a square, and a dead space (a portion not present between the high-voltage electrode 1D and the earthed electrode 1A) becomes small. If the generation of a dead space is tolerable, the cross section of the earthed electrode 1A may be an equilateral octagon.

Incidentally, while the high-voltage electrode 1D has been made in the columnar form, it may be made in a square pillar form having a prescribed rounded corner. If the high-voltage electrode 1D is made in the square pillar form, a fluctuation in the distance between the high-voltage electrode 1D and the earthed electrode 1A can be made small. The reason why the corners of the square pillar are rounded resides in the matter of avoiding concentration of electric discharge in the corners. The corners are not always rounded.

Figures 28A, 28B:
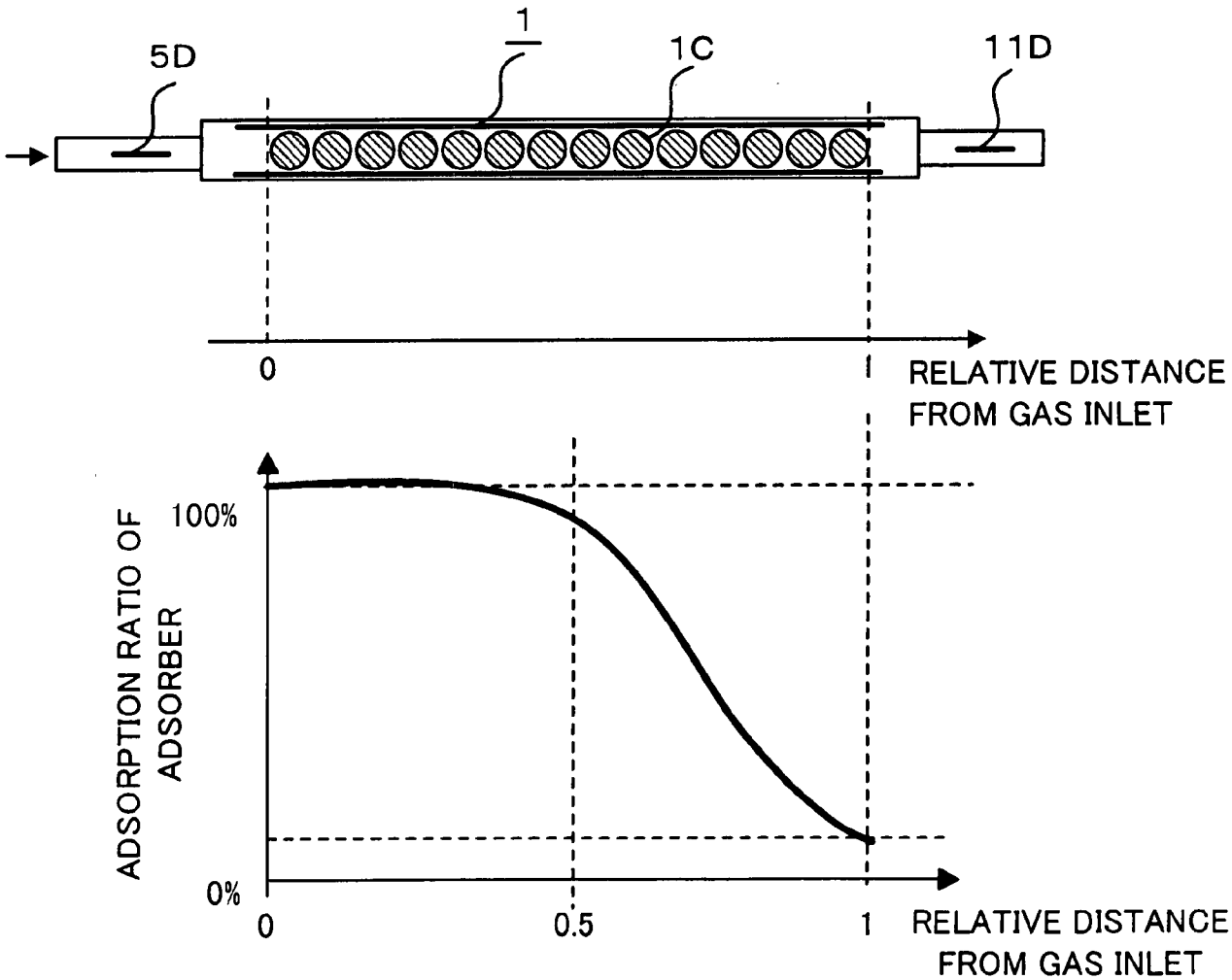
FIG. 28A is a conceptual view to explain the distance from the inlet of the gas to be treated to explain the change of the adsorption amount of VOC by the position of an adsorber in a gas treatment unit in a VOC treatment apparatus in Embodiment 14 of this invention.
FIG. 28B is a diagram to explain the change of the adsorption amount of VOC by the position of an adsorber in a gas treatment unit in a VOC treatment apparatus in Embodiment 14 of this invention.

Further, it is possible to restrict an electric discharge power while taking into account the amount of VOC to be adsorbed on the adsorber 1C. FIG. 28A and FIG. 28B are drawings to explain the VOC adsorption amount of the adsorber 1C at the point where VOC in the gas to be treated cannot be completely adsorbed, whereby VOC remains in an amount of, for example, 10% of the VOC concentration at the inlet of the gas treatment unit 1 in the treated gas coming out from the gas treatment unit 1.

FIG. 28A is a conceptual view to explain the distance from the inlet of the gas to be treated. FIG. 28B shows a change of the VOC adsorption amount of the adsorber 1C depending upon the distance from the inlet of the gas treatment unit 1. The distance as referred to herein is expressed in terms of a relative distance that is a ratio to the full length of the adsorber. In FIG. 28B, the ordinate represents an adsorption ratio expressing what percent of VOC has been actually adsorbed against the amount of VOC that the adsorber 1C can adsorb.

FIG. 28A shows the case where the electric discharge is generated vertically to the gas flow. However, even in the case where the electric discharge is generated in parallel to the gas flow as in this embodiment, the change of the adsorption ratio of the adsorber 1C depending upon the distance from the inlet of the gas treatment unit 1 becomes one as shown in FIG. 28B.

As shown in FIG. 28B, in the region of from a portion near the inlet of the gas treatment unit 1 to substantially a half of the full length, the adsorber 1C adsorbs 100% of VOC. In the downstream side from substantially the half of the full length, the adsorption ratio gradually decreased and becomes about 10% in a portion near the outlet.

Here, the portion in the upstream side from the center of the full length of the adsorber 1C, where substantially 100% of VOC is adsorbed, is called the upwind portion, and the downstream side where VOC can be still sufficiently adsorbed is called the downwind portion. In FIG. 28B, the averaged adsorption ratio in the upwind portion is close to 100%, while the adsorption ratio in the downwind portion is about 50% in average. Since the amount of energy necessary for desorbing VOC from the adsorber 1C is proportional to the amount of adsorbed VOC, the time for generating electric discharge in the downwind portion is about a half of that in the upwind portion. In this way, in the case where the electric discharge time is made equal between the upwind portion and the downwind portion, the energy to be consumed fruitlessly in the downwind portion can be saved.

Incidentally, the amount of the electric discharge energy may be changed by making the electric discharge time equal. Also, in FIG. 25, while the number of the high-voltage electrode 1D has been made equal between the upwind portion and the downwind portion, the high-voltage electrodes 1D may be disposed in the downwind portion such that the number is decreased within the same area. Incidentally, when the number of the high-voltage electrode 1D is changed within the same area, the minimum distance between the high-voltage electrode 1D and the earthed electrode 1A, namely, the electric discharge gap also changes, and the electric discharge voltage changes, too. Accordingly, a high-voltage power supply device may preferably be separately provided in the upwind portion and the downwind portion. In the case where the amount of the electric discharge energy is changed in the upwind portion and the downwind portion, a high-voltage power supply device may preferably be provided separately in the upwind portion and the downwind portion, too. Incidentally, when the plural high-voltage power supply devices are provided, the manufacturing costs of apparatus increase, but the number of the high-voltage power supply device and its voltage are comprehensively determined while judging the costs and performance.

Here, the upwind portion and the downwind portion are divided in substantially the center of the full length of the adsorber 1C, but the position to be divided varies depending upon the full length of the adsorber 1C. If the full length of the adsorber 1C is long, the proportion of the upwind portion becomes large. This is because if the VOC treatment apparatus having a characteristic of FIG. 28B is present, whether or not VOC remains in the treated gas is determined only by the amount of the adsorber 1C which can still adsorb VOC, namely, the length of the downwind portion, and if the full length of the adsorber 1C is prolonged, the prolonged portion comes into the upwind portion.

The cross sectional area of the space for holding the adsorber in the flowing direction of the gas to be treated, the full length of the adsorber in the flowing direction of the gas to be treated, the size and number of the high-voltage electrode to be disposed, and the minimum distance between the high-voltage electrode and the earthed electrode are designed while comprehensively taking into consideration the flow rate of the gas to be treated which should be treated per unit time, the VOC concentration in the gas to be treated, easiness of flowing of the gas in a space for holding the adsorber, the structure strength, the period of cycle of adsorption and desorption, the manufacturing costs, the operating costs, and so on. For example, the following points should be considered. That is, the total amount of the adsorber may preferably be regulated at a value adaptive with the period and the VOC concentration such that the adsorber does not cause breakdown within the period of the treatment. The cross sectional area of the space for holding the adsorber and the gas flow rate are determined by the flow rate of the gas to be treated. The full length of the adsorber is determined such that VOC that has not been adsorbed immediately before the start of desorption is not generated and that a pressure loss of the gas falls within a prescribed range. In some case, the shape of the space for holding the adsorber is determined, and the electric discharge gap and the size and number of the high-voltage electrode are then determined. Also, in some case, the electric discharge gap is first determined, and the shape of the space for holding the adsorber is then determined.

By providing a column 1U outside the outermost earthed electrode 1A in the crossing direction to the flow of the gas to be treated, the possibility that the outermost earthed electrode 1A deforms or breaks due to the weight of the packed adsorber 1C becomes low. Also, since the upper surface and the lower surface of the structural member 1T are connected, the structure strength of the structural member 1T becomes large. Incidentally, the column 1U may be a lateral beam or an oblique beam.

While the structural member 1T has been made of a metal, it may be prepared by using a reinforced ceramic or a reinforced plastic so far as a sufficient strength is obtained. In the case where the structural member is prepared by using a reinforced ceramic or a reinforced plastic having electric insulation properties, the resulting structural member will realize a function as an insulating material for the purpose of preventing unnecessary electric discharge.

The thickness, number and position of the column 1U are determined such that a prescribed strength is obtained and that the flow of the gas to be treated is not interrupted as far as possible. In the case where a sufficient strength is obtained by a cylindrical structural member in a small-sized apparatus, there is some possibility that a structure member is not provided in the outside of the outermost earthed electrode 1A in the crossing direction to the flow of the gas to be treated. In the case where a sufficient strength is not obtained only by the structural member in the outside of the space for holding the adsorber 1C, a structural member surrounded by the earthed electrode may be disposed such that the electric discharge is not affected.

While the space for holding the adsorber of the gas treatment unit 1 has been of a rectangular parallelepiped, other shapes than the rectangular parallelepiped, such as a polygonal pillar, a cylindrical column, and a combination of rectangular parallelepipeds, may be employed.

The above can be applied to other embodiments.

Embodiment 15

This Embodiment 15 is the case where Embodiment 14 is change such that the cross section of the earthed electrode 1A surrounding the high-voltage electrode 1D is of an equilateral octagon and that a metal-made column is penetrated into a square portion surrounded only by the earthed electrodes 1A.

Figure 29:
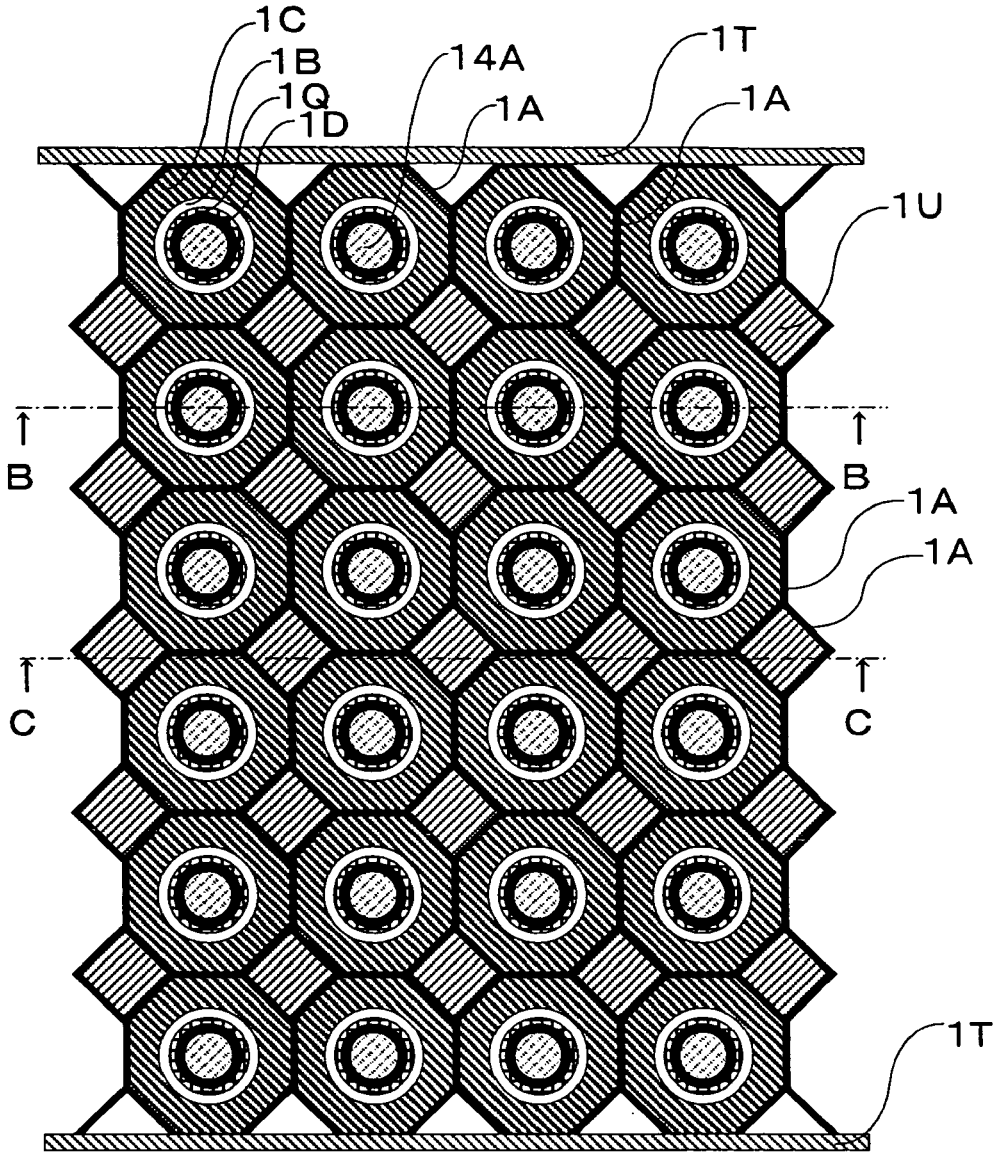
FIG. 29 is a lateral cross sectional view to explain the disposition of electrodes in a gas treatment unit of a VOC treatment apparatus in Embodiment 15 of this invention.
Figure 30:
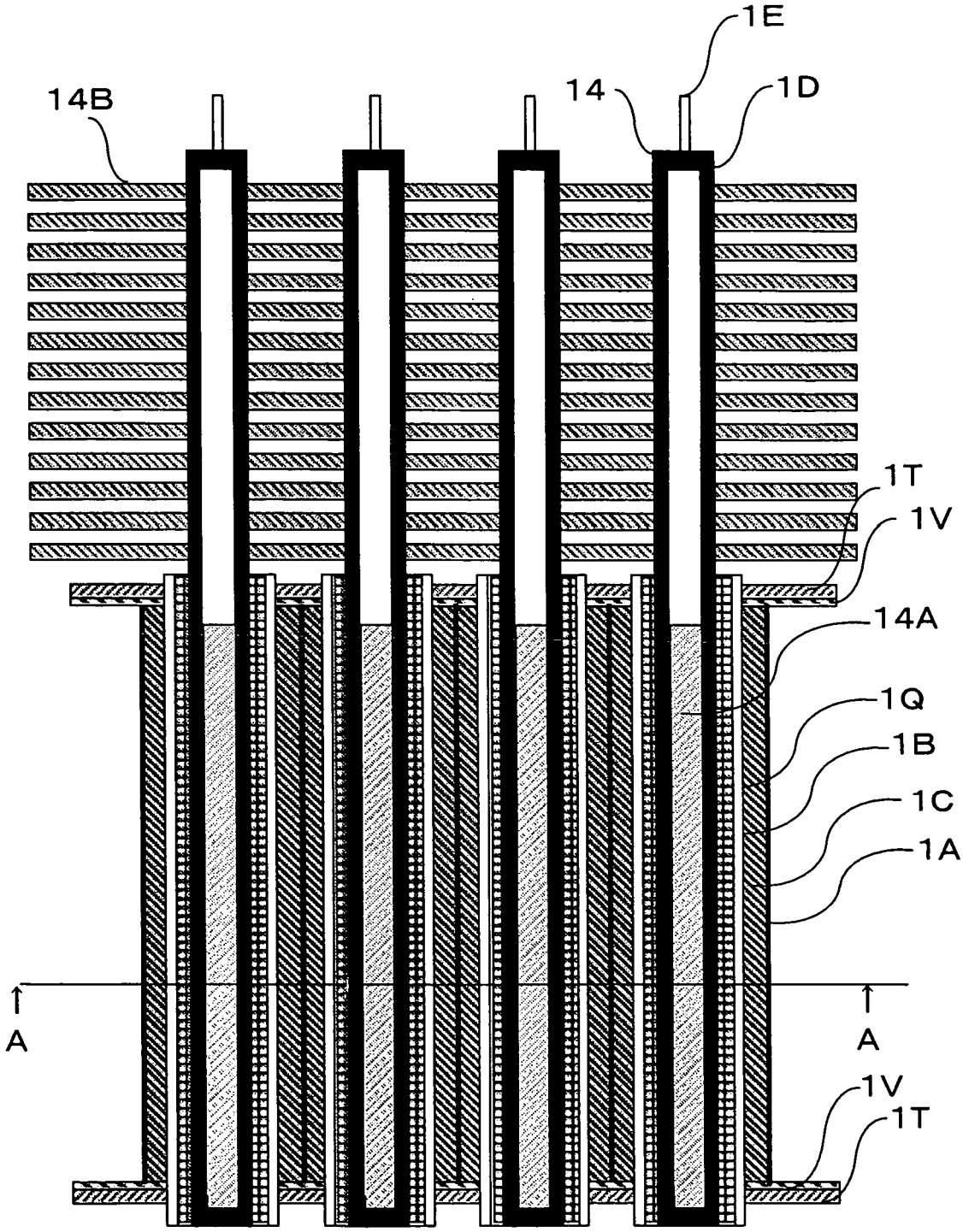
FIG. 30 is a longitudinal cross sectional view to explain the structure of electrodes of a VOC treatment apparatus in Embodiment 15 of this invention.
Figure 31:
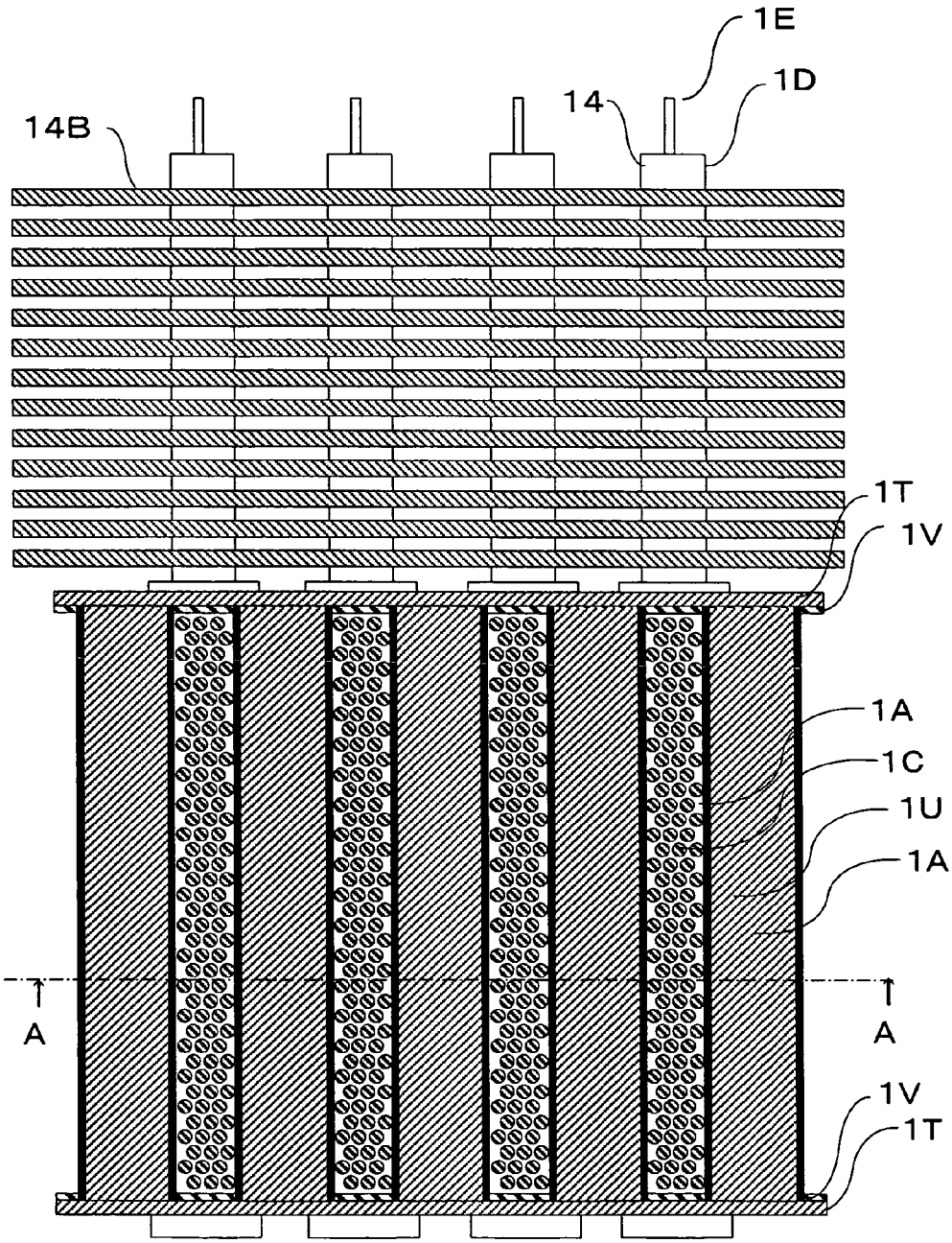
FIG. 31 is a longitudinal cross sectional view in the position close to an earthed electrode of a VOC treatment apparatus in Embodiment 15 of this invention.

FIG. 29 to FIG. 31 are each a view to explain the structure of the VOC treatment apparatus in this Embodiment 15, in which FIG. 29 is a lateral cross sectional view, FIG. 30 is a longitudinal cross sectional view in the BB cross section of FIG. 29, and FIG. 31 is a longitudinal cross sectional view in the CC cross section of FIG. 29.

Only points different from FIG. 26 and FIG. 27 concerning the case of Embodiment 14 will be described. A high-voltage electrode 1D and a glass tube 1B surrounding it are disposed such that they are in the same position in the adjacent rows, and the cross section of the earthed electrode 1A surrounding the high-voltage electrode 1D is of an equilateral octagon. Then, since a square portion surrounded by the earthed electrodes 1A is generated, a column 1U the surface of which is made to function as the earthed electrode 1A and which structurally strengthens the gas treatment unit is provided in this square portion. The column 1U connects the upper surface and the lower surface of a cylindrical structural member 1T to each other. The column 1U is made of a metal having high electrical conductivity and high thermal conductivity. In the inside of the side face of the structural member 1T, an earthed electrode 1A in which a groove having a cross section of an isosceles right triangle is provided in a prescribed position of a plate material having no hole provided therein by press processing or the like is installed such that the bottom of the groove is faced inward, thereby making the cross section of the earthed electrode 1A equilaterally octagonal. The reason why no hole is provided in this earthed electrode 1A resides in the matter of avoiding the entrance of the adsorber 1C into the space between the earthed electrode 1A and the structural member 1T. Incidentally, since the adsorber 1C has entered the space cannot be desorbed by electric discharge, such is fruitless.

Other structure is the same as in Embodiment 14.

Since the high-voltage electrode 1D and the glass tube 1B surrounding it are disposed such that they are in the same position in the adjacent rows, four rows of the high electrode 1D and the glass tube 1B are presented on the cross section as shown in FIG. 30. In FIG. 31, which is the cross section very close to the earthed electrode 1A in the parallel direction to the flow of the gas to be treated, it is noted that the earthed electrode 1A is provided with a hole and that the adsorber 1C is also packed in the far side from the hole.

This Embodiment 15 acts in the same manner as in Embodiment 14, thereby giving rise to the same effect. Further, since metal-made column 1U is provided within the space for holding the adsorber, it is possible to realize a gas treatment unit that is strong as a structure. Since the metal-made column 1U conducts heat as generated by electric discharge into the structural member 1T, even when the temperature within the gas treatment unit is the same, it is possible to make the electric discharge current larger. Also, since the cross section of the earthed electrode surrounding the high-voltage electrode is made equilaterally octagonal, the gap length between the high-voltage electrode and the earthed electrode can be made closer than that in the case of a square, and electric discharge can be generated more uniformly.

While the column 1U has been made to serve as the earthed electrode 1A, too, in the case where the column 1U is prepared by using a material having not so high conductivity, an earthed electrode 1A may be provided separately from the column 1U.

Every one earthed electrode as provided in the inside of the side face of the structural member 1T may be installed in the structural member. Also, the earthed electrode 1A may be made of a column material having a cross section of an isosceles right triangle in place of the plate material. The above can be applied to other embodiments having the same earthed electrode.

Embodiment 16

This Embodiment 16 is the case where for the purposes of more increasing the strength and making assembling easy, Embodiment 15 is changed such that the earthed electrode in the side face side in parallel to the gas flow also serves as a structural member.

Figure 32:
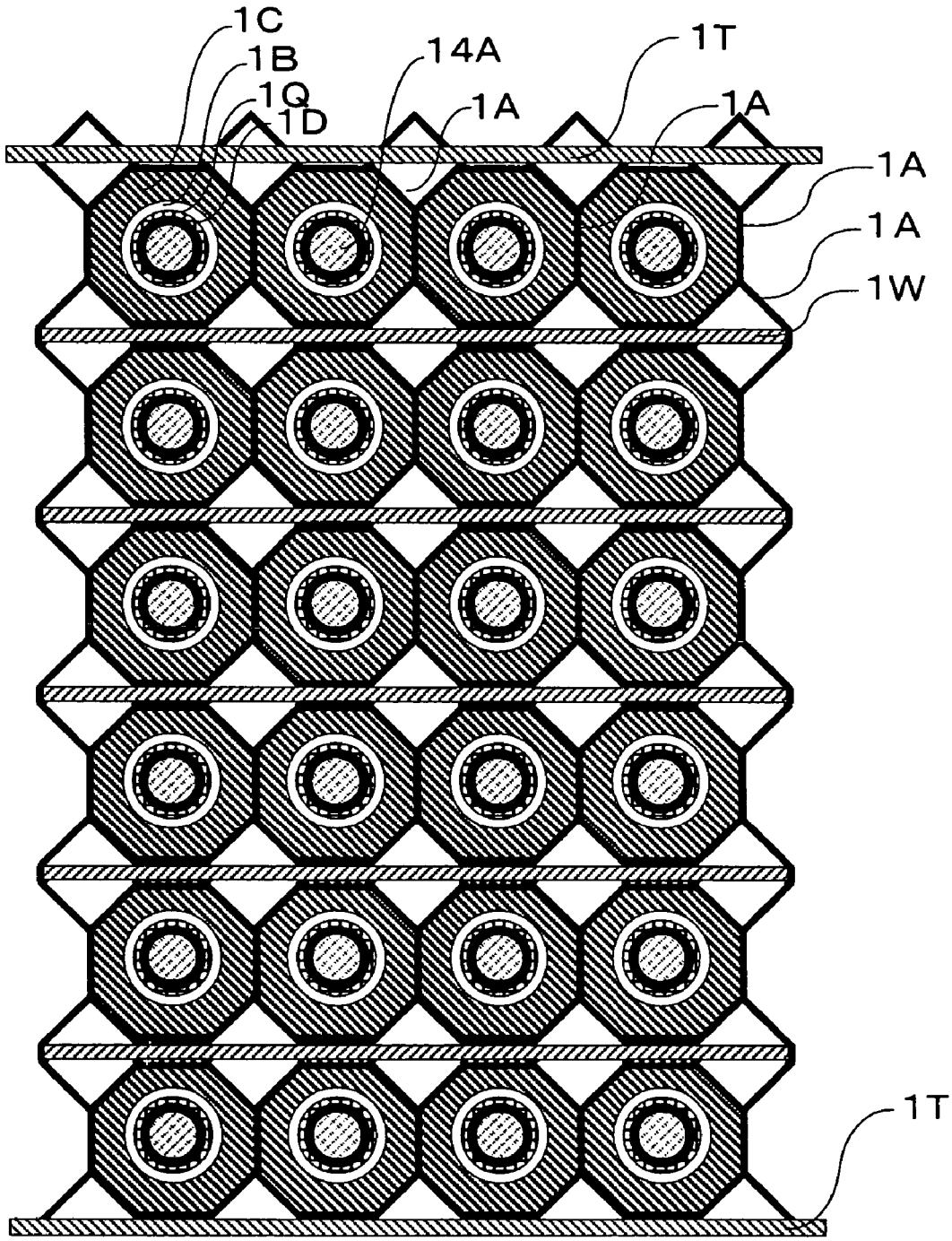
FIG. 32 is a lateral cross sectional view to explain the disposition of electrodes of a gas treatment unit of a VOC treatment apparatus in Embodiment 16 of this invention.

FIG. 32 is a lateral cross sectional view to explain the structure of the VOC treatment apparatus in this Embodiment 16. Only points different from FIG. 29 concerning the case of Embodiment 15 will be described. As a reinforcing member for increasing the strength in the parallel direction to the flow of the gas to be treated, a plate material 1W is used in place of the column 1U. The plate material 1W is made of a metal having high electrical conductivity and high thermal conductivity. An earthed electrode 1A having the same shape as in the inside face of the structural member 1T is also installed on the both surfaces of the plate member 1W. By providing such an earthed electrode 1A, the cross section of the earthed electrode 1A surrounding the high-voltage electrode 1D becomes equilaterally octagonal, and the electric discharge density can be made close to uniformity. The thickness of the plate material 1W is a thickness at which a prescribed structural strength is obtained.

Other structure is the same as in Embodiment 15.

This Embodiment 16 acts in the same manner as in Embodiment 15, thereby giving rise to the same effect. Since the reinforcing member is changed to the plate material 1W from the column 1U, there give rises to effects that it is possible to reduce a trouble for installing the reinforcing member in the structural member 1T and that assembling of the gas treatment unit becomes easier.

Since the earthed electrode 1A for making the cross section of the earthed electrode 1A surrounding the high-voltage electrode 1D equilaterally octagonal, there gives rise to an effect that the electric discharge becomes close to uniformity. Incidentally, the earthed electrode 1A may be installed in the plate material 1W. In that case, though the degree that the electric discharge is not uniform becomes worse, there gives rise to an effect that the manufacturing costs of the gas treatment unit 1 can be reduced. Any structural member for structurally reinforcing the gas processing unit 1 may be adopted so long as it can provide a prescribed strength.

Embodiment 17

This Embodiment 17 is the case where Embodiment 14 is changed such that the treated gas is used for cooling the heat pipe.

Figure 33:
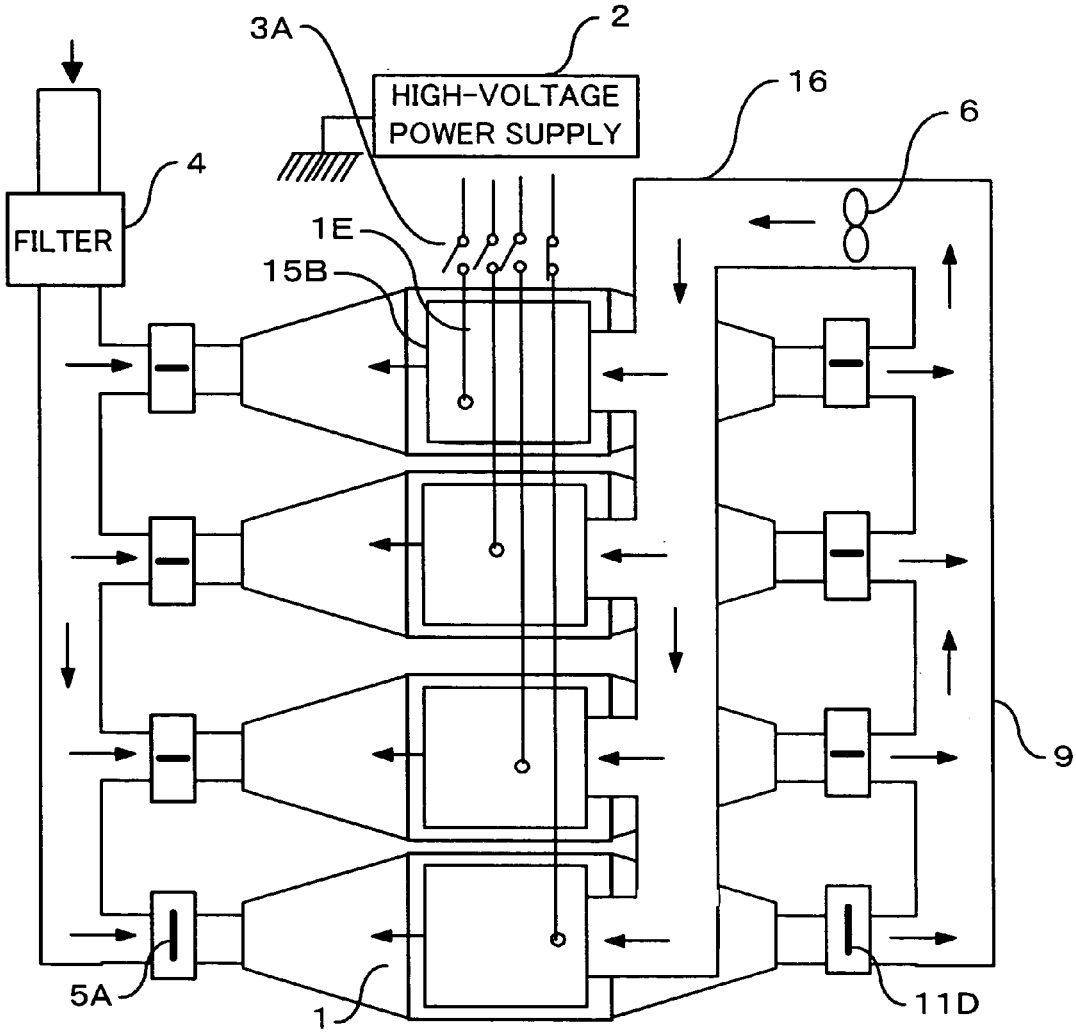
FIG. 33 is a plan view to explain the structure of a VOC treatment apparatus in Embodiment 17 of this invention.
Figure 34:
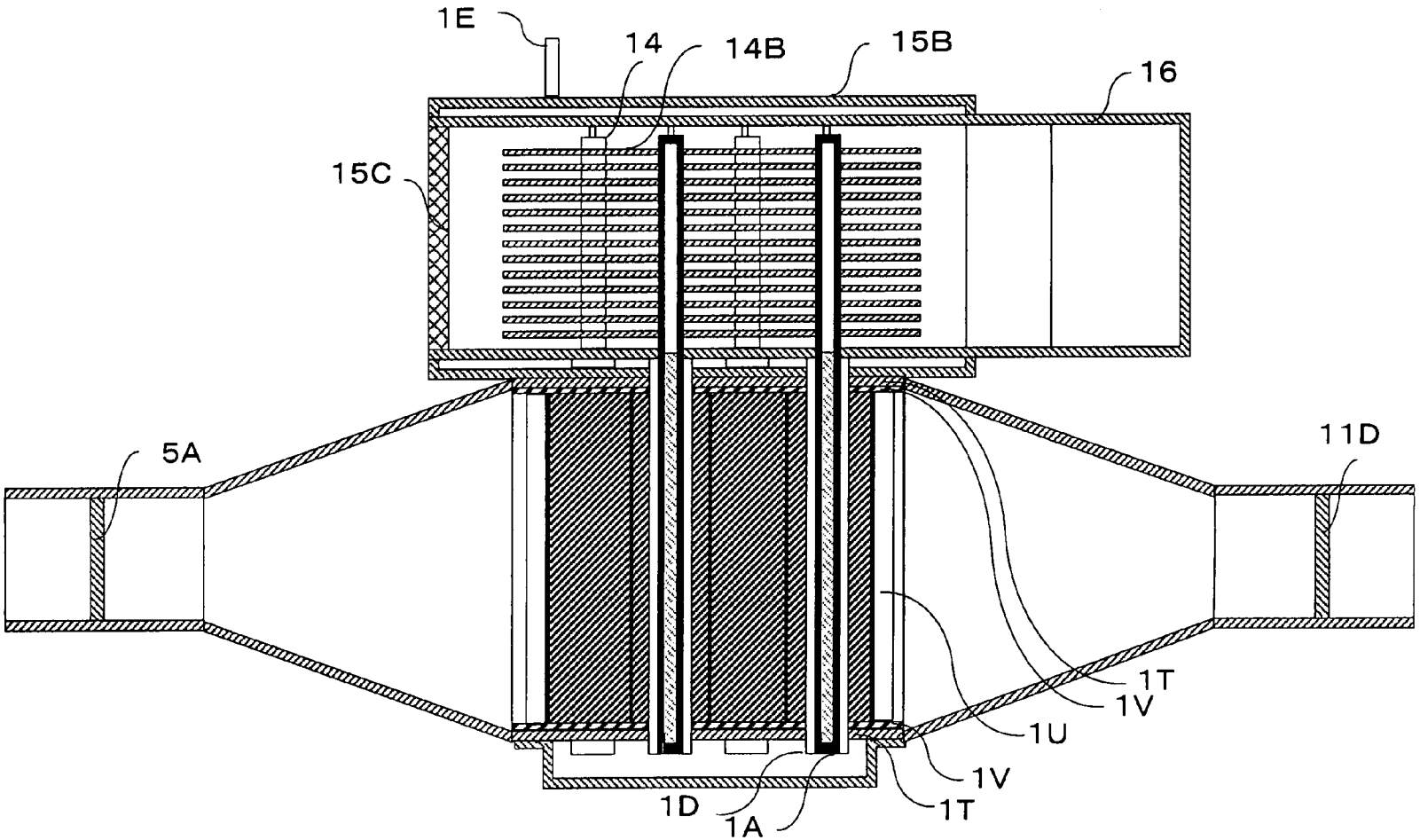
FIG. 34 is a longitudinal cross sectional view to explain the structure of a gas treatment unit of a VOC treatment apparatus in Embodiment 17 of this invention.

FIG. 33 is a plan view to explain the structure of the VOC treatment apparatus in this Embodiment 17. FIG. 34 is a longitudinal cross sectional view to explain the structure of the VOC treatment apparatus in this Embodiment 17. Only points different from FIG. 24 concerning the case of Embodiment 14 will be described. For the purpose of using the treated gas for cooling a heat pipe 14, a cooling air feed pipe 16 is provided between a blast guide 15B and an exhaust conduit 9 in the upper portion of each gas treatment unit 1. Since air passes through the cooling air feed pipe 16 and is sent to the heat pipe 14 by an exhaust fan 6, a cooling fan 15A is not provided.

Other structure is the same as in Embodiment 14.

This Embodiment 17 acts in the same manner as in Embodiment 14, thereby giving rise to the same effect. The gas as treated in the VOC treatment apparatus is clean, and in the case of treating an indoor gas, the treated gas of around room temperature is discharged. In this embodiment, since the treated gas is used for cooling the heat pipe, in the VOC treatment apparatus as placed outdoor, especially in the summer season or the like, the heat pipe can be cooled by air-conditioned indoor air, and therefore, there gives rise to an effect that the cooling efficiency becomes good.

In the winder season or the like, since the temperature of the air outside becomes lower than room temperature. Therefore, in the case where the temperature of the air outside is lower than room temperature, a structure capable of cooling the heat pipe by the air outside may be provided.

Embodiment 18

Figure 35A:
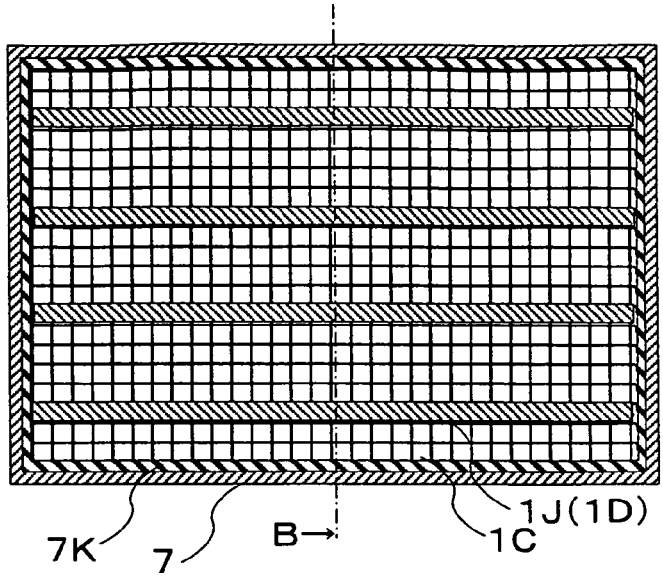
FIG. 35A is a lateral cross sectional view to explain the structure of a VOC treatment apparatus in Embodiment 18 of this invention.
Figure 35B:
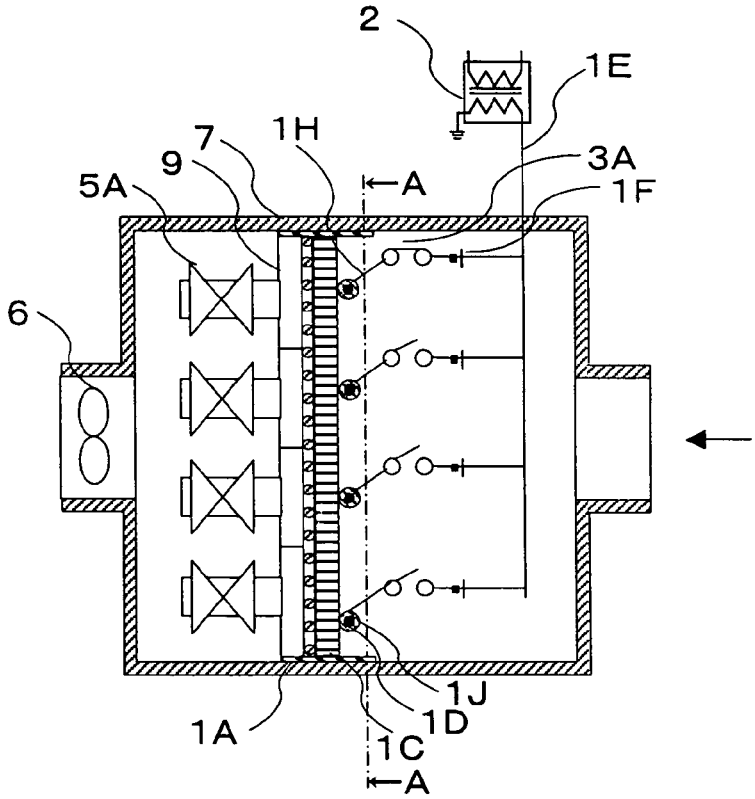
FIG. 35B is a longitudinal cross sectional view to explain the structure of a VOC treatment apparatus in Embodiment 18 of this invention.

This Embodiment 18 is the case where Embodiment 13 is changed such that the earthed electrode 1A and the adsorber 1C are used for a double purpose by the plural gas treatment units 1. FIG. 35A and FIG. 35B are views to explain the structure of the VOC treatment apparatus in this Embodiment 18. FIG. 35A is a lateral cross sectional view, and FIG. 35B is a longitudinal cross sectional view, respectively. Incidentally, the AA cross section in FIG. 35B is corresponding to FIG. 35A, and the BB cross section in FIG. 35A is corresponding to FIG. 35B, respectively.

Only points different from Embodiment 13 will be described. In this Embodiment 18, plural gas treatment units are housed in one container 7, and a feed conduit 8 is not required. The earthed electrode 1A and the adsorber 1C are used for a double purpose by all of the gas treatment units 1.

In this Embodiment 18, VOC can also be treated with good efficiency at a small power supply capacity, and the generation of NOx can be reduced. Since the earthed electrode 1A and the adsorber 1C are used for a double purpose by the gas treatment units 1, miniaturization of the apparatus and realization of low costs become possible. Incidentally, only one of the earthed electrode 1A or the adsorber 1C may be used for a double purpose, or other member may be used for a double purpose. What a member is used for a double purpose can be applied to other embodiments, and when applied, the same effect is brought.

Embodiment 19

Figure 36A:
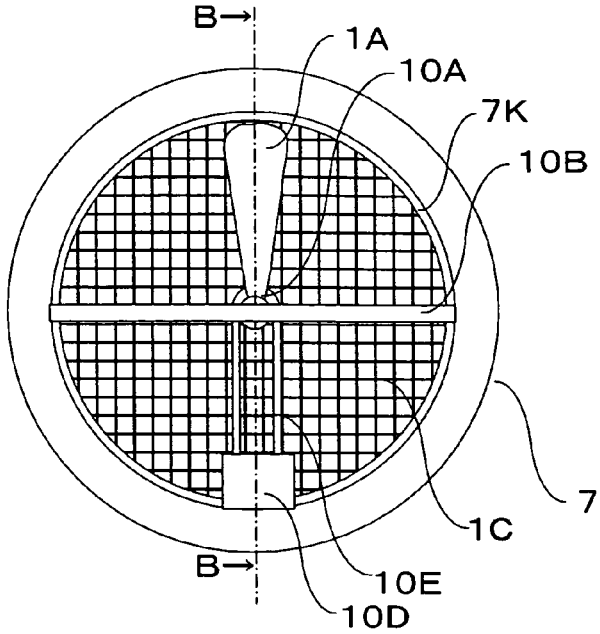
FIG. 36A is a lateral cross sectional view to explain the structure of a VOC treatment apparatus in Embodiment 19 of this invention.
Figure 36B:
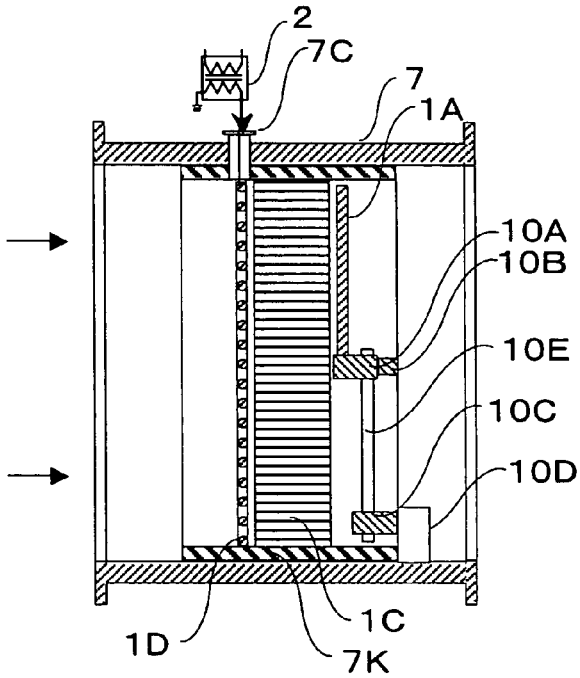
FIG. 36B is a longitudinal cross sectional view to explain the structure of a VOC treatment apparatus in Embodiment 19 of this invention.

This Embodiment 19 is the case where the earthed electrode is rotated. FIG. 36A and FIG. 36B are views to explain the structure of the VOC treatment apparatus in this Embodiment 19. FIG. 36A is a lateral cross sectional view, and FIG. 36B is a longitudinal cross sectional view, respectively. The AA cross section in FIG. 36B is corresponding to FIG. 36A, and the BB cross section in FIG. 36A is corresponding to FIG. 36B, respectively.

In a cylindrical container 7, a high-voltage electrode 1D in the circular mesh form and a sector rotatable earthed electrode 1A are disposed while interposing an adsorber 1C in the circular honeycomb form therebetween. An insulator 7K is added at prescribed intervals on the inner surface of the container 7, thereby preventing the generation of unnecessary electric discharge from occurring. The insulator 7K is added in portions where the high-voltage electrode 1D, the adsorber 1C and the earthed electrode 1A are provided and portions having prescribed room on the both sides thereof. The earthed electrode 1A and the high-voltage electrode 1D are made of a metal having high conductivity, such as molybdenum, tungsten, and stainless steel, or a material prepared by coating a metal having a catalytic action of oxidative destruction, such as platinum, gold, titanium dioxide, and manganese dioxide, on the surface of such a metal.

The cross section of the adsorber 1C and the high-voltage electrode 1D is designed such that it is spread fully in the inside of the container 7. The radius of the earthed electrode 1A is made slightly smaller than the radium of the adsorber 1C such that the earthed electrode 1A is rotatable in the container 7. An angle $\alpha$ of the sector of the earthed electrode 1A is regulated such that a value (may be not an integer) obtained by dividing 360 degrees by $\alpha$ becomes a prescribed size corresponding to the number of group of the gas treatment unit 1 in Embodiment 1 or the like. Incidentally, the sector of the earthed electrode 1A may be divided into plural sections. In the case of dividing the sector into plural sections, the angle of the sector is determined while taking into consideration the same point.

The gas to be treated flows from the left side to the right side in the drawing, the high-voltage electrode 1D is provided in the inlet side, and the earthed electrode 1A is provided in the exhaust side. A rotating mechanism 10 for rotating the earthed electrode 1A is provided in the exhaust side of the earthed electrode 1A. The rotating mechanism 10 is constructed of a rotating axis 10A, a fixing frame 10B for fixing the rotating axis 10A to the container 7, a driving axis 10C provided just beneath the rotating axis 10A and in parallel to the rotating axis 10A, a motor 10D fixed to the container 7 for rotating and driving the driving axis 10C, and a belt 10E for conducting the rotation of the driving axis 10C to the rotating axis 10A.

The rotating mechanism 10 is an electric discharge control mechanism and a flow regulating mechanism.

A gap between the earthed electrode 1A and the high-voltage electrode 1D is defined as a proper gap such that the electric discharge can be generated at a high voltage to be applied. A gap between the earthed electrode 1A and the adsorber 1C is made short such that the gas flow passing through the adsorber 1C in a proportion where the earthed electrode 1A is present in the downstream side is smaller than those of other portions. Specifically, this gap is not more than 5 mm, and desirably not more than 1 mm. Incidentally, the adsorber 1C in a proportion where the earthed electrode 1A is present in the downstream side is a portion that is brought into contact with the electric discharge.

Next, the action will be described. A direct current positive high voltage is passed through the high-voltage electrode 1D during the actuation of the VOC treatment apparatus. The earthed electrode 1A is moved by an angle $\alpha$ at every prescribed time of about several minutes. In this way, electric discharge is generated between the earthed electrode 1A and a portion of the opposite high-voltage electrode 1D. In the adsorber 1C in the portion that is brought into contact with the electric discharge, VOC is desorbed, and the desorbed VOC is decomposed into water and carbon dioxide. The adsorber 1C that is not brought into contact with the electric discharge adsorbs VOC. This means that a part of the adsorber 1C successively becomes in the contact state with the electric discharge. Incidentally, the time interval for moving the earthed electrode 1A is a time sufficient for decomposing and desorbing VOC with the adsorber 1C in the portion which is brought into contact with the electric discharge and is determined such that the adsorber 1C in which the time interval until it comes into contact with the electric discharge is longer than the breakdown time is not generated.

In this Embodiment 19, VOC can also be treated with good efficiency at a small power supply capacity, and the generation of NOx can be reduced. Further, this embodiment is characterized in that a conduit, a pipe and the like for passing the gas are not required.

A gap between the earthed electrode 1A and the adsorber 1C is short, the gas flow is small in the portion of the adsorber 1C where the electric discharge is generated, and the generation of NOx can be reduced. Further, the number required for each of the high-voltage electrode 1D, the adsorber 1C and the container 7 is only one, and a cooling device with water, a valve for gas flow regulation, and the like are not required. Accordingly, there gives rise to an advantage that the manufacture can be carried out at low costs.

While the rotation of the earthed electrode 1A has been made intermittently at the same angle as the angle $\alpha$ of the sector of the earthed electrode 1A at one time, the rotation may be achieved continuously. In the case of the intermittent rotation, the rotation angle $\beta$ at one time may be not equal to $\alpha$. The movement interval may be made short while making the rotation angle smaller than $\alpha$, or the earthed electrode 1A may be moved at a prescribed interval at an angle large than $\alpha$. When the movement is achieved at an angle larger than $\alpha$, the portion of the adsorber far from the portion which has been desorbed at the last time is desorbed, and therefore, desorption can be achieved more efficiently.

The earthed electrode 1A is rotated such that the portion of the adsorber can be desorbed in sequence; and that the matter that the portion of the adsorber which cannot be desorbed is generated, or the matter that even when a non-desorbed portion is present, the desorbed portion is further desorbed be not generated. Here, the matter that the portion of the adsorber which cannot be desorbed is generated is, for example, the case of $\alpha$=30° and $\beta$=120°. In this case, only the adsorber in the three portions of from 0° to 30°, from 120° to 150° and from 240° to 270° are desorbed, and the adsorber in other portions cannot be desorbed. The matter that even when a non-desorbed portion is present, the desorbed portion is further desorbed is, for example, the case of $\alpha$=30° and $\beta$=125°. In this case, nevertheless the ranges of from 0° to 30°, from 125° to 155°, from 250° to 280° and from 15° to 45° are desorbed, and the range of an angle of 240° is not desorbed, the range of from 15° to 30° is desorbed at the second time. In the case where plural earthed electrodes 1A are present, the earthed electrodes 1A are rotated while paying the same attention.

It may be tolerated that even though the efficiency is lowered, the portion of the adsorber that cannot be desorbed is generated, or that even though the portion that has not been desorbed is present, additional desorption of the desorbed portion is generated.

The shape of the electrode is not limited to a sector but a rectangle or a combination of a sector and a rectangle. In the case of a combination of a sector and a rectangle, it is desired that a portion having a larger radius is shaped as a sector, whereas a portion having a smaller radius is shaped as a rectangle. Further, with respect to the shape of the electrode, any shape can be employed so far as the electrode covers a part of the adsorber 1C, and when electrode makes one rotation, it can cover the major part of the adsorber.

While a positive high voltage has been applied to the high-voltage electrode 1D, a negative direct current high voltage may be applied. An alternating current voltage may be applied while placing a dielectric on an electric discharge surface of at least one of the earthed electrode 1A and the high-voltage electrode 1D. When the alternating current voltage is applied, a stable electric discharge is likely obtained at a higher electric power. In the case of using a dielectric, it is effective that the earthed electrode 1A in FIG. 36 is of a structure in which a metallic electrode is disposed in a glass tube, that is, the structure of the high-voltage electrode 1D in Embodiment 1. Alternatively, the high-voltage electrode 1D in FIG. 36 may be of a structure in which plural glass tubes having a metallic electrode therein are disposed. Incidentally, the glass is an example of the dielectric, and other dielectrics may be employed. A dielectric may be coated on a metallic electrode.

The rotating small electrode may be the high-voltage electrode 1D but not the earthed electrode 1A. When the high-voltage electrode 1D is smaller than the earthed electrode 1A, a more practically useful apparatus having improved stability of electric discharge is obtainable. However, in the case where the electrode to which a high voltage has been applied is moved, an attention may preferably be paid to insulation or the like, resulting in complication of the structure. Whether the electrode to be rotated be the earthed electrode 1A or the high-voltage electrode 1D may be determined depending upon the application.

In this Embodiment 19, while a cooling device has been omitted, a device for cooling the electrodes may be provided while comprehensively judging the costs and performance. Incidentally, cooling of the electrodes is effective in achieving the electric discharge stably at a high electric power.

In the case of an adsorber in the honeycomb form, the gas passes linearly through the gas passage in the adsorber. Accordingly, it is possible to largely lower the gas flow rate while only generating a slight pressure loss in an inlet or an outlet of the gas passage. Namely, in the case of the honeycomb form, when the interval between the earthed electrode 1A and the adsorber 1C is identical, an effect for lowering the gas flow rate, that is, an effect for reducing the generation amount of the NOx is large. Even in the case where the adsorber is not in the honeycomb form, when the interval is made sufficiently small, a required effect for reducing the generation amount of NOx is obtained. Incidentally, in the case where it is tolerated that the generation amount of NOx is not reduced, or another measure for reducing the generation amount of NOx is taken, the interval between the earthed electrode 1A and the adsorber 1C may be made large.

In this Embodiment 19, while the earthed electrode 1A has been rotated, it may be moved in parallel. While the high-voltage electrode 1D has been made in the mesh form and not moved, both the earthed electrode 1A and the high-voltage electrode 1D may be moved while making the high-voltage electrode 1D and the earthed electrode 1A have the same shape. The adsorber may be moved while fixing the electrodes. In the case of moving the adsorber, when the adsorber is rotated in the circular state, useless space disposition is small. The shape of the electrodes and the adsorber and the movement method are not limited so far as electric discharge is generated between a pair of the electrode so as to come into contact with a part of the adsorber and at least one of the electrodes or the adsorber is moved, whereby the major part of the adsorber comes into contact with the electric discharge.

The above can be applied to other embodiments having the same construction.

Embodiment 20

Figure 37A:
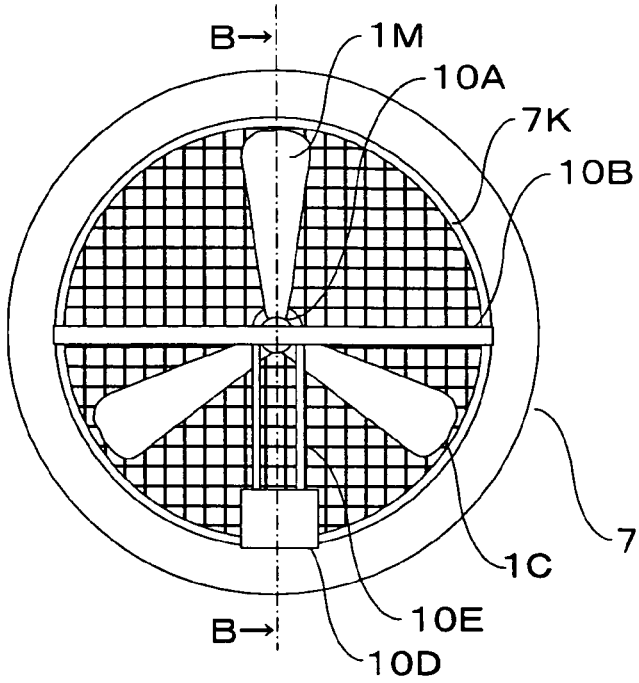
FIG. 37A is a lateral cross sectional view to explain the structure of a VOC treatment apparatus in Embodiment 20 of this invention.
Figure 37B:
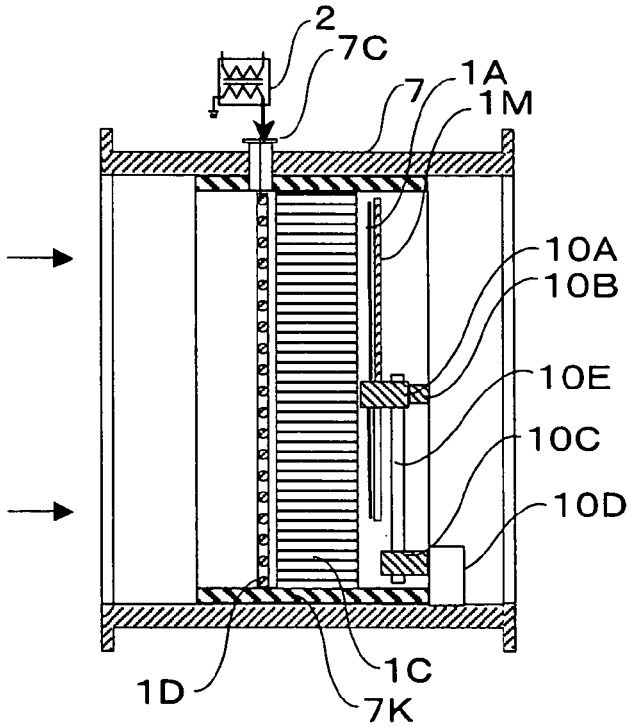
FIG. 37B is a longitudinal cross sectional view to explain the structure of a VOC treatment apparatus in Embodiment 20 of this invention.

This Embodiment 20 is another case where the earthed electrode is rotated. FIG. 37A and FIG. 37B are views to explain the structure of the VOC treatment apparatus in this Embodiment 20. FIG. 37A is a lateral cross sectional view, and FIG. 37B is a longitudinal cross sectional view, respectively. The AA cross section in FIG. 37B is corresponding to FIG. 37A, and the BB cross section in FIG. 37A is corresponding to FIG. 37B, respectively.

In comparison with FIG. 36 concerning the case of Embodiment 19, only points that are different will be described. The earthed electrode 1A is linear, and a baffle 1M is provided in the downstream side of the gas flow of the earthed electrode 1A. The width of the baffle 1M is a length sufficient for hiding the gas passage in the honeycomb within the range where it is brought into contact with electric discharge. A group of the earthed electrode 1A and the baffle 1M is provided in the number of three at angle intervals of 120° each other. Other structure is the same as in Embodiment 19.

In this Embodiment 20, VOC can also be treated with good efficiency at a small power supply capacity, and the generation of NOx can be reduced. Further, since the earthed electrode 1A is linear, electric field intensity in the vicinity of the electrode is increased, whereby electric discharge is likely generated.

The width of the baffle 1M is controlled such that the baffle 1M covers a portion of the adsorber which is brought into contact with electric discharge but does not cover a portion of the adsorber which is not brought into contact with electric discharge. When the gas flow is stopped in the state that the baffle 1M covers even a portion of the adsorber that is not brought into contact with electric discharge, the adsorber in the subject portion neither adsorbs nor desorbs VOC, thereby lowering the efficiency of the VOC treatment apparatus. In the adsorber in the honeycomb form, since the cross sectional area of one gas passage is small, if the one gas passage can be entirely covered, it is possible to make the gas not flow into that gas passage even when the outside of the gas passage is not covered. For that reason, in the case of the honeycomb form, the adsorber that neither adsorbs nor desorbs VOC becomes the necessary minimum. Accordingly, it is possible to reduce the generation of NOx without causing a lowering of the efficiency of the VOC treatment apparatus. In the case where the adsorber is not in the honeycomb form, a measure for making the baffle 1M larger or for making an interval between the baffle 1M and the adsorber short is taken. Incidentally, the baffle 1M may not be in the plate-like form. In any case, the baffle 1M is controlled so as to have a shape and a size necessary and sufficient for lowering the gas flow into the adsorber which is brought into contact with the electric discharge. Incidentally, in the case where it is tolerated that the generation amount of NOx is not reduced, or another measure for reducing the generation amount of NOx is taken, the baffle 1M may not be provided.

When the earthed electrode 1A is merely made linear, since the proportion of the portion of the adsorber that is brought into contact with the electric charge is reduced, the plural number of the earthed electrode 1A has been provided. The shape, the size and the number of the electrode to be moved or the baffle 1M is comprehensively determined while considering the degree of the whole of the adsorber which is brought into contact with the electric discharge, or the range of the gas flow rate to be reduced and its degree.

Embodiment 21

Figure 38:
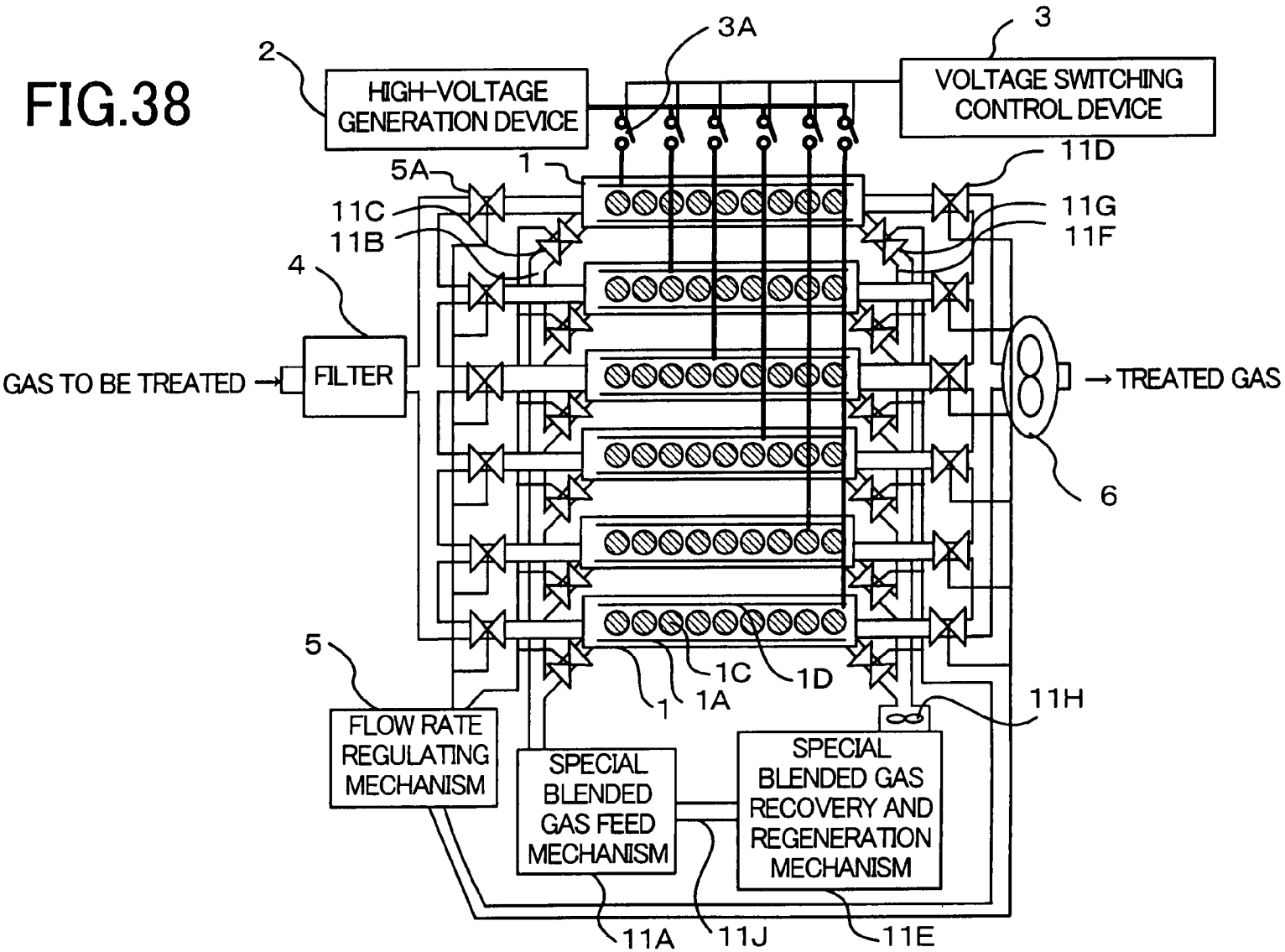
FIG. 38 is a system block diagram of a VOC treatment apparatus in Embodiment 21 of this invention.

This Embodiment 21 is the case where a special blended gas in which the oxygen concentration is increased and an inert gas is blended in place of nitrogen is fed into the gas treatment unit 1 to be electrically discharged. FIG. 38 is a system block diagram of the VOC treatment apparatus in this Embodiment 21.

In the VOC treatment apparatus in this Embodiment 21, the following for treating the special blended gas are added to Embodiment 1. (1) A special blended gas feed mechanism 11A that is a gas feed mechanism for feeding the special blended gas. (2) A conduit 11B between the special blended gas feed mechanism 11A and the gas treatment unit 1. (3) A valve 11C for regulating the flow rate of the special blended gas which flows into the conduit 11B. (4) A valve 11D for regulating whether or not an exhaust of the gas treatment unit 1 flows into the exhaust fan 6. (5) A special blended gas recovery and regeneration mechanism 11E for recovering the special blended gas from the gas treatment unit and regenerating it. (6) A conduit 11F for connecting the gas treatment unit 1 to the special blended gas recovery and regeneration mechanism 11E. (7) A valve 11G for regulating the flow rate of the conduit 11F. (8) An exhaust fan 11H before the exhaust port within the conduit 11F. (9) A conduit 11J for connecting the special blended gas recovery and regeneration mechanism 11E to the special blended gas feed mechanism 11A.

The special blended gas is a blended gas prepared by blending an inert gas and oxygen in a prescribed proportion while suppressing the nitrogen content as far as possible. The composition of the special blended gas is determined by comprehensively judging a performance enhancing effect and costs.

The special blended gas feed mechanism 11A is a mechanism for feeding the special blended gas comprising oxygen and an inert gas blended in a prescribed proportion. The special blended gas recovery and regeneration mechanism 11E is a mechanism for removing other components than oxygen and the inert gas from the recovered special blended gas and enabling one to use again the resulting gas as the special blended gas. The regenerated special blended gas is fed into the gas treatment unit 1 after adding oxygen or the inert gas so as to obtain a prescribed blend by the special blended gas feed mechanism 11A.

One gas treatment unit 1 is provided with a sealable cell; the valve 5A and the valve 11C are provided in the suction side; and the valve 11D and the valve 11G are provided in the exhaust side. The gas treatment unit 1 takes the following four kinds of action states depending upon the opening and closing state of these valves and the presence or absence of application of a high voltage. The action state A is a state in which the adsorber adsorbs VOC in the gas to be treated. The action state B is a state in which the adsorber having VOC adsorbed thereon is desorbed to decompose VOC. On the other hand, the action state C and the action state D are each a transitional state in the way of the state transfer. The action state C is taken in the way of transfer from the action state A to the action state B, and the action state D is taken in the way of return from the action state B to the action state A.

Figure 39:
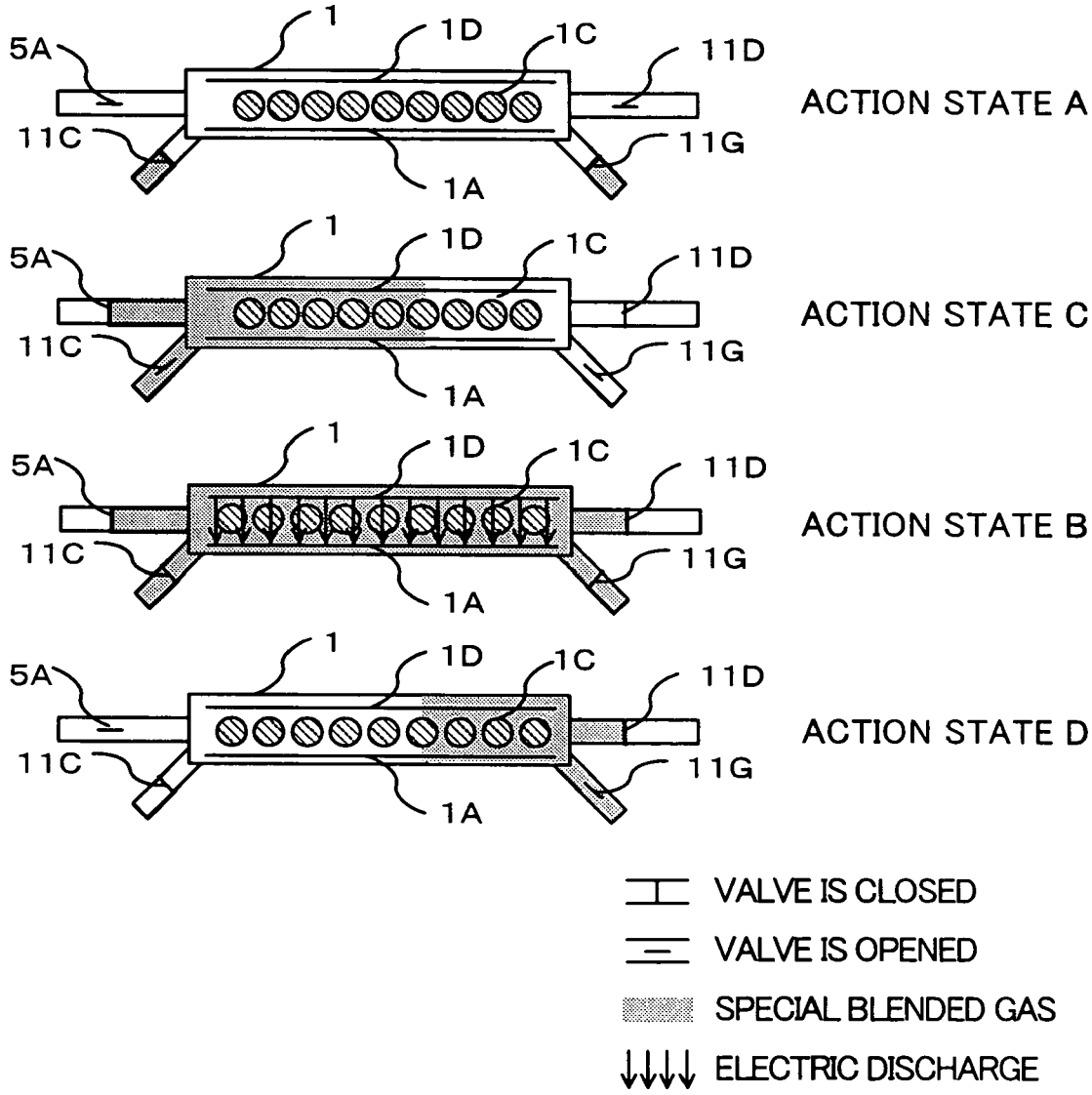
FIG. 39 is a view to explain the action states that a VOC treatment apparatus in Embodiment 21 of this invention takes.

FIG. 39 is a view to explain each of the action states. Incidentally, the special blended gas is expressed in the tint stain form. As shown in FIG. 39A, the action state A is a state in which the valve 5A and the valve 11D are opened, the valve 11C and the valve 11G are closed, and the gas to be treated flows into the gas treatment unit 1. A high voltage is not applied to the high-voltage electrode 1D, and electric discharge is not generated. As shown in FIG. 39B, the action state C is a state as changed from the action state A such that the valve 5A is closed while the valve 11C is opened and that the valve 11D is closed while the valve 11G is opened. Though in the action state A, the gas to be treated has been filled in the gas treatment unit 1, the action state C is a state in the way of exchanging the gas to be treated by the special blended gas. When the gas treatment unit 1 has been filled with the special blended gas, the valve 11C and the valve 11G are closed, and a high voltage is applied to the high-voltage electrode 1D, thereby generating electric discharge. In this way, the action state B as shown in FIG. 39C is taken. In the action state B, either one of the valve 11C or the valve 11G may be opened. Further, both the valve 11C and the valve 11G may be opened in the action state B although such increases a consumption amount of the special blended gas.

When a high voltage is not applied to the high-voltage electrode 1D and the valve 5A and the valve 11G are opened, the action state changes from the action state B is changed into the action state D as shown in FIG. 39D. In the action state D, the special blended gas that has been filled in the gas treatment unit 1 in the action state B is exchanged by the gas to be treated. When the special blended gas has become absent in the gas treatment unit 1, the valve 11G is closed, and the valve 11D is opened, whereby the action state is retuned to the action state A. These valves are controlled by the flow rate regulating mechanism 5. Incidentally, the valves regarding the special blended gas may be controlled from other mechanisms such as the special blended gas feed mechanism 11A and the special blended gas recovery and regeneration mechanism 11E.

Figure 40:
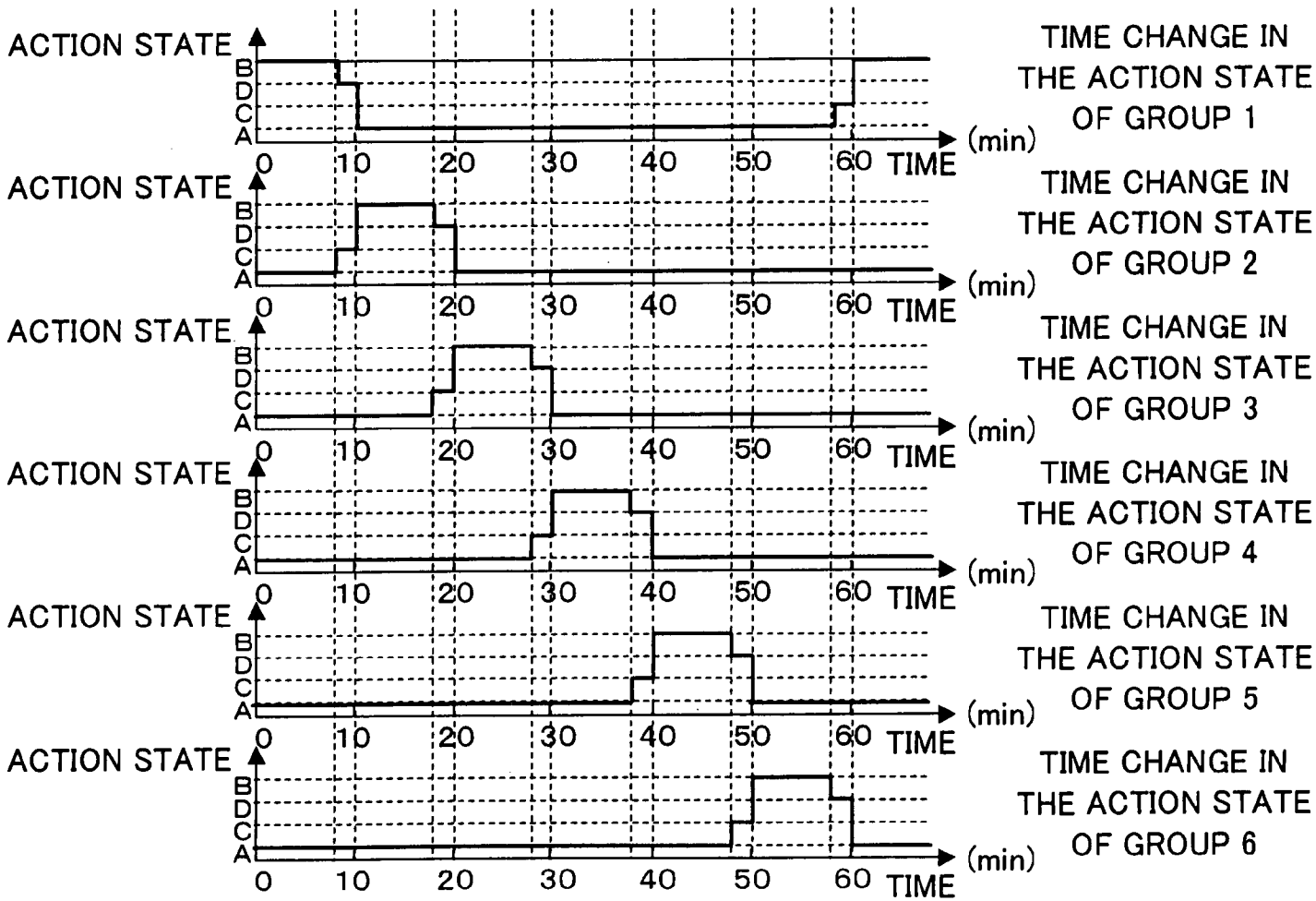
FIG. 40 is a view to explain the sequence of the action states that groups of gas treatment unit take in a control system of a VOC treatment apparatus in Embodiment 21 of this invention.

FIG. 40 is a view to explain the sequence of the action states that groups of the gas treatment unit 1 take in the VOC treatment apparatus. Incidentally, in FIG. 40, the action state A, the action state C, the action state D, the action state B, and the action state B are arranged in order from the lower portion. There are included action states of from a phase 1A to a phase 6B. The action state changes from a phase 1A, a phase 1B, a phase 2A, a phase 2B, a phase 3A,—a phase 6A, and a phase 6B in sequence and returns from the phase 6B to the phase 1A. This cycle is repeated. In the phase nB, the group n takes the action state B, with remainder being in the action state A. In the phase nA, the group (n-1) takes the action state D, and the group n takes the action state C, with the remainder group being in the action state A. Since the group (n-1) is made to take the action D and the group n is simultaneously made to take the action state C, it is possible to shorten the time necessary for making the group (n-1) take the action state A and making the group n take the action state B.

The group n may be made to take action state C after making the group (n-1) take the action state. Also, the group n may be made to take the action state C after making the group (n-1) take the action state D; and the group (n-1) may be made to take the action state D after making the group n take the action state C. Incidentally, in these cases, strictly speaking, the phase number increases. In the following description, while the phase is not particularly mentioned, it is to be noted that in the case of changing the sequence of the action state to be taken in every group, the phase number is changed adaptive with that phase.

In this Embodiment 21, VOC can also be treated with good efficiency at a small power supply capacity, and since the electric discharge is generated in the special blended gas not containing nitrogen, NOx is not substantially generated. Further, when the concentration of oxygen in the special blended gas is increased, the probability of the generation of active species such as an oxygen atom and ozone is increased, and the decomposition efficiency of VOC is enhanced. If the special blended gas has either one of a characteristic that the special blended gas contains oxygen and has an oxygen concentration higher than that in the air, or a characteristic that the special blended gas has a nitrogen concentration lower than that in the air, there gives rises to either one of an effect for enhancing the decomposition efficiency of VOC or an effect for reducing the generation of NOx. While the inert gas has been blended in place of nitrogen, any gas may be used so far as the gas is not an inter gas but does not react with oxygen, or it reacts with oxygen but does not generate a harmful substance.

This Embodiment 21 is an embodiment that is based on Embodiment 1 and in which the special blended gas is used. However, this Embodiment 21 may be based on other embodiments.

In this Embodiment 21, the valves are opened and closed such that the special blended gas does not leak out as far as possible. In the case where it is important that the gas to be treated is not mixed into the recovered special blended gas, during change of from the action state A to the action state C, the opening and closing operation of the valve 11D and the valve 11G is not carried out, and during change of from the action state C to the action state B, only the valve 11D is closed. Then, the timing of return from the action state D to the action state A is made fast, whereby the action state is returned to the action state A before the special blended gas in the gas treatment unit 1 is completely discharged. Incidentally, the order of the valve operation may be changed. Although the plural valves have been operated simultaneously, only one valve may be operated at a time. Also, the timing of the start and end of the electric discharge may be changed. Incidentally, by changing the control of each of the valves and the timing of the start and end of the electric discharge, the transitional action state between the action state A and the action state B changes so that it takes other action state than the action state C and the action state D. However, in the case of taking the action states such that the electric discharge is generated in the plural groups, a measure should be taken such that the electric power to be consumed by the electric discharge does not exceed the power supply capacity. In the case where a measure that the electric power to be consumed by the electric discharge does not exceed the power supply capacity cannot be achieved, the electric discharge is not generated simultaneously in the plural groups.

Though the time in the action state C is identical with the time in the action state D, these times may be separately fixed. In the case where the times are separately fixed, the timing of the start of the action state C may be made identical to that of the action state D. The time of the end may be made identical to each other. Further, the timing of the start and end of the action state C may be separately fixed from the timing of the start and end of the action state D.

In this Embodiment 21, the recovered special blended gas is regenerated and reused as the special blended gas. However, the special blended gas may be only recovered but not reused. Also, the special blended gas may not be recovered.

Whether or not the special blended gas is recovered or regenerated is determined while judging a degree of enhancement of the performance by use of the special blended gas, the costs of the special blended gas, the costs of devices necessary for recovery and regeneration, and demerits in the case of not recovering it in addition to the composition of the special blended gas.

Embodiment 22

Figure 41:
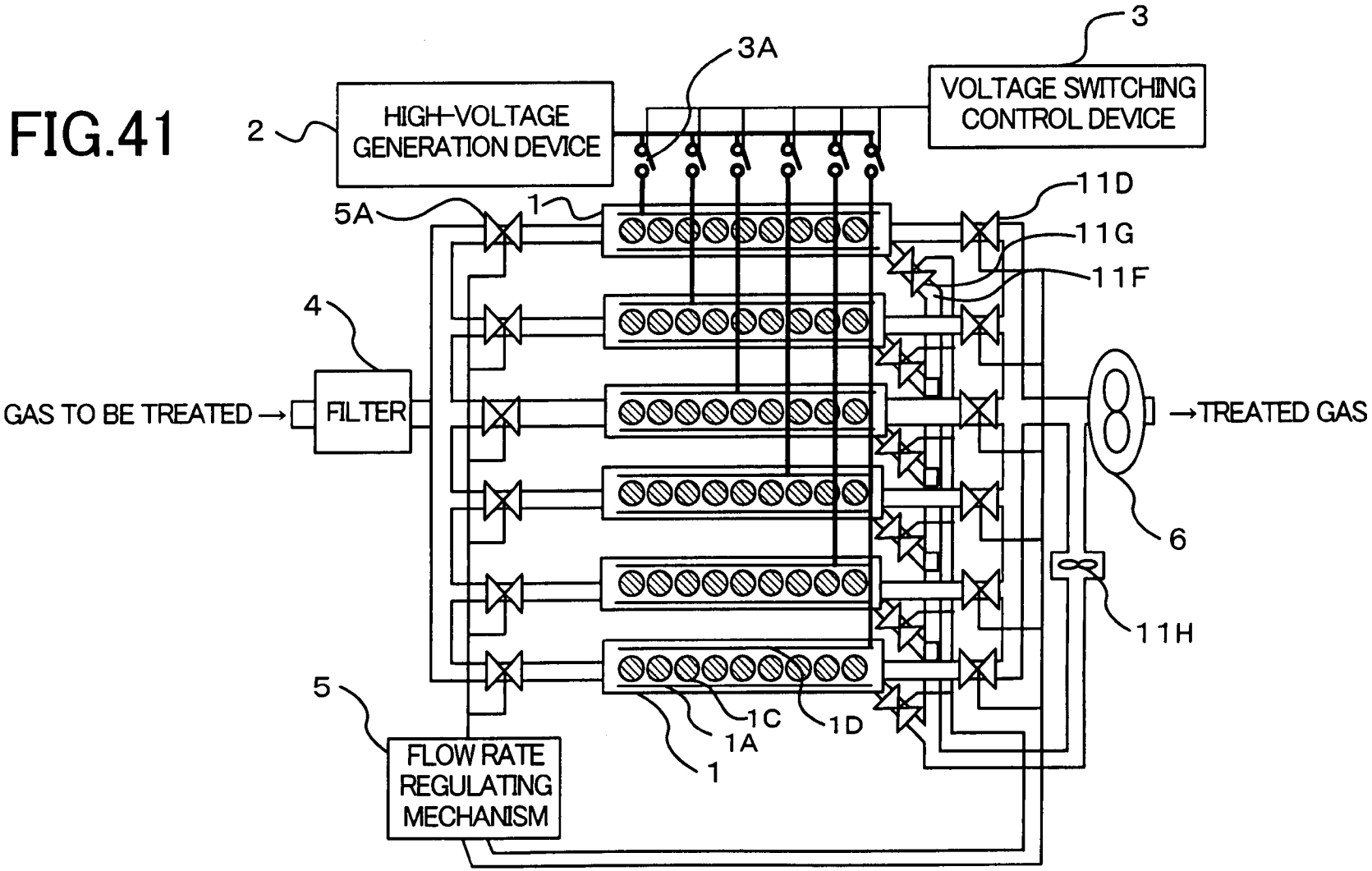
FIG. 41 is a system block diagram of a VOC treatment apparatus in Embodiment 22 of this invention.

In this Embodiment 22, the flow of the gas to be treated is stopped, VOC is desorbed by electric discharge, and the gas remaining in the gas treatment unit 1 (hereinafter referred to as "gas after desorption") is then returned to the suction side by the treated gas. FIG. 41 is a system block diagram of the VOC treatment apparatus in this Embodiment 22.

In the VOC treatment apparatus in this Embodiment 22, as a gas return mechanism for returning the gas after desorption to the suction side, the following are added to Embodiment 1. (1) An exhaust fan 11H for passing the treated gas into the gas treatment unit 1 and returning it to a feed conduit 8. (2) A conduit 11F for connecting the gas treatment unit 1 to the exhaust fan 11H. (3) A valve 11G for regulating the flow rate of the conduit 11F. (4) A valve 11D for regulating whether or not an exhaust of the gas treatment unit 1 flows towards the exhaust fan 6.

One gas treatment unit 1 is provided with a sealable cell; the valve 5A is provided in the suction side; and the valve 11D and the valve 11G are provided in the exhaust side. The gas treatment unit 1 takes the following three kinds of action states depending upon the opening and closing state of these valves and the presence or absence of application of a high voltage. The action state A is a state in which the adsorber adsorbs VOC in the gas to be treated. The action state B is a state in which the adsorber having VOC adsorbed thereon is desorbed to decompose VOC. The action state D is a state in which the gas after desorption is returned to the suction side by the treated gas. The action state D is a temporarily transitional state in the way of return from the action state B to the action state A.

Figure 42:
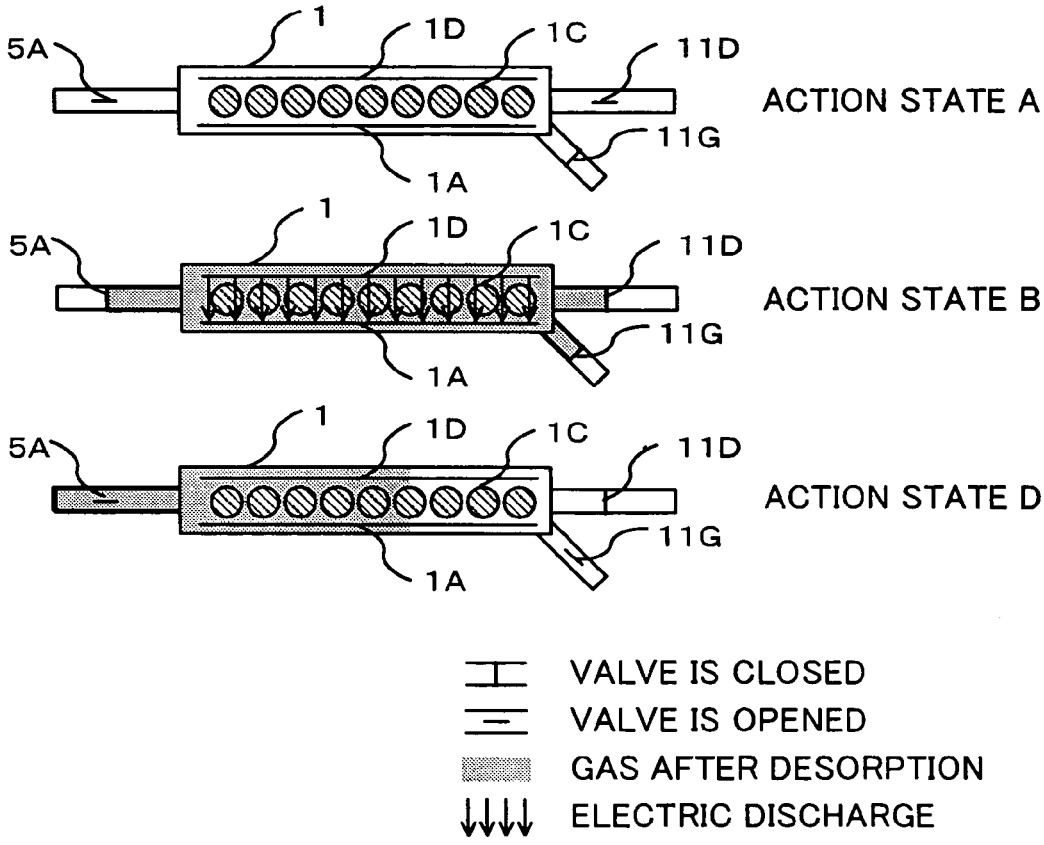
FIG. 42 is a view to explain the action states that a VOC treatment apparatus in Embodiment 22 of this invention takes.

FIG. 42 is a view to explain each of the action states. Incidentally, the gas after desorption is expressed in the tint stain form. As shown in FIG. 42A, the action state A is a state in which the valve 5A and the valve 11D are opened, the valve 11G is closed, and the gas to be treated flows into the gas treatment unit 1. A high voltage is not applied to the high-voltage electrode 1D, and electric discharge is not generated. As shown in FIG. 42B, the action state B is a state in which the valve 5A, the valve 11D and the valve 11G are closed, and a high voltage is applied to the high-voltage electrode 1D, thereby generating electric discharge. The valve 5A may be opened. When a high voltage is not applied to the high-voltage electrode 1D and the valve 5A and the valve 11G are opened, the action state is changed from the action state B to the action state D as shown in FIG. 42C. When the valve 11D is opened and the valve 11G is closed, the action state is returned from the action state D to the action state A. These valves are controlled by the flow rate regulating mechanism 5. Incidentally, the valves regarding the return of the gas after desorption to the suction side may be controlled from another mechanism as newly provided.

In the action state D, the gas after desorption containing by-products by the electric discharge as filled in the gas treatment unit 1 in the action state B is sent to the feed conduit 8 by the treated gas, and the by-products are adsorbed in the gas treatment unit taking other action state A. The flow direction of the gas in the action state D is an opposite direction to the flow direction of the gas to be treated in the action state A in which VOC is adsorbed. The period of taking the action state D is regulated at a prescribed period in which the gas after desorption can be entirely returned to the feed conduit 8. Incidentally, the destination to which the gas after desorption is returned is not always the feed conduit 8 but any place at which the gas after desorption is not discharged out in the suction side.

Figure 43:
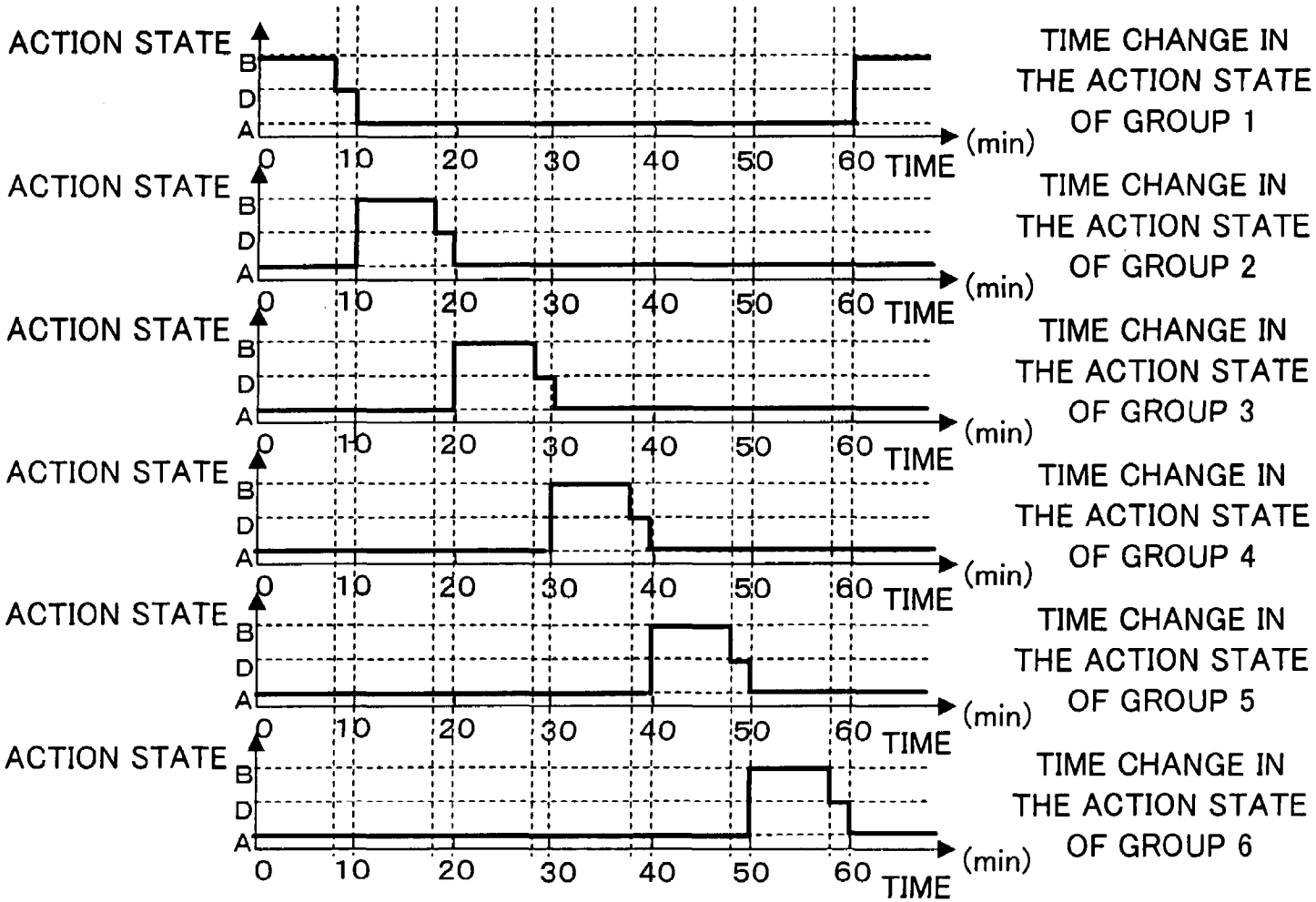
FIG. 43 is a view to explain the sequence of the action states that groups of gas treatment unit take in a control system of a VOC treatment apparatus in Embodiment 22 of this invention.

FIG. 43 is a view to explain the sequence of the action states that groups of the gas treatment unit 1 take in the VOC treatment apparatus. Incidentally, in FIG. 43, the action state A, the action state D, and the action state B are arranged in order from the lower portion. There are included action states of from a phase 1A to a phase 6B. The action state changes from a phase 1A, a phase 1B, a phase 2A, a phase 2B, a phase 3A,—a phase 6A, and a phase 6B in sequence and returns from the phase 6B to the phase 1A. This cycle is repeated. In the phase nB, the group n takes the action state B, with remainder being in the action state A. In the phase nA, the group (n-1) takes the action state D, with the remainder group being in the action state A. A pattern of the changes of the action states that the respective groups take as described previously is referred to as "pattern A".

Here, it is also possible that in the phase nA, the group (n-1) takes the action state D, and the group n takes the action state B, with the remainder group being in the action state A. A pattern of the changes of the action states that respective groups take as described previously is referred to as "pattern B". Incidentally, in the pattern B, one group is in the action state B, and the number of group taking the action state A in the phase nA is smaller by one than that in the case of the pattern A. If the number of group is sufficiently large, there is no problem even when the number of group taking the action state A is smaller by one than that in the case of the pattern A. Also, the matter that VOC in the by-products in the gas after desorption or in the gas to be treated cannot be adsorbed does not occur.

In this Embodiment 22, VOC can also be treated with good efficiency at a small power supply capacity, and the generation of NOx can be reduced. Further, since the gas after desorption containing by-products as formed by the electric discharge such as NOx is returned to the feed conduit, thereby adsorbing and removing the by-products by the adsorber 1C, the by-products to be discharged as the treated gas, such as NOx, are very slight.

This Embodiment 22 is an embodiment that is based on Embodiment 1 and in which the gas return mechanism for returning the treated gas ton the feed conduit is provided. However, this Embodiment 22 may be based on other embodiments.

Even when a VOC treatment apparatus is not the VOC treatment apparatus in which the gas treatment unit 1 is divided into plural groups and the desorption treatment of the adsorber is carried out in every group, there gives rise to an effect that the discharge amount of by-products such as NOx can be reduced so far as the gas return mechanism is provided. In the action state D of the VOC treatment apparatus which is not the VOC treatment apparatus in which the desorption treatment of the adsorber is carried out in every group, the air outside or the like is introduced into the gas treatment unit 1 having the gas after desorption filled therein via the valve 11D, thereby returning the desorbed gas to the suction side. Incidentally, when a VOC treatment apparatus in which the desorption treatment of the adsorber is carried out in every group is employed, there gives rise to advantages that the treated gas can be used for returning the gas after desorption to the suction side and that the gas as returned to the suction side can be immediately subjected to an adsorption treatment in other gas treatment unit.

It is also possible to prevent the discharge of by-products as formed by the electric discharge such as NOx by returning the gas to the suction side at the time of the generation of electric discharge. However, in the case where the flow rate of the gas to be made to flow in the reverse direction at the time of the generation of electric discharge is equal to or larger than the flow rate at the time of not generating electric discharge, there is no effect that the amount of NOx as generated by the electric discharge is reduced. Incidentally, in the case where the flow rate of the gas to be made to flow in the reverse direction at the time of the generation of electric discharge is smaller than the flow rate at the time of not generating electric discharge, when that degree is large, the reduction amount of NOx as generated by the electric discharge increases.

At the time of the generation of electric discharge, in the case of returning the gas to the suction side, since the amount of by-products remaining within the gas treatment unit 1 is small, the prescribed time for returning the gas to the suction side after the generation of electric discharge may be made short.

The above can be applied to other embodiments.

Embodiment 23

Figure 44:
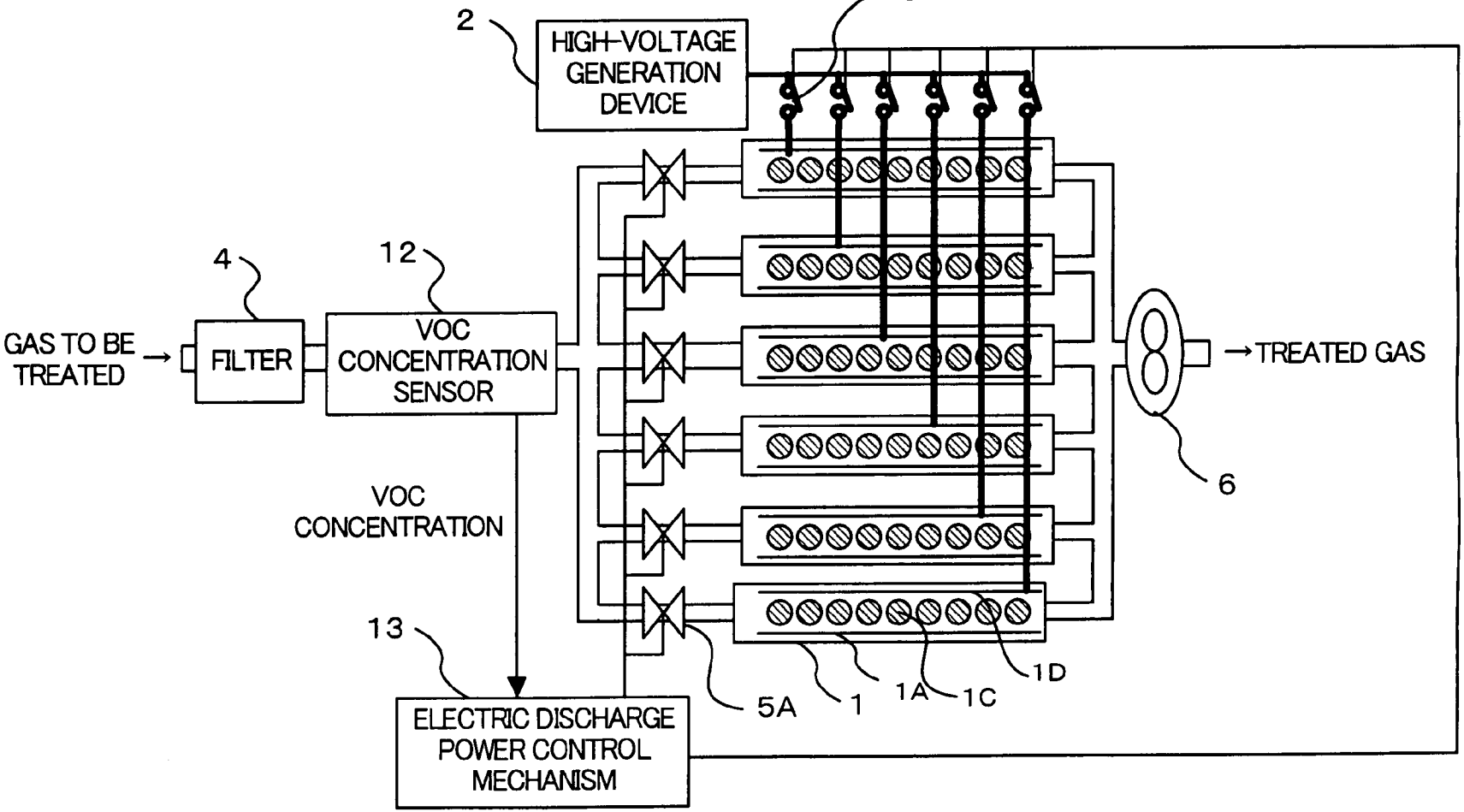
FIG. 44 is a view to explain the action states which a VOC treatment apparatus in Embodiment 23 of this invention takes.

The VOC treatment apparatus in this Embodiment 23 is a VOC treatment apparatus which is based on Embodiment 1 and in which the VOC concentration in the gas to be treated is measured, thereby regulating the power consumption of the electric discharge depending upon the VOC concentration. FIG. 44 is a system block diagram of the VOC treatment apparatus in this Embodiment 23. FIG. 44 is different from FIG. 1 concerning the case of Embodiment 1 in the following points. A VOC concentration sensor 12 for measuring the VOC concentration in the gas to be treated immediately after the filter 4 is added. An electric discharge power control mechanism 13 that is an electric discharge control mechanism is provided in place of the voltage switching control device 3 and the flow rate regulating mechanism 5. The electric discharge power control mechanism 13 calculates the amount of VOC which the adsorber 1C has adsorbed (hereinafter referred to as "VOC adsorption amount") from the VOC concentration as measured in the VOC concentration sensor 12 and regulates the voltage switching element 3A and the valve 5A depending upon the VOC adsorption amount at the time of start of electric discharge such that the power consumption of the electric discharge becomes the necessary minimum for decomposing VOC. Other construction is the same as in Embodiment 1.

Next, the actions will be described. In this Embodiment 23, in addition to the action state A and the action state B the same as in Embodiment 1, the gas treatment unit 1 takes the following action state E. The action state E is a state in which the valve 5A is closed and a high voltage is not applied to the high-voltage electrode 1D. The action state E is an action state to be taken during a period in which in the case where the VOC adsorption amount is small, after completion of desorption of the adsorber 1C in the action state B, the next group of the gas treatment unit 1 becomes in the action state B, and this group returns to the action state A.

The reason why the action state E is necessary will be described. That is, in the case where the VOC concentration is low, the time for decomposing VOC in the action state B becomes short. If the action state E is not taken, and the action state B is taken in the next group at the point of time of completion of the action state B in some group, the period of the action of the VOC treatment apparatus is changed depending upon the VOC concentration. In the case where the VOC concentration is low, the period of the treatment becomes short, and the adsorber is decomposed before sufficiently adsorbing VOC, whereby the decomposition efficiency of VOC is lowered. In the case where the VOC concentration is low, for the purpose of making the period of treatment to a prescribed length or longer so as to not lower the decomposition efficiency, the action state E is necessary.

Figure 45:
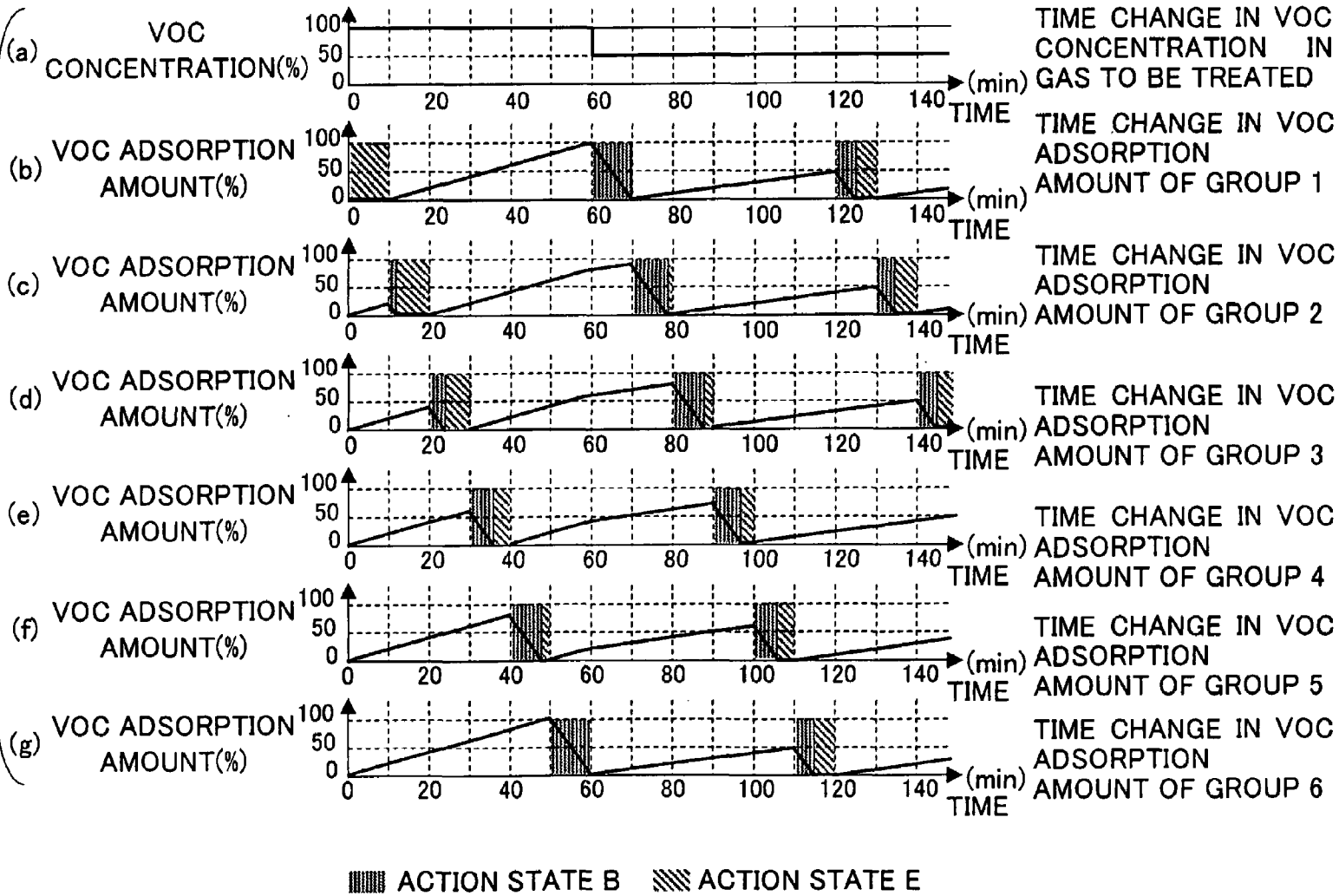
FIG. 45 is a view to explain the relationship between the VOC concentration in a gas to be treated and the adsorption amount of VOC of an adsorber in each group of a gas treatment unit in Embodiment 23 of this invention.

FIG. 45 is a view to explain the relationship between the VOC concentration in the gas to be treated and the adsorption amount of VOC of the adsorber 1C in each group of the gas treatment unit 1. FIG. 45A shows the VOC concentration in the gas to be treated; and from FIG. 45B to FIG. 45G each shows the VOC adsorption amount of the adsorber 1C in the gas treatment unit 1 in groups 1 to 6. The VOC concentration in the gas to be treated gas is expressed in terms of % against the assumed maximum concentration. The VOC adsorption amount of the adsorber 1C is expressed in terms of "%" against the amount of VOC as adsorbed in one period in the case where the gas to be treated having the assumed maximum concentration is continuous. Here, in a region in which the adsorber 1C does not cause breakdown, it is assumed that the adsorber 1C can adsorb all of VOC in the gas to be treated with which the adsorber 1C is brought into contact. This means that if the gas flow rate is constant in the time standpoint, the VOC adsorption amount of the adsorber 1C can be calculated by multiplying the time integral of the VOC concentration by the gas flow rate per unit time. The amount of VOC that can be decomposed is proportional to the power consumption. Incidentally, actually, the adsorption of VOC depends upon other conditions such as the VOC adsorption amount. The rate of decomposing VOC depends upon the VOC adsorption amount and other factors.

It is assumed that FIG. 45A shows the case where though the VOC concentration is about 100% of the assumed maximum amount at the first stage, it is changed to 50% in the way. It is assumed that the VOC treatment apparatus starts the action at the point of time when the time is zero and that the adsorber does not adsorb VOC in all of the gas treatment units 1 at the time of start of the action. According to the foregoing assumption, the amount of VOC which the adsorber adsorbs is one obtained by multiplying a time integral of the VOC concentration of the gas to be treated from the point of time when the adsorber after completion of the desorption is brought into contact with the gas to be treated by the gas flow rate per unit time. For that reason, the electric discharge power control mechanism 13 calculates the VOC adsorption amount at the time of start of the action state B in every group of the gas treatment unit 1. Further, the electric discharge power control mechanism 13 determines the continuous time of the action state B depending upon the VOC adsorption amount, thereby controlling the turn-on or turn-off of the voltage switching element 3A such that the continuous time of the action state B becomes the determined time. After completion of the action state B, the action state becomes the action state E.

The group of the gas treatment unit 1 is controlled such that the time taking the action state B or the action state E becomes a prescribed time T (10 minutes in FIG. 45). When the number of the group of the gas treatment unit 1 is defined as "N", a prescribed time T is a time when the adsorber adsorbs 100% VOC in the case where the gas to be treated having a VOC concentration of 100% continues for a time of T×(N-1), and is required to be a time necessary for decomposing VOC or longer.

In the group 1, since the VOC adsorption amount is zero at a time of 0, the group 1 does not take the action state B but becomes in the action state E. It is noted that when the VOC adsorption amount increases, the time for taking the action state B becomes long. Also, it is noted that after the VOC adsorption amount has become zero, the group 1 does not take the action state B but becomes in the action state E.

In this Embodiment 23, VOC can also be treated with good efficiency at a small power supply capacity, and the generation of NOx can be reduced. Further, it is possible to suppress the power consumption necessary for decomposing VOC at the necessary minimum. Incidentally, for the purpose of surely decomposing VOC, the time taking the action state B may be made slightly longer than the necessary minimum. In such case, there gives rise to an effect that after completion of the decomposition treatment of VOC, by avoiding the generation of a fruitless electric discharge, the power consumption can be reduced.

In this Embodiment 23, the time of electric discharge has been changed while making the applied voltage and the electric discharge current, in its turn, the power consumption constant, either one or both the applied voltage and the electric discharge current, its in tern, the power consumption may be changed while making the time of electric discharge constant depending upon the adsorption amount of VOC by controlling the high-voltage generation device 2. Further, not only either one or both the applied voltage and the electric discharge current but also the time of electric discharge may be changed. Any method may be employed so far as the power consumption for desorbing and decomposing VOC can be reduced. Incidentally, it is preferable that the power consumption is close to the necessary minimum as far as possible within the range where VOC can be surely decomposed.

In this Embodiment 23, it has been assumed that the rate that the adsorber 1C adsorbs VOC is proportional to the VOC concentration and the rate that the adsorber 1C desorbs VOC is proportional to the power consumption, the calculation may be carried out by a more strict method while taking into consideration other factors. A proper calculation express adaptive with the purpose may be employed.

While the time for taking the action state B or the action state E has been fixed at a prescribed value, the time may be made variable. As an example in the case where the time is made variable, the case where the adsorption amount of VOC of the group of the gas treatment unit 1 which will subsequently take the action state B becomes a prescribed amount (for example, 75%) or more may be considered. In the case where the time is made variable, if the state that the VOC concentration is high is continued, the next group of the gas treatment unit 1 may be in the action state B without taking the action state E after the action state B.

By making the time for taking the action state B or the action state E variable, even in the case where the VOC concentration is low, since the decomposition treatment can be carried out after sufficiently adsorbing VOC on the adsorber, the VOC can be decomposed with good efficiency. However, for the purpose of waiting for sufficient adsorption of VOC, even if the VOC concentration abruptly increases and continues a high state, it should be considered that the adsorber does not cause breakdown. More specifically, even if the VOC concentration abruptly rises to 100% and the 100% state continues thereafter, the start time of the action state B in the next group of the gas treatment unit 1 is controlled such that the subsequent groups of the gas treatment unit 1 do not cause breakdown until the action state B has been completed in the next group of the gas treatment unit 1.

By fixing the applied voltage, the electric discharge current and the electric discharge continuation time in the action state B, only the time of the action state E may be made variable.

After the action state B, the action state A may be taken in place of the action state E. In that case, the number of group taking the action state A is different between the phase 0 where all of the groups take the action state A and a phase where one group takes the action state B or the action state E. When the number of group taking the action state A is different, if the flow rate of the gas to be treated is identical, the gas flow rate per gas treatment unit 1 is changed. In the case where the gas flow rate is changed, the VOC adsorption amount is calculated by integrating the VOC concentration against the gas flow rate. Incidentally, even by changing the number of group taking the action state A, the control can be achieved such that the gas flow rate per gas treatment unit 1 is not changed and that the total amount of the gas flow rate is changed.

While this Embodiment 23 has been based on Embodiment 1, it may be based on other embodiments.

The above can be applied to other embodiments using the VOC concentration sensor.

The invention thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A volatile organic compound treatment apparatus comprising:

an adsorber coming into contact with a gas to be treated and adsorbing volatile organic compounds;

a plurality of pairs of electrodes, divided into a plurality of groups, which generate electric discharge so that a part of the adsorber is exposed to the electric discharge; and an electric discharge control mechanism for controlling whether or not the electric discharge is generated in what pair of the electrodes by applying a voltage to every group of the pair of electrodes such that different parts of the adsorber are sequentially exposed to the electric discharge; and a flow rate regulating mechanism for feeding to the adsorber in the portion exposed to the electric discharge the gas to be treated at a smaller flow rate than that to the adsorber in the portion not exposed to the electric discharge.

2. The volatile organic compound treatment apparatus according to claim 1, wherein any of one-side electrodes of the plurality of pairs of electrodes is structured by an electrode.

3. The volatile organic compound treatment apparatus according to claim 1, wherein:

a dielectric is provided between the pair of electrodes, and an alternating current voltage is applied to the pair of electrodes.

4. The volatile organic compound treatment apparatus according to claim 1, further comprising:

a gas return mechanism for passing a gas in the reverse direction to the flow of the gas to be treated into the adsorber in the portion exposed to the electric discharge and the portion until elapsing a prescribed period of time after finishing exposed to the electric discharge.

5. The volatile organic compound treatment apparatus according to claim 1, further comprising:

a gas feed mechanism for feeding any one of a gas having a higher concentration of oxygen than that in the air or a gas containing oxygen and having a lower concentration of nitrogen than that in the air.

6. The volatile organic compound treatment apparatus according to claim 1, further comprising:

a VOC concentration sensor for measuring the concentration of the volatile organic compounds in the gas to be treated; wherein:

the amount of the volatile organic compounds having been adsorbed on the adsorber is determined from the concentration of the volatile organic compounds as measured by the VOC concentration sensor, and after the amount of the volatile organic compounds having been adsorbed on the adsorber in the portion exposed to the electric discharge generated by the pair of electrodes reaches a prescribed value or more, the electric discharge control mechanism applies a voltage to the pair of electrodes and generates the electric discharge.

7. The volatile organic compound treatment apparatus according to claim 1, further comprising:

a VOC concentration sensor for measuring the concentration of the volatile organic compounds in the gas to be treated; wherein:

the amount of the volatile organic compounds having been adsorbed on the adsorber is determined from the concentration of the volatile organic compounds as measured by the VOC concentration sensor, and the electric discharge control mechanism changes at least one of an applied voltage, an electric discharge current and an electric discharge continuation time depending upon the amount of the volatile organic compounds having been adsorbed on the adsorber in the portion exposed to the electric discharge at the moment of start of electric discharge.

8. The volatile organic compound treatment apparatus according to claim 1, wherein:

the adsorber is a dielectric formed such that a pore having a prescribed porosity and a prescribed size through which the gas to be treated passes, and an alternating current voltage is applied to the pair of electrodes.

9. A volatile organic compound treatment apparatus comprising:

at least first and second gas treatment units, each including a pair of electrodes which generate electric discharge upon application of a voltage thereto, and an adsorber disposed between the pair of electrodes and coming into contact with a gas to be treated and adsorbing volatile organic compounds;

an electric discharge control mechanism configured to selectively control application of voltage to selected of the pair of electrodes of a selected gas treatment unit such that different adsorbers are sequentially exposed to the electric discharge; and a flow rate regulating mechanism configured to control feed of a gas to be treated to said first and second gas treatment units so that a smaller amount of gas to be treated flows into the gas treatment unit having an adsorber exposed to electric discharge compared to the gas treatment unit in which an adsorber is not exposed to electric discharge.

* * * * *